US006773099B2

(12) United States Patent
Inoue et al.

(10) Patent No.: US 6,773,099 B2
(45) Date of Patent: Aug. 10, 2004

(54) LIQUID CONTAINER, LIQUID SUPPLYING APPARATUS, AND RECORDING APPARATUS

(75) Inventors: Ryoji Inoue, Kanagawa (JP); Hiroyuki Ishinaga, Tokyo (JP); Nobuyuki Kuwabara, Tokyo (JP); Tetsuya Ohashi, Chiba (JP); Hideki Ogura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/262,964

(22) Filed: Oct. 3, 2002

(65) Prior Publication Data

US 2003/0067520 A1 Apr. 10, 2003

(30) Foreign Application Priority Data

| | | |
|---|---|---|
| Oct. 5, 2001 | (JP) | 2001-310646 |
| Oct. 5, 2001 | (JP) | 2001-310647 |
| Oct. 5, 2001 | (JP) | 2001-310648 |
| Dec. 27, 2001 | (JP) | 2001-398214 |
| Dec. 27, 2001 | (JP) | 2001-398215 |

(51) Int. Cl.[7] ..... B41J 2/175
(52) U.S. Cl. ..... 347/86
(58) Field of Search ..... 347/85, 86, 87; 137/439

(56) References Cited

U.S. PATENT DOCUMENTS

| | | | | | |
|---|---|---|---|---|---|
| 5,409,134 | A | | 4/1995 | Cowger et al. | 222/1 |
| 5,453,772 | A | * | 9/1995 | Aono et al. | 347/87 |
| 5,505,339 | A | | 4/1996 | Cowger et al. | 222/105 |
| 5,600,358 | A | | 2/1997 | Baldwin et al. | 347/87 |
| 5,754,207 | A | * | 5/1998 | Gragg et al. | 347/86 |
| 5,767,882 | A | * | 6/1998 | Kaplinsky et al. | 347/87 |
| 5,801,737 | A | * | 9/1998 | Sato et al. | 347/86 |
| 5,812,155 | A | * | 9/1998 | Seccombe | 347/6 |
| 5,975,330 | A | | 11/1999 | Sasaki et al. | 220/495.01 |
| 6,186,620 | B1 | | 2/2001 | Hsieh et al. | 347/84 |
| 6,213,598 | B1 | * | 4/2001 | Hou et al. | 347/86 |
| 6,250,751 | B1 | * | 6/2001 | Whitney et al. | 347/87 |
| 2003/0035036 | A1 | | 2/2003 | Ogura et al. | |

FOREIGN PATENT DOCUMENTS

| | | | | |
|---|---|---|---|---|
| EP | 463849 | | 1/1992 | |
| JP | 3-24900 | | 2/1991 | |
| JP | 6-183023 | | 7/1994 | |
| JP | 08-183023 | A * | 7/1994 | 347/86 |
| JP | 7-125240 | | 5/1995 | |
| JP | 7-125241 | | 5/1995 | |
| JP | 9-267483 | | 10/1997 | |

* cited by examiner

*Primary Examiner*—Anh T. N. Vo
(74) *Attorney, Agent, or Firm*—Fitzpatrick, Cella, Harper & Scinto

(57) ABSTRACT

In a configuration having an ink containing portion which is deformable at least in a part thereof, a spring for generating a required negative pressure in the container by exerting a force that expands the deformable part, and an air introducing section for allowing air to be introduced in accordance with an increase in the negative pressure in the container to keep the negative pressure in an adequate range, a one-way valve is used to prevent leakage of ink from a sealed containing space containing ink to the outside and to allow introduction of air into the containing space from the outside. As a result, there is provided an ink tank from which no ink leaks out through the air introducing section thereof in any ambience for use or storage and which can maintain stable negative pressure characteristics regardless of the phase of the consumption of the liquid.

18 Claims, 55 Drawing Sheets

LIQUID CONTAINER, LIQUID SUPPLYING APPARATUS, AND RECORDING APPARATUS

This application is based on Japanese Patent Application Nos. 2001-310648, 2001-310647 and 2001-310646 filed Oct. 5, 2001, and Nos. 2001-398215 and 2001-398214 filed Dec. 27, 2001, the content of which are incorporated hereinto by reference.

BACKGROUND OF THE INVENTION

1. Field of the Invention

The present invention relates to a liquid container, a liquid supplying apparatus, and a recording apparatus for supplying a liquid such as ink to a pen or recording head as a recording section, for example, in an efficient and stable manner, and to an ink jet cartridge.

2. Description of the Related Art

Ink jet recording apparatuses that form an image on a recording medium by applying ink that is a liquid to the recording medium using a liquid consuming or using apparatus such as an ink jet recording head include apparatus that form an image by ejecting ink while moving a recording head relative to a recording medium and apparatus that form an image by ejecting ink while moving a recording medium relative to a fixed recording head conversely.

Methods of supplying ink to a recording head used in such an ink jet recording apparatus include a method referred to as on-carriage method in which an ink tank is integrally or separably mounted to a recording head that is carried by a carriage to be moved back and forth (main scanning) and in which ink is directly supplied from the ink tank to the recording head. There is another method referred to as tube supply method in which an ink tank is fixed in a region of a recording apparatus other than a carriage as a body separate from a recording head carried by the carriage and in which ink is supplied by coupling the ink tank and the recording head through a flexible tube. The method includes a configuration in which a second ink tank to serve as an intermediate tank (sub-tank) between an ink tank (main tank) and a recording head is mounted on the recording head or a carriage and in which ink is directly supplied from the second ink tank to the recording head.

According to those methods, an ink tank to supply ink to a recording head directly is provided with a mechanism for generating an adequate negative pressure in a range in which the negative pressure is in equilibrium with a pressure in the recording head to hold meniscuses formed at an ink ejecting section thereof to prevent the ink from leaking from the ink ejecting section satisfactorily and in which an ink ejecting operation of the recording head can be performed.

In a negative pressure generating mechanism of this type, a porous member such as a sponge that is impregnated with ink to be held thereby is contained in an ink tank, and an adequate negative pressure is generated by an ink holding capacity of the same.

In another mechanism, a bag-shaped member formed from a material such as rubber having an elastic force and generating a tension in the direction of increasing the volume thereof is charged with ink as it is, and the tension generated by the bag-shaped member exerts a negative pressure to the in therein.

In still another mechanism, a bag-shaped member is formed using a flexible film, and a spring for urging the film in the direction of increasing the volume of the bag-shaped member is bonded to the interior or exterior of the same to generate a negative pressure.

In any of the above mechanisms, however, the negative pressure tends to increase as the amount of ink in the ink tank decreases, and it becomes impossible to supply ink to a recording head stably when the level of the negative pressure exceeds a predetermined value. This results in a problem in that the ink tank becomes unusable before the ink is completely used up.

For example, there is Japanese Patent Application Publication No. 3-024900 (1991) which discloses a structure of an ink tank of a type which is constituted by a flexible enclosed bag-shaped member that directly contains ink therein and that can be deformed according to the amount of contained ink and in which a spring member is provided in the bag-shaped member. Since the negative pressure is basically determined such that the spring force and a force resulting from the negative pressure (or a difference between the atmospheric pressure and the negative pressure) are balanced with each other, the negative pressure in the bag-shaped member increases as the deformation of the spring proceeds with the deformation of the bag-shaped member as a result of ink consumption. This may result in a problem in that the negative pressure increases beyond a proper range in which an ink ejecting operation of the recording head can be performed to prevent the formation adequate meniscuses at the ink ejecting section of the recording head or in that the ink can not be satisfactorily supplied to the recording head. This also disallows the ink to be used completely.

Some ink tanks have a configuration in which ink is contained in a bag-shaped member, and the material and shape of which are appropriately selected to generate a negative pressure by the bag-shaped member itself and which becomes flat with no space left therein when the ink is completely used up, but there are limitations on the shape of such a bag-shaped member. Therefore, when such an ink tank is configured to be contained in a box-like housing, the configuration of the bag-shaped member does not fit the interior of the housing completely even when it is charged with ink, and the volumetric efficiency of the ink tank is low with respect to the entire space available therein. Such a bag-shaped member also has a problem in that its performance of supplying ink to a recording head can be reduced and in that it can make an ink ejecting operation of a recording head unstable when ink is nearly used up because of a high negative pressure.

Several mechanisms have been proposed as follows to prevent magnitude of a negative pressure being too much greater than the predetermined level.

For example, Japanese Patent Application Laid-open No. 7-125240 (1995) and Japanese Patent Application Laid-open No. 7-125241 (1995) have disclosed mechanisms in which a hydrophobic film and a tubular vent port are provided in a tank, and a spherical body is disposed in the tube to introduce air into the tank when a negative pressure therein increases. That is, those publications have disclosed mechanisms which have a tubular vent port (boss) that establishes communication between the outside and inside of a container and in which spherical body having an outer diameter smaller than an inner diameter of the boss is attached to a plurality of projecting ribs provided on an inner wall of the boss to form a substantially annular orifice with the spherical body and the boss. The size of such an orifice is chosen such that a small amount of ink is kept in the orifice as a liquid seal because of the capillarity of ink. The orifice is configured such that a negative pressure in the container over-comes the capillarity of ink to disable the liquid seal when it nearly reaches the limit of an operating range of the recording head.

Japanese Patent Application Laid-open No. 6-183023 (1994) has disclosed a mechanism in which a plate-like member having a hole and a plate having a protrusion are provided in a face-to-face relationship in an ink bag constituted by a flexible sheet with a spring member disposed between the plates and in which the protrusion enters the hole when an internal negative pressure exceeds a predetermined value to separate the plate having the hole and the flexible sheet from each other, thereby introducing air in the tank. In this mechanism, the plate having the hole and the flexible sheet come into tight contact with each other after air is introduced, and leakage of ink is prevented by an ability for holding ink meniscuses or a liquid seal formed between those elements.

However, those methods require a plurality of parts in a region where air is introduced, and the structure of such a region has therefore become complicated.

When a pressure in a container T having a certain amount of air introduced therein becomes extremely high as a result of an ambient change (a reduction of the atmospheric pressure or a temperature rise) as shown in FIG. 1A, ink is pushed out from the container as shown in FIG. 1B, which can result in leakage of ink through an ink ejection port N or a vent hole A when the container is used in an ink jet recording head. When a liquid is contained in a bag-shaped member constituted by a flexible sheet, although expected is a certain degree of buffering effect that moderates an increase of a pressure therein by accommodating expansion of air which results in a pressure reduction, such an effect is limited.

In the configuration disclosed in Japanese Patent Application Laid-open No. 7-125240 (1995) or Japanese Patent Application Laid-open No. 7-125241 (1995), an enclosed system is established by balancing a force originating from ink meniscus formed in the region of the annular orifice and a negative pressure provided by the spring. Although the mechanical configuration is relatively simple, it is insufficient in stability in maintaining the enclosed system. Specifically, a problem arises in that contained ink can leak out because of breakage of a liquid seal that is attributable to various conditions such as a difference between air pressures inside and outside the container, a reduction of the viscosity of ink resulting from an increase in the temperature of ink, a shock or drop that occurs when the ink tank is handled alone, and acceleration that occurs during main scanning according to the serial recording method, in particular. Further, a liquid seal is vulnerable to humidity changes such as drying, which causes variations in the operation of introducing air bubbles and consequently reduces the capability of supplying ink to a recording head and hence the quality of recording.

It is assumed that the above publications have disclosed configurations in which an entrance maze serving as an overflow container and ensuring a humidity gradient is provided contiguously with a boss in order to prevent such problems, but the configurations become complicated accordingly. Further, since the other end of the channel in the form of a maze is always in communication with the atmosphere, a certain degree of ink evaporation is unavoidable.

When ink in the container is used up, outside air is abruptly introduced to eliminate the negative pressure in the container. This can cause ink remaining in the region of the recording head to leak out through the ejection port, and the residual ink can leak out through the annular orifice that no longer forms meniscus.

Further, in those examples of the related art, there is provided an opening section for directly introducing the atmosphere into an ink tank. As a result, the quantity of gases in the ink tank becomes relatively great in a region in the ink tank where ink is nearly used up depending on the size and position of the opening section, which can result in incomplete holding of meniscuses at the ink ejection port or opening section when the negative pressure is eliminated as a result of introduction of the atmosphere and can therefore lead to leakage of ink or incomplete introduction of the atmosphere.

In addition, breakage of a liquid seal can occur because of various conditions such as a difference between air pressures inside and outside the container, a temperature rise of drop, a shock or drop that occurs when the ink tank is handled alone, and acceleration that occurs during main scanning according to the serial recording method, in particular. This results in a problem in that air can be introduced or ink can leak out conversely even when a pressure in the container has not reached a predetermined value. Further, such conditions can vary depending on the designs of the recording head and ink tank or physical properties of ink, and a problem arises also in that designing must be adequately carried out in accordance with the shape and dimensions of the opening section and the basic configuration of the negative pressure generating mechanism depending on each mode of use.

The above ink tank utilizing a liquid seal for introducing air creates problems such as a reduction of freedom in designing a recording apparatus in addition to problems inherent in it as described above.

Specifically, it is not easy to configure such a liquid seal section as an element separate from an ink tank by making it detachable from the ink tank, for example. In case that the liquid seal section is provided as a separate element, a complicated process or apparatus configuration will be required when attaching the element to an ink tank directly or connecting it to the ink tank indirectly through a tube in order to form preferable meniscus in an annular section as described above taking factors such as a difference between pressures inside and outside the ink tank into consideration.

When the liquid seal section is provided in a position apart from an ink tank with a tube interposed therebetween, the tube must be filled with ink to form meniscus at the liquid seal section. However, the ink in the tube will be returned to the ink tank when air is introduced through the liquid seal section, and a complicated process or configuration will be required to refill the tube with ink thereafter as described above.

The technique disclosed in the Japanese Patent Application Laid-open No. 6-183023 (1994) employs a structure in which air is introduced through a microscopic gap between a thin plate-like member and a flexible sheet. This has resulted in another problem in that a negative pressure becomes unstable when air is introduced because the force for causing separation as described is changed by a capillary force that is generated when a liquid enters the gap.

Further, in order to provide a sufficient buffering function, a member that has extremely low rigidity and that is easy to deform is used as the flexible member for moderating an internal pressure of a container by substantially increasing the volumetric capacity of the container through the deformation of the flexible member itself when the pressure of a gas (air) in the container increases as a result of a temperature rise.

However, since a material having low rigidity used as such a flexible member has a small thickness and exhibits high permeability against gases in general, it is likely to allow a gas to penetrate into a container because of an osmotic pressure of the gas. This has resulted in the possibility of insufficient performance of the buffering function when a liquid is kept in the container for a long time because a gas (air) can penetrate into the container in a quantity that cannot be handled by the buffering function for absorbing expansion of the gas in the container. Therefore, it has been necessary to use a quite expensive material having a metal deposited thereon as the material of the flexible member in order to achieve low rigidity and a reduction in gas permeability at the same time.

SUMMARY OF THE INVENTION

From the above, the inventors first found that it is undesirable to eliminate a negative pressure in a liquid container by introducing air into the container and that it is important to return the pressure to a predetermined negative pressure value. Further, the inventors consider that an appropriate amount of air must be introduced for this purpose.

In particular, when a liquid container is used as an ink tank for directly supplying into to an ink jet recording head, it is inevitable to supply ink at a stable rate of flow and in a stable amount to perform recording at a high speed with high quality. For this purpose, it is strongly desired to keep a substantially constant resistance in an ink supply channel against a flow of ink. Therefore, the stabilization of a negative pressure in an ink tank is an important factor and, more specifically, it is important to keep the negative pressure in a predetermined range. For this purpose, a part for introducing air must operate with reliability.

It is also important to allow a liquid to be contained in a container in a proper state by reducing opportunities when those members are subjected to an osmotic pressure of a gas to reduce penetration of the gas into the container and to allow the contained liquid to be supplied with stability.

The invention has been made taking the above-described problems into consideration and achieves at least one of the following aims.

In a configuration of a containing portion of a liquid (e.g., ink) to be supplied to the outside (e.g., a recording head) having a section for generating a required negative pressure and an air introducing section for keeping the negative pressure within a proper range by allowing air to be introduced into the containing section in accordance with an increase in a negative pressure therein as a result of the supply of the liquid, the invention makes it possible to prevent the liquid from leaking out though the air introducing section in any environment of use and storage and to maintain stable negative pressure characteristics regardless of the phase of consumption of the liquid.

The invention provides a liquid container (such as an ink tank) in which introduction of outside air for maintaining a constant negative pressure in the liquid container is performed reliably at adequate timing to stabilize the negative pressure with higher reliability and in which leakage of a liquid through a liquid supply port is prevented even at an abrupt ambient change to avoid wasteful consumption of the liquid eventually, and the invention also provides a liquid-consuming apparatus (such as an ink jet recording apparatus) utilizing the liquid container.

The invention provides an ink tank having a negative pressure adjusting mechanism with which problems inherent in ink tanks as described above utilizing a liquid seal can be solved and with which freedom in designing a recording apparatus can be improved, an ink jet recording head, an ink jet cartridge having the ink jet recording head and the ink tank as integral parts thereof, and an ink jet recording apparatus.

The invention provides a liquid container with a simple structure which absorbs changes in a negative pressure therein as a result of consumption of a liquid to stabilize the negative pressure, which prevents leakage of the liquid through a liquid supply port even at an abrupt ambient change, and which can be manufactured at a low cost, and the invention provides a liquid-ejection recording apparatus utilizing the liquid container.

The invention provides a liquid container a part of which is constituted by a flexible member and a member having high gas permeability, in which a liquid can be properly contained by reducing opportunities when those members are subjected to an osmotic pressure of a gas to reduce penetration of the gas into the container, and from which the contained liquid can be supplied with stability, the invention also providing a recording apparatus utilizing the same.

In a first aspect of the invention, there is provided a liquid container comprising:

- a containing portion defining a containing space for liquid;
- a liquid supply portion provided with the containing portion and forming a liquid supply port for supplying liquid contained in the containing portion to the outside;
- a one-way valve arranged on the containing portion for allowing an introduction of gas into the containing space from outside, and preventing a leakage of liquid and gas to the outside; and
- a mechanism having a function for keeping or expanding a capacity of the containing space, wherein
  - the one-way valve controls a negative pressure in the containing space caused by consumption of liquid in the containing portion.

Here, the mechanism may include a movable member equipped with at least a part of the containing portion displaceably or deformably, and an urging means for urging the movable member in a direction a capacity of the containing space increases.

Further, the containing portion may have a deformable flexible member in a part thereof as the movable member and is configured so that liquid is present inside the flexible member contacting with the outside space.

There is provided a liquid using apparatus connectable with the liquid container according to the first aspect and using liquid supplied from the containing space.

Further, there is provided a recording apparatus comprising means using the liquid using apparatus having a configuration of recording head for performing a recording with ink supplied from the liquid container which contains ink as the liquid.

Still further, there is provided an ink jet head cartridge comprising:

- an ink jet head for ejecting ink; and
- a liquid container, according to the first aspect, for containing ink as the liquid to be supplied to the ink jet head.

In a second aspect of the invention, there is provided a liquid supplying method for supplying liquid to the outside from a containing portion defining a containing space for liquid through a supply port formed on the containing portion, comprising the steps of:

providing a one-way valve for allowing an introduction of gas into the containing space from outside, and preventing a leakage of liquid and gas to the outside;

providing a mechanism having a function for keeping or expanding a capacity of the containing space, and;

controlling a negative pressure in the containing space caused by consumption of liquid in the containing portion by the one-way valve.

In a third aspect of the invention, there is provided a liquid supply apparatus, comprising:

a containing portion which defines a containing space for liquid and includes a liquid supply portion for forming a liquid supply port for supplying contained liquid to the outside and a gas introduction portion for introducing gas from outside into the containing space;

a mechanism having a function for keeping or expanding a capacity of the containing space; and a one-way valve having a gas introducing member mountable on the gas introduction portion in which, in the state where the gas introduction member is mounted onto the gas introduction portion, an introduction of the gas is allowed through the gas introduction portion and a leakage of liquid and gas from the containing space to the outside is prevented, and the one-way valve for controlling a negative pressure in the containing space caused by consumption of liquid in the containing portion.

There is provided an ink tank for the liquid supply apparatus according to the third aspect, comprising:

the containing portion for containing ink as the liquid; and a mechanism having a function for keeping or expanding a capacity of the containing space.

Further, there is provided an ink jet recording apparatus for performing a recording by ejecting ink onto a recording medium by using this ink tank and a recording head for ejecting ink supplied by the ink tank, comprising:

a holder for mounting the ink tank;

a one-way valve for allowing communication of fluid flowing into one direction and preventing communication of fluid toward the other direction; and a flow path being connected with the one-way valve and being open and closed thereby; wherein the holder having a member communicating with the flow path and the ink tank having a mounting portion capable of detachably mounting the member of the holder, whereby gas is introduceable thereinto through the one-way valve and the member of the holder.

There is provided an ink jet cartridge, comprising:

an ink tank for constituting the liquid supply apparatus according to the third aspect, the ink tank having the containing portion for containing ink as the liquid and a mechanism having a function for keeping or expanding a capacity of the containing space; and an recording head for ejecting ink supplied from the ink tank through a communicating path, the recording head being formed integral with the ink tank.

Further, there is provided an ink jet recording apparatus for performing a recording by ejecting ink onto a recording medium by using this ink jet cartridge, comprising:

a holder for mounting the ink jet cartridge;

a one-way valve for allowing communication of fluid flowing into one direction and preventing communication of fluid toward the other direction; and a flow path being connected with the one-way valve and being open and closed thereby; wherein the holder having a member communicating with the flow path and the ink tank of the ink jet cartridge having a mounting portion capable of detachably mounting the member of the holder, whereby gas is introduceable thereinto through the one-way valve and the member of the holder.

In a fourth aspect of the invention, there is provided a one-way valve for, mounted on a containing portion which defines a containing space for liquid, allowing an introduction of gas from outside to the containing space and preventing a leakage of liquid and gas from the containing space to the outside, the one-way valve comprising:

a hollow gas introduction member for inserting into the containing space;

a valve chamber communicated with the gas introduction member and having an opening portion which allows an introduction of gas from outside; and an opening/closing member which is provided with the valve chamber and urged in the direction the opening portion is closed, whereby being activated to open the opening portion if the pressure within the containing space becomes less than the predetermined value.

In a fifth aspect of the invention, there is provided a liquid container, comprising:

a liquid containing chamber having a movable member defining a containing space of liquid at least in part thereof and being deformable according to a supply of the liquid to the outside, and having a liquid supply port for supplying liquid contained therein; and a valve chamber communicating with the containing space and having a one-way valve which allows an introduction of gas into the containing space form outside and prevents a leakage of liquid and gas to the outside from the containing space; wherein the liquid containing chamber includes an elastic member for generating an urging force F1 in the direction increasing a content of the containing space, and an urging means for receiving the urging force F1 to urge the movable member with an area S1 against the direction;

the valve chamber includes a valve controlling member for generating an urging force F2 in order to control an opening operation of the on-way valve, and a closing means for receiving the urging force F2 to close the one-way valve by an act of the urging force F2 with an area S2; and the one-way valve is configured to be open in order to introduce air from outside, assuming that the pressure resulted from the meniscus of the liquid formed in a communicating portion which makes a communication between the containing space and the valve chamber when the liquid is present in the communicating portion is PM, the height between the meniscus and the uppermost of ink in the containing space is h, the density of the liquid is ρ, and the acceleration of gravitation is g, respectively; an absolute value of the negative pressure $PV=-(F1/S1)+h\times\rho\times g+PM$ acting on the valve chamber satisfies $$|PV|>|F2|/S2.$$

Here, the valve chamber may be configured to have a communication with the containing space at a portion of the liquid containing chamber which retains the introduced gas, and when the following formula $$|F1|/S1>|F2|/S2$$

is satisfied, the one-way valve is open to introduce air from outside.

In a sixth aspect of the invention, there is provided a liquid container, comprising:

a movable member which defines a containing space for liquid and is displaceable according to supply of the liquid;

a liquid supply port for supplying the contained liquid to the outside; and a one-way valve having a port capable of introducing gas into the containing space and a sealing member for sealing the port; wherein the one-way valve is opened to introduce the gas when a capacity of the containing space starts to decrease due to a displacement of the movable member according to supply of the liquid and becomes lower than the predetermined value.

In a seventh aspect of the invention, there is provided a liquid container having a liquid supply port for supplying the contained liquid to the outside and a valve chamber equipped with a one-way valve for allowing an introduction of gas into the containing space from outside and preventing a leakage of liquid and gas from the containing space to the outside, the liquid container being generally sealed except for the liquid supply port and the one-way valve, comprising:

a negative pressure generating means for applying negative pressure to the liquid supply from the liquid supply port; and a negative pressure controlling means for controlling the negative pressure by introducing the gas, wherein the negative pressure controlling means has a function to prevent a discharge caused by an operation tempting to discharge liquid and gas to the outside therefrom.

In a eighth aspect of the invention, there is provided a liquid container, comprising:

a movable member which defines a containing space for liquid and is displaceable in accordance with a supply of the liquid;

a liquid supply port for supplying the contained liquid to the outside;

an opening capable of introduction of gas into the containing space; and a valve body for sealing the opening; wherein, the containing space is configured to maintain the capacity thereof about the predetermined value regardless of a supply of the liquid and an introduction of the gas, after the capacity of the containing space starts to decrease according to the supply of the liquid from the state where the containing space is generally filled with the liquid to be lower than the predetermined value which causes an introduction of gas.

There is provided a liquid using apparatus capable of being joined with the liquid container according to any one of the fifth to eighth aspects, wherein liquid supplied from the containing space is used.

Further, there is provided a recording apparatus utilizing a liquid container according to any one of the fifth to eighth aspects in which an ink as a recording agent is contained, and performing a recording with ink supplied from the containing space.

Moreover, there is provided an ink jet cartridge, comprising:

a liquid container according to any one of the fifth to eighth aspects in which an ink as a recording agent is contained; and a recording head capable of ejecting ink from an ink ejection port, the recording head being joined with the containing space and the ink being supplied from the containing space.

In the above, an ink as the liquid may contain pigment as a color material.

Incidentally, in the present specification, the wording "recording" means not only a condition of forming significant information such as characters and drawings, but also a condition of forming images, designs, patterns and the like on printing medium widely or a condition of processing the printing media, regardless of significance or unmeaning or of being actualized in such manner that a man can be perceptive through visual perception.

Further, the wording "printing medium" means not only a paper used in a conventional printing apparatus but also everything capable of accepting inks, such as fabrics, plastic films, metal plates, glasses, ceramics, wood and leathers, and in the following, will be also represented by a "sheet" or simply by "paper".

Still further, the wording "ink" should be interpreted in a broad sense as well as a definition of the above "printing" and thus the ink, by being applied on the printing media, shall mean a liquid to be used for forming images, designs, patterns and the like, processing the printing medium or processing inks (for example, coagulation or encapsulation of coloring materials in the inks to be applied to the printing media).

The above and other objects, effects, features and advantages of the present invention will become more apparent from the following description of embodiments thereof taken in conjunction with the accompanying drawings.

BREIF DESCRIPTION OF THE DRAWINGS

Figure 1B:
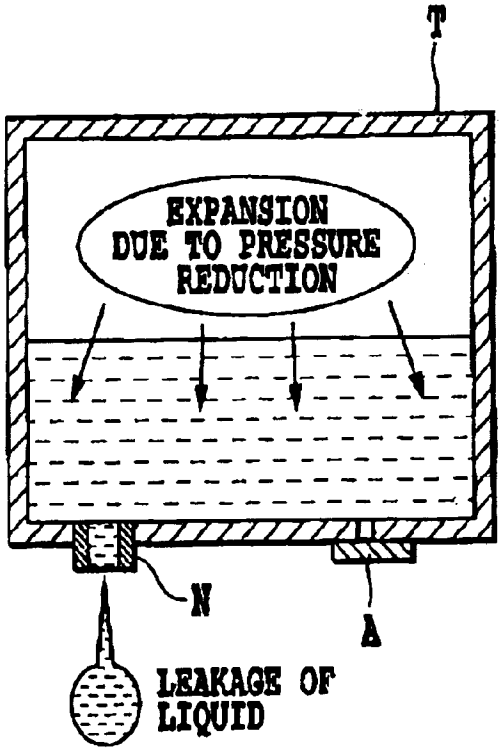
FIGS. 1A and 1B are illustrations for explaining problems with a liquid container according to the related art into which outside air is introduced to moderate an increase of a negative pressure that occurs as a result of consumption of a liquid (ink)
Figure 1A:
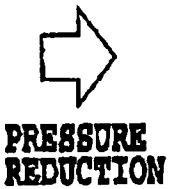
Figure 1A:
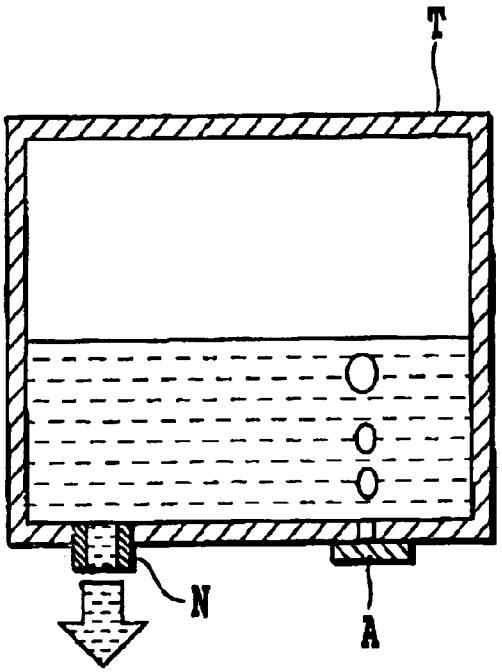
Figure 2:
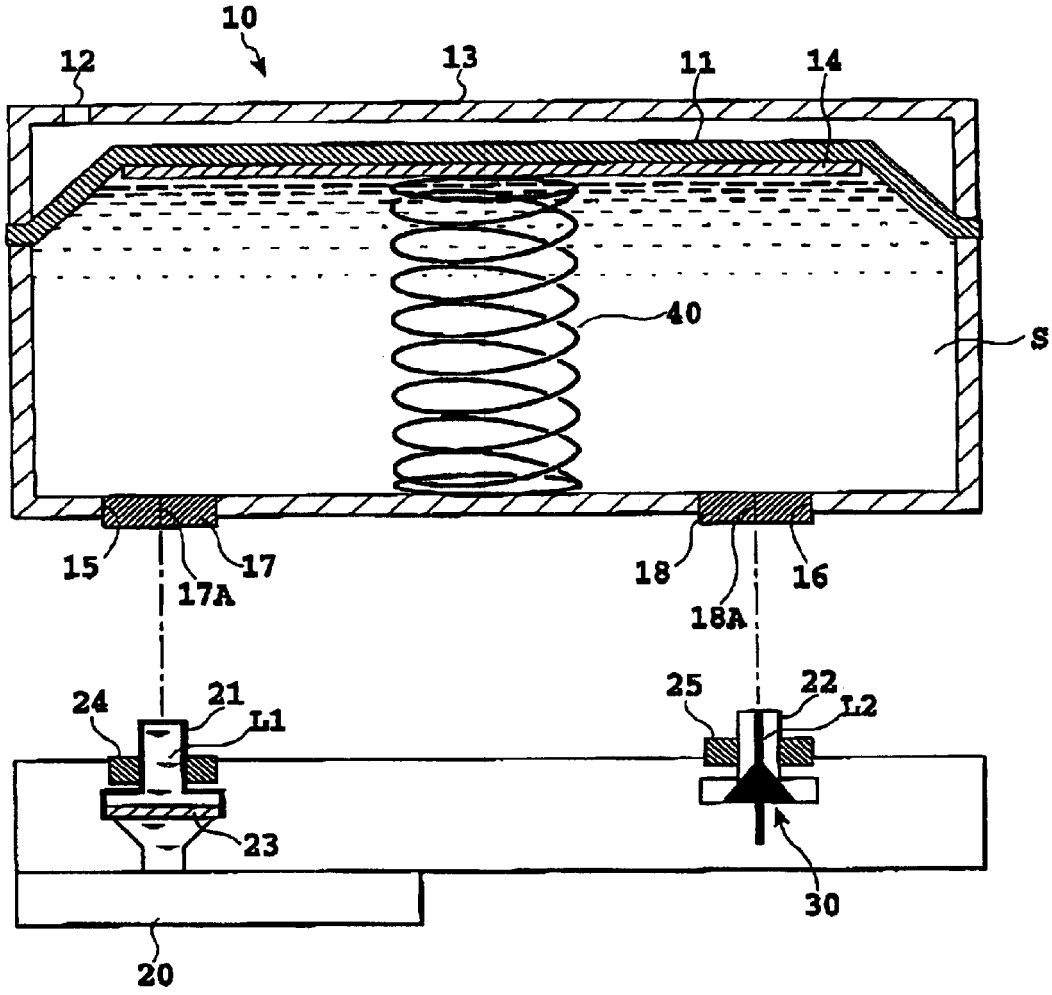
FIG. 2 is a schematic sectional view of a configuration of an ink tank and a recording head in a first embodiment of a basic configuration according to the invention.
Figure 4A:
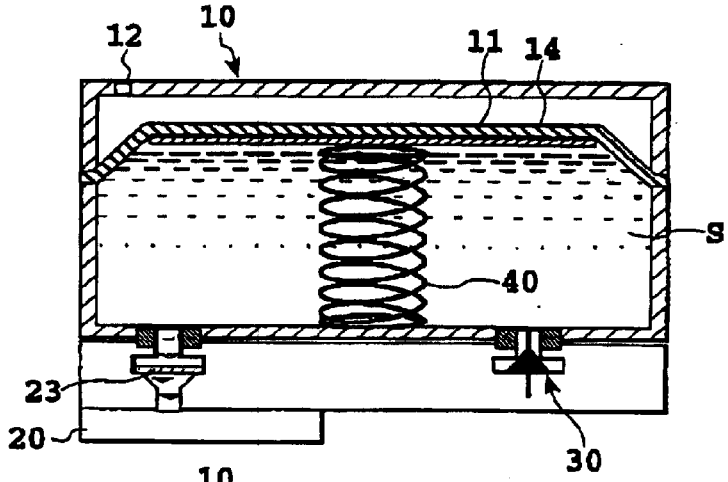
Figure 4B:
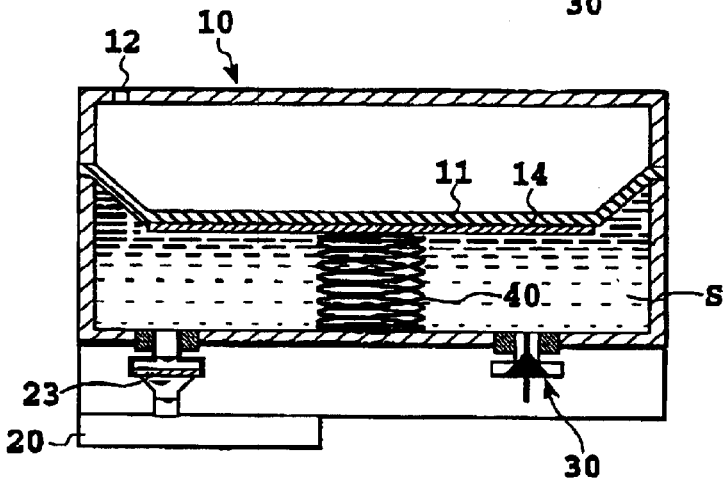
Figure 4C:
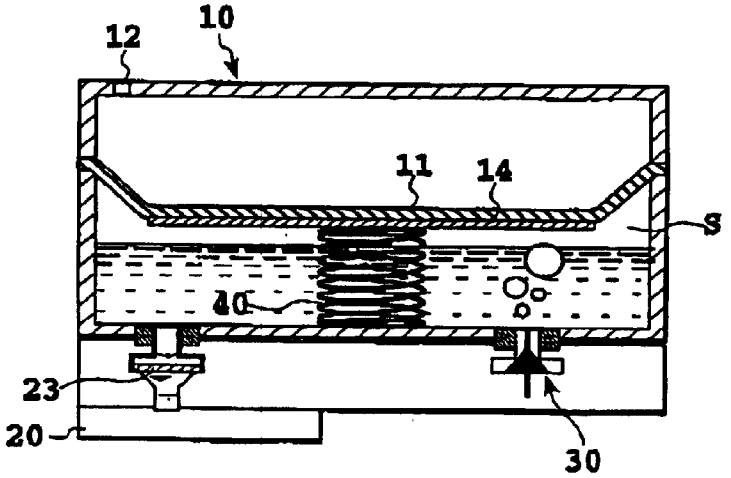
Figure 5:
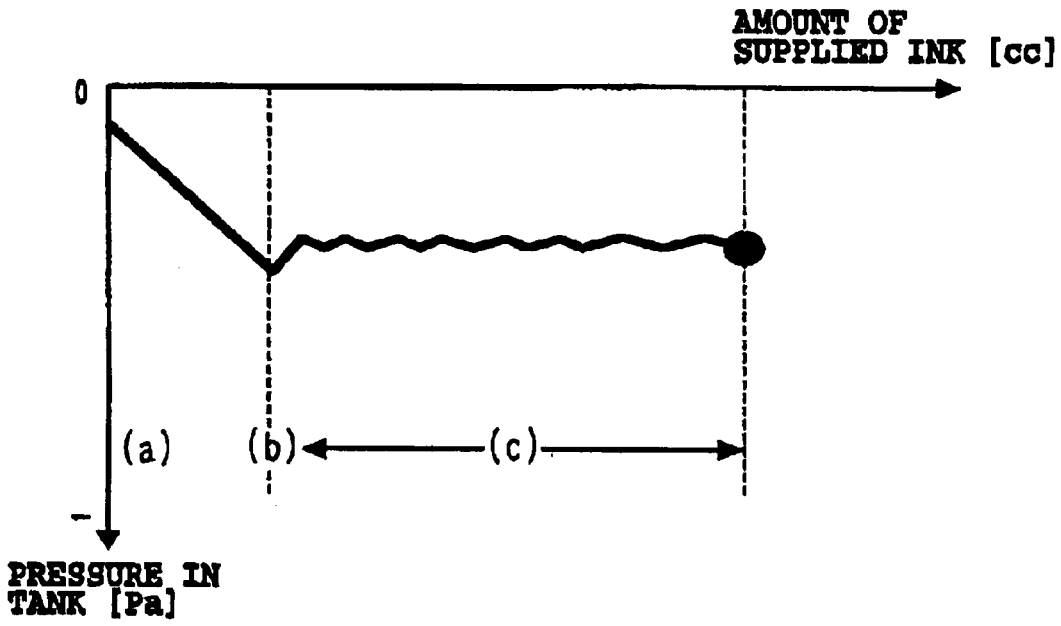
Figure 6:
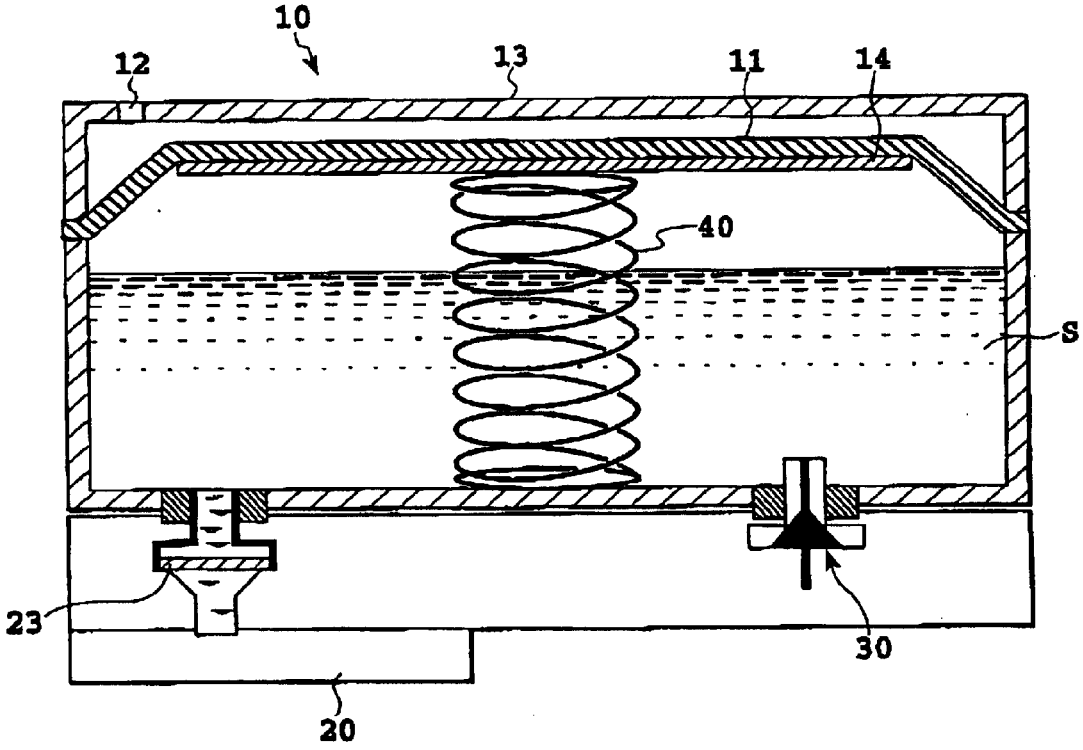
Figure 7:
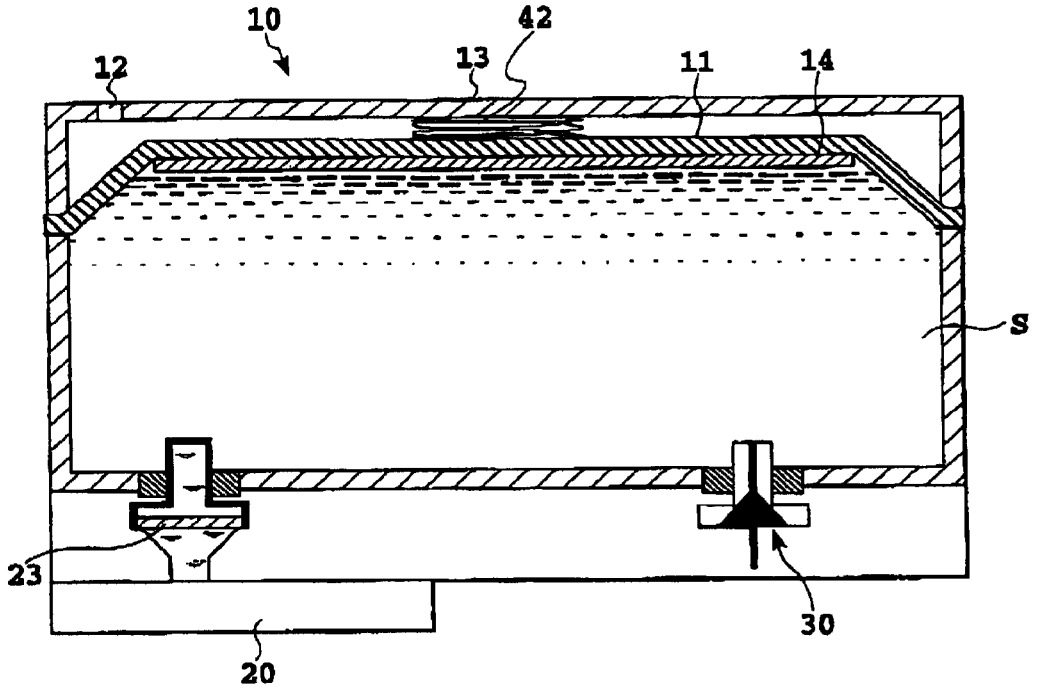
Figure 8:
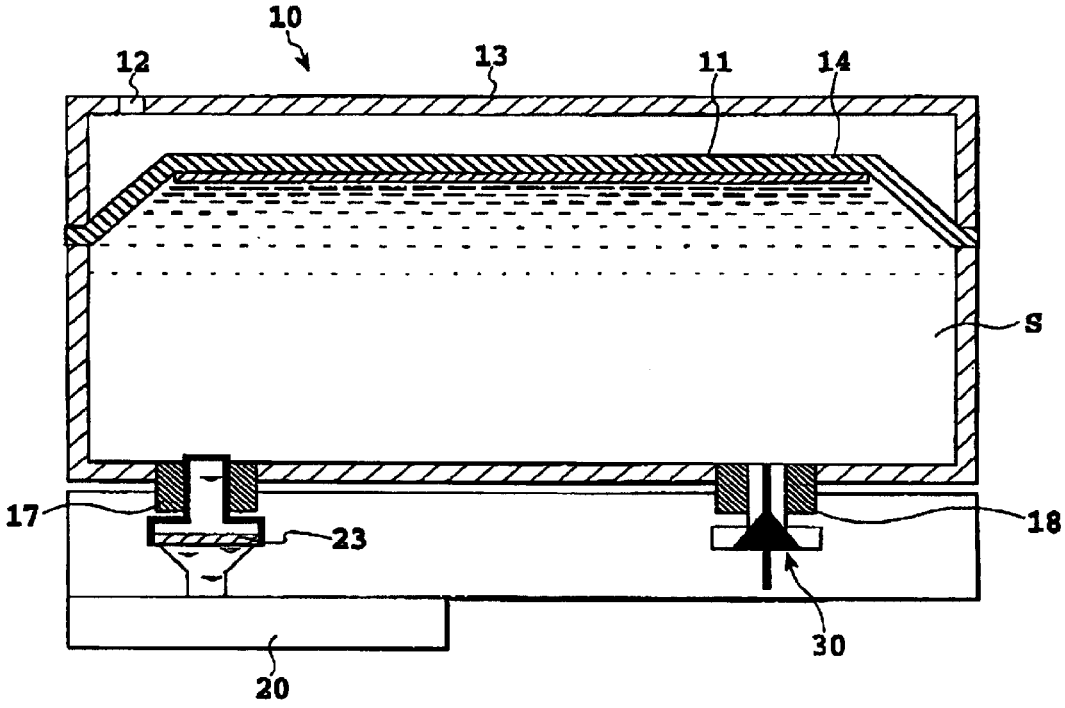
Figure 9:
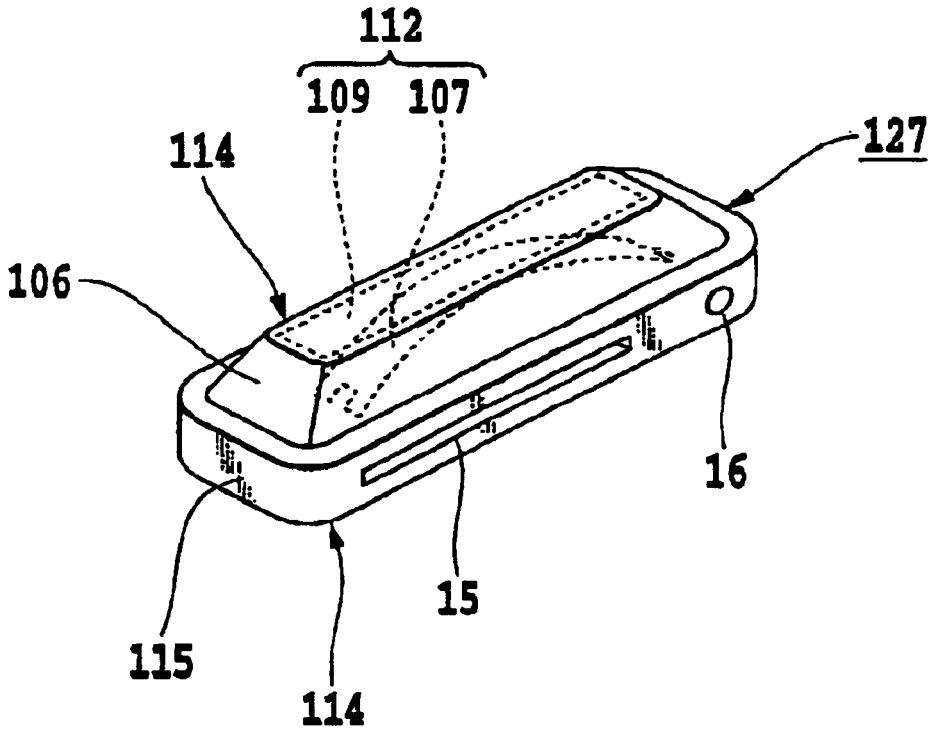
Figure 10A:
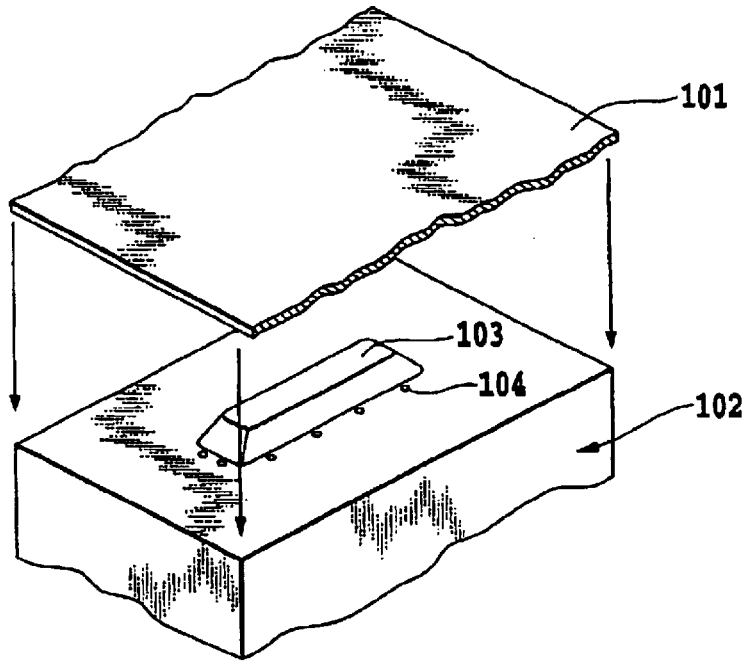
Figure 10B:
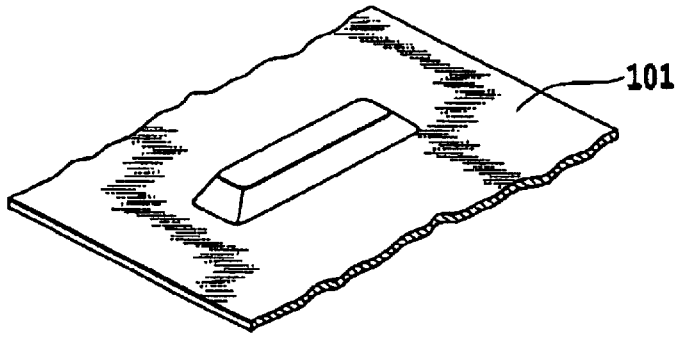
Figure 10C:
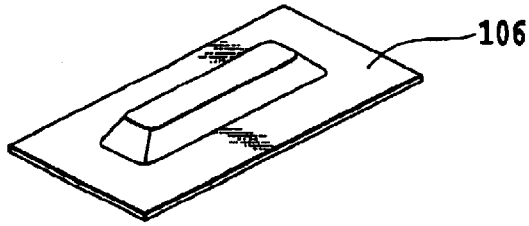
Figure 11A:
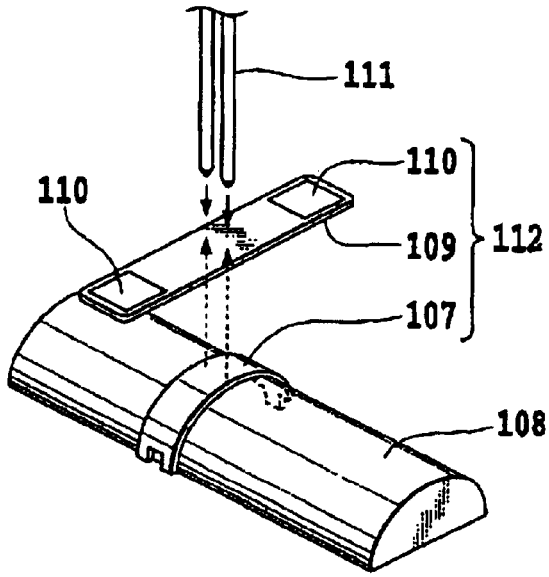
Figure 11B:
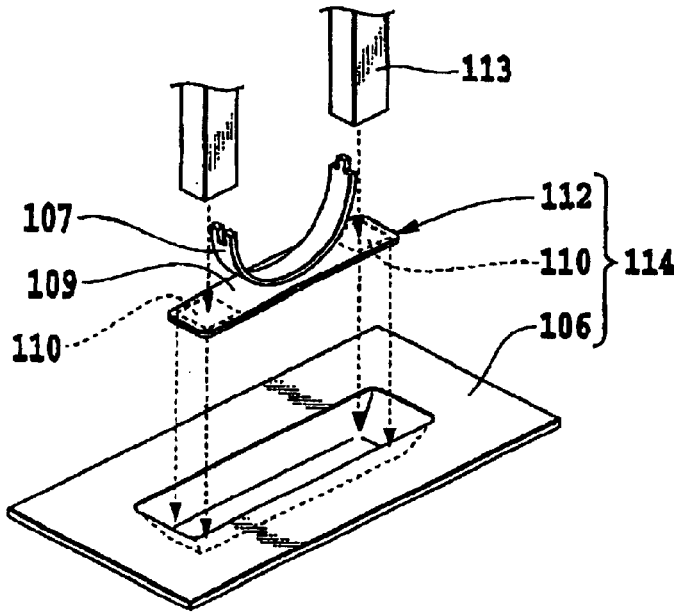
Figure 12A:
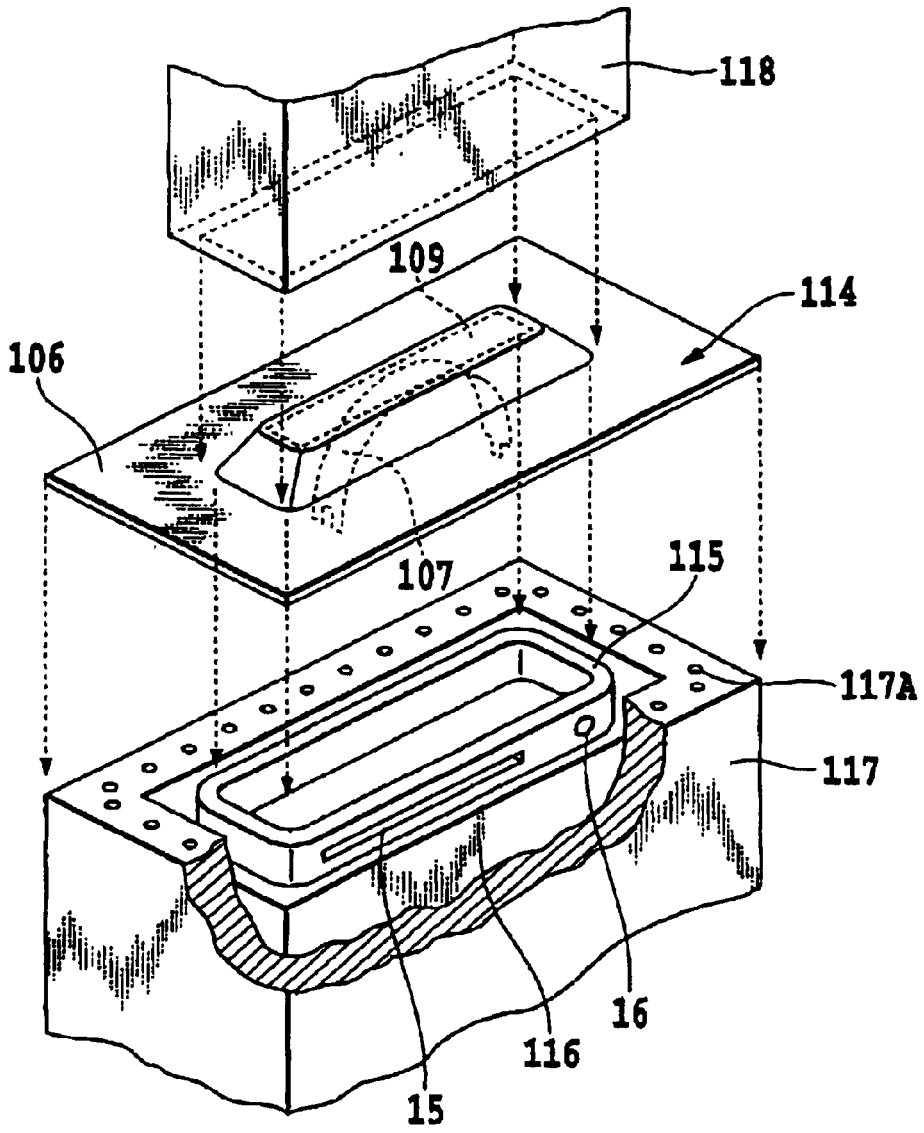
Figure 12B:
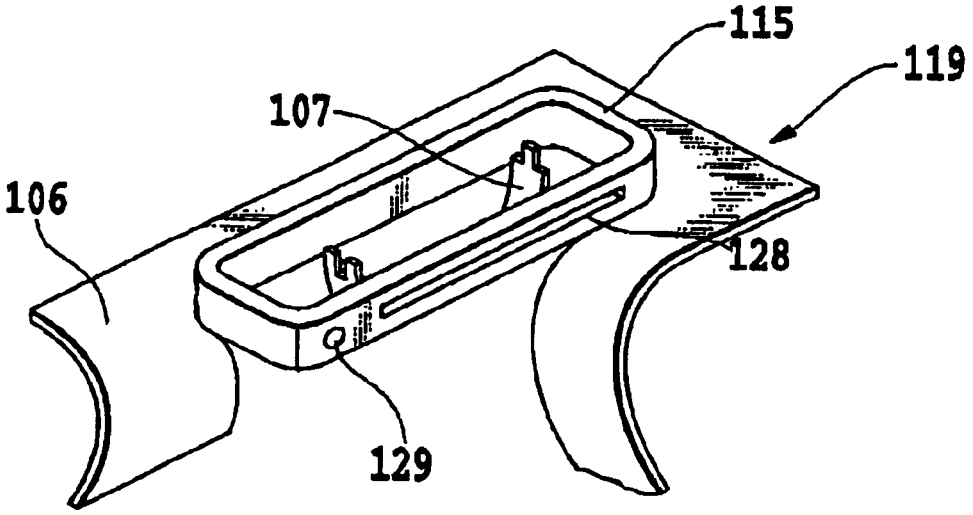
Figure 13:
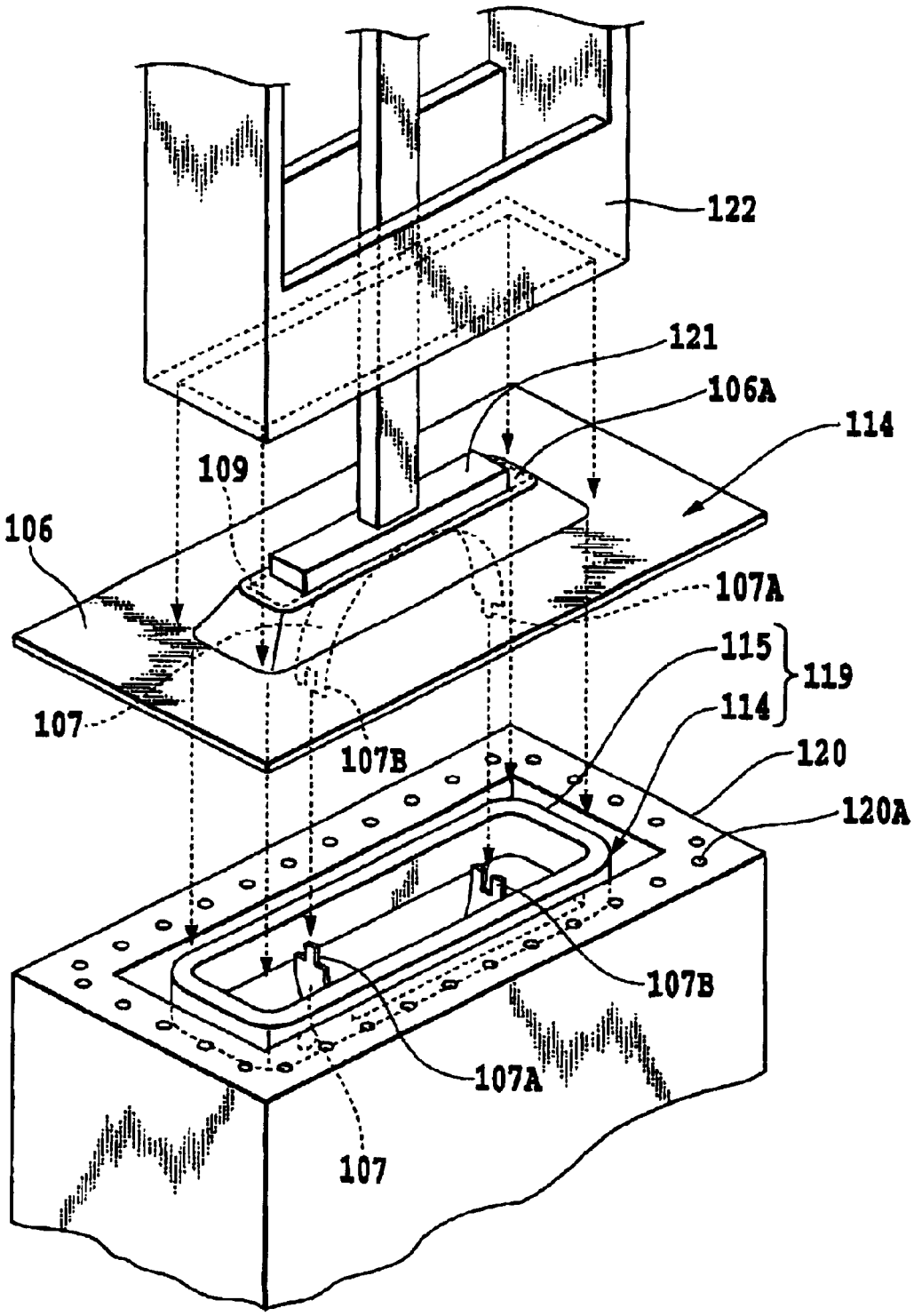
Figure 14A:
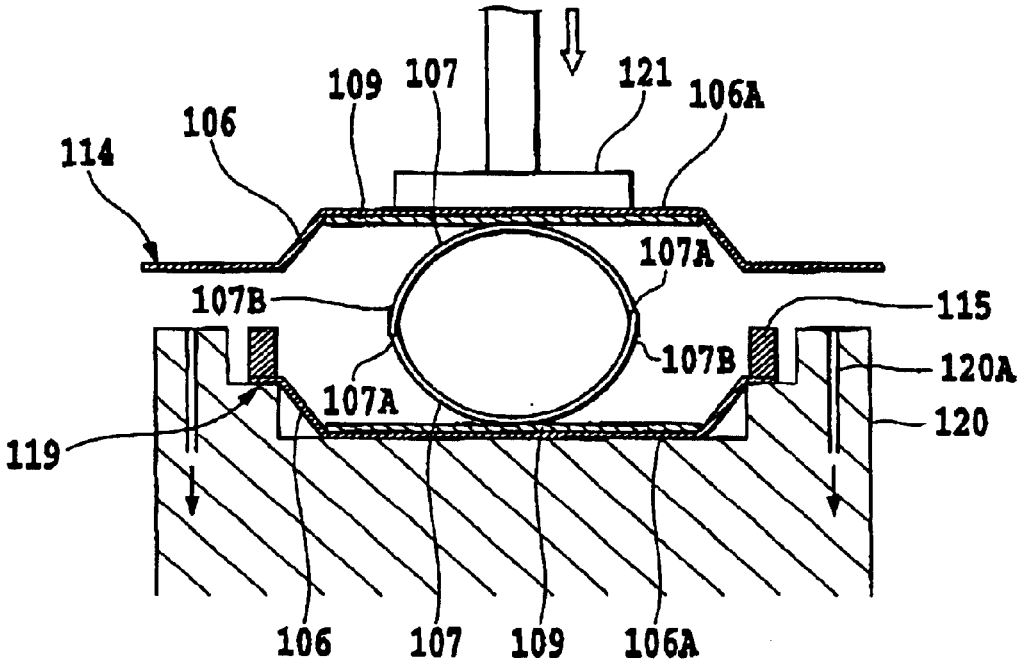
Figure 14B:
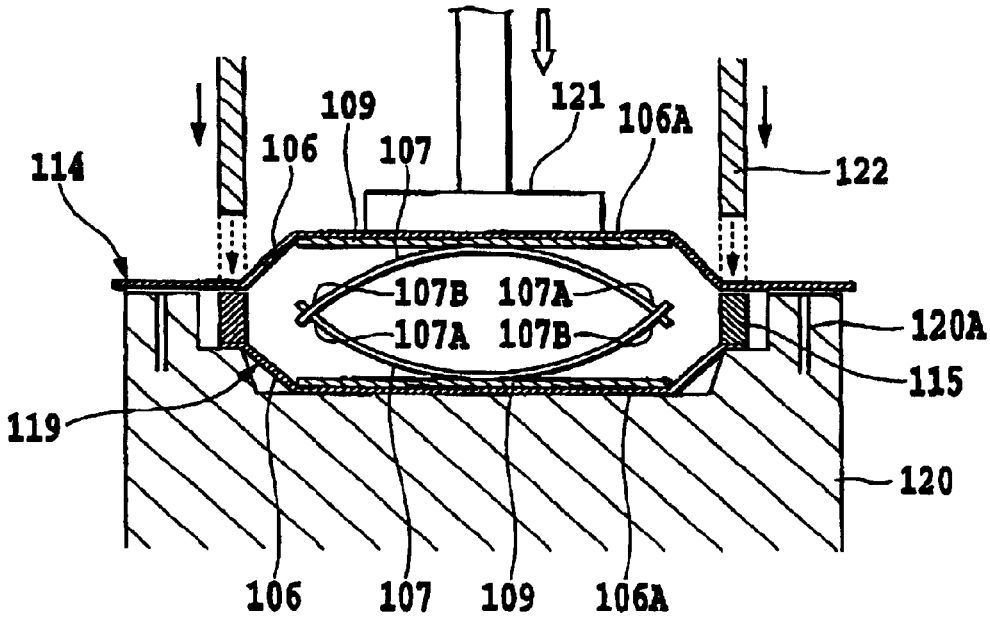
Figure 15:
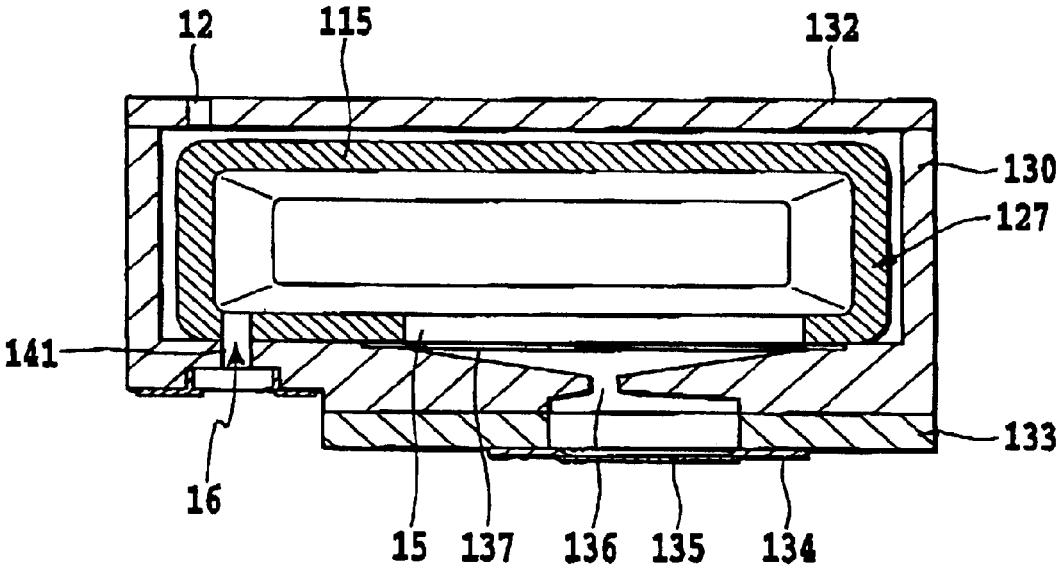
Figure 16:
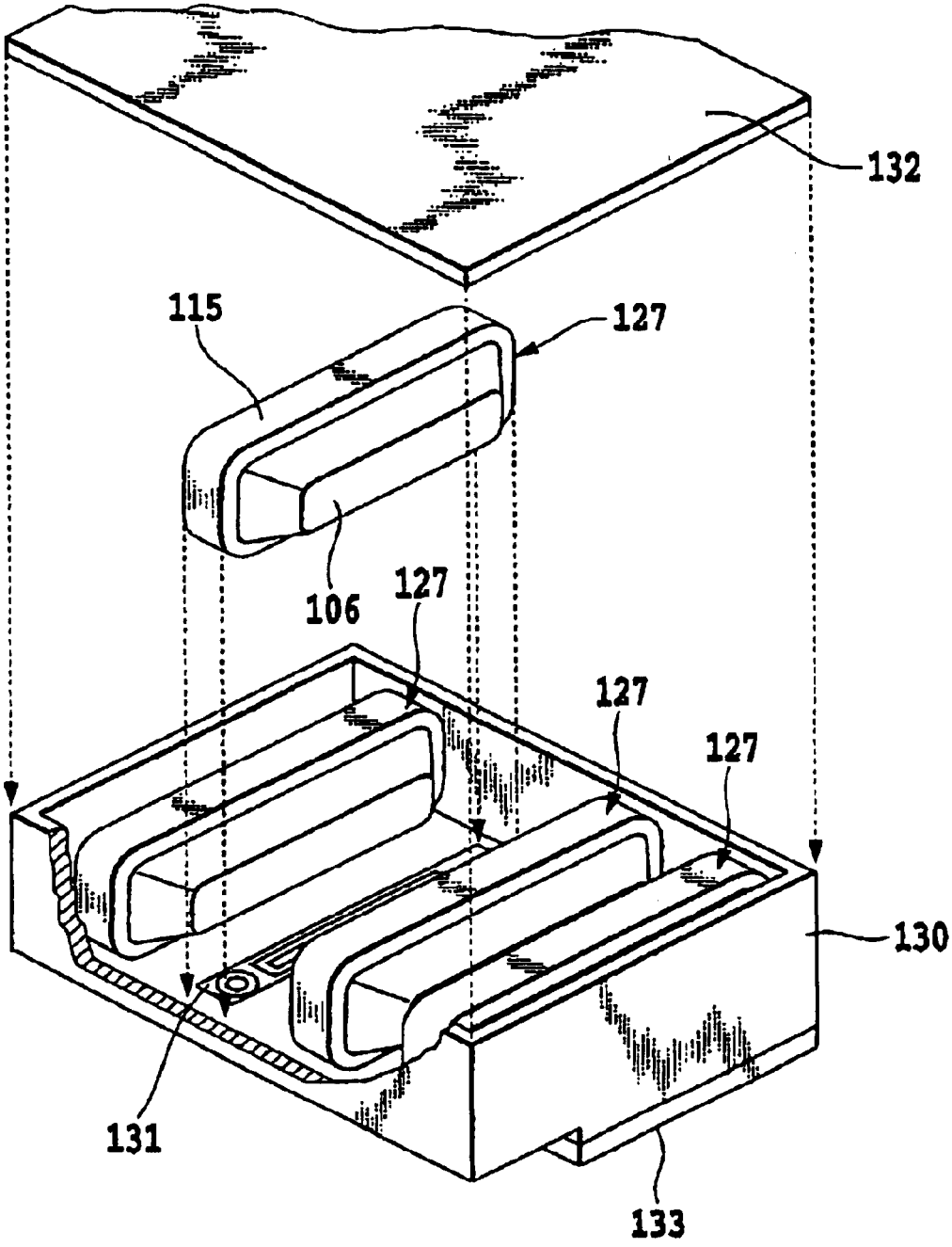
Figure 17:
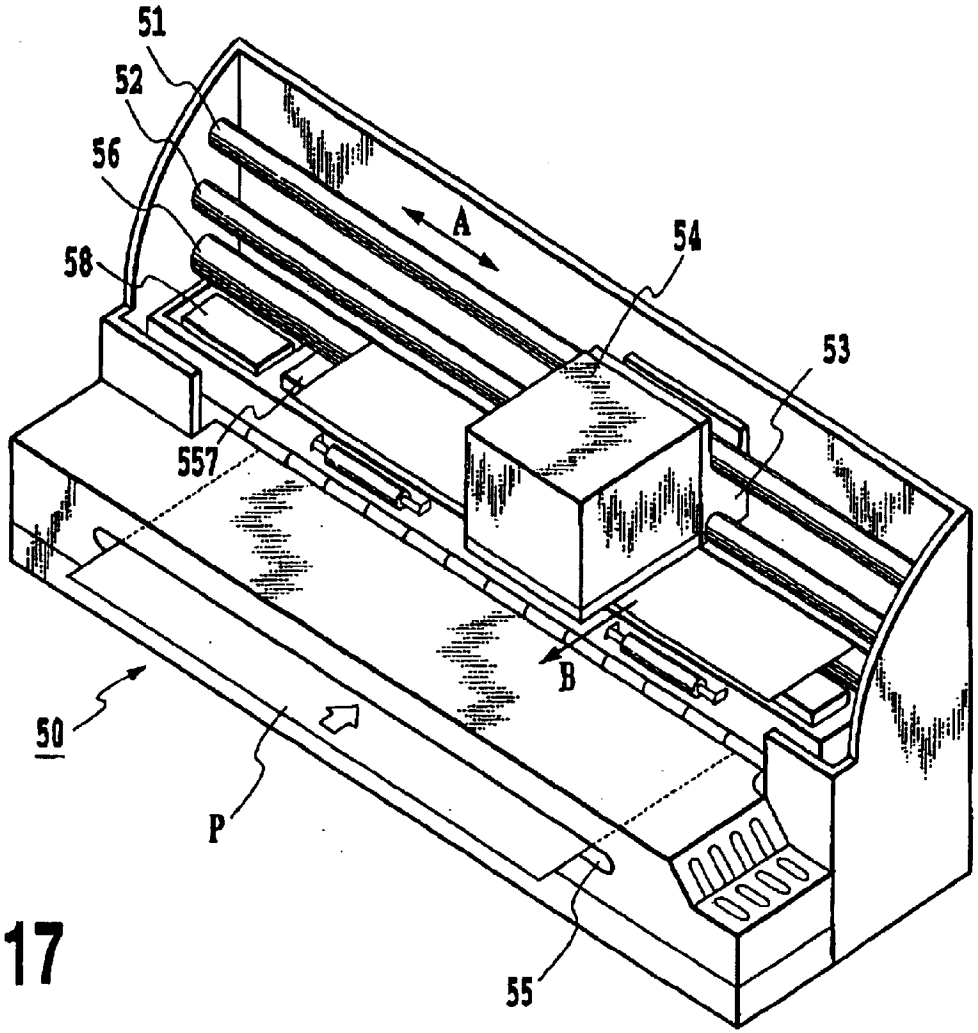
Figure 18:
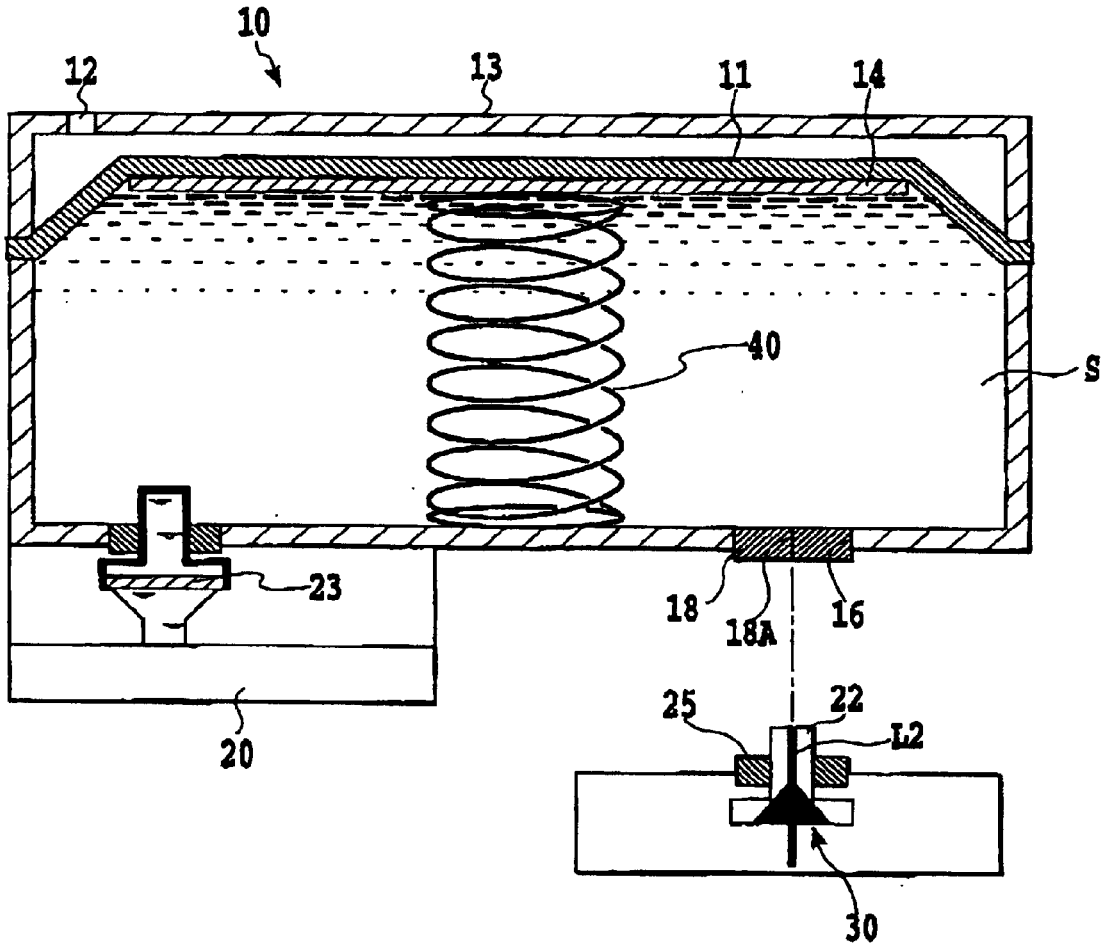
Figure 19:
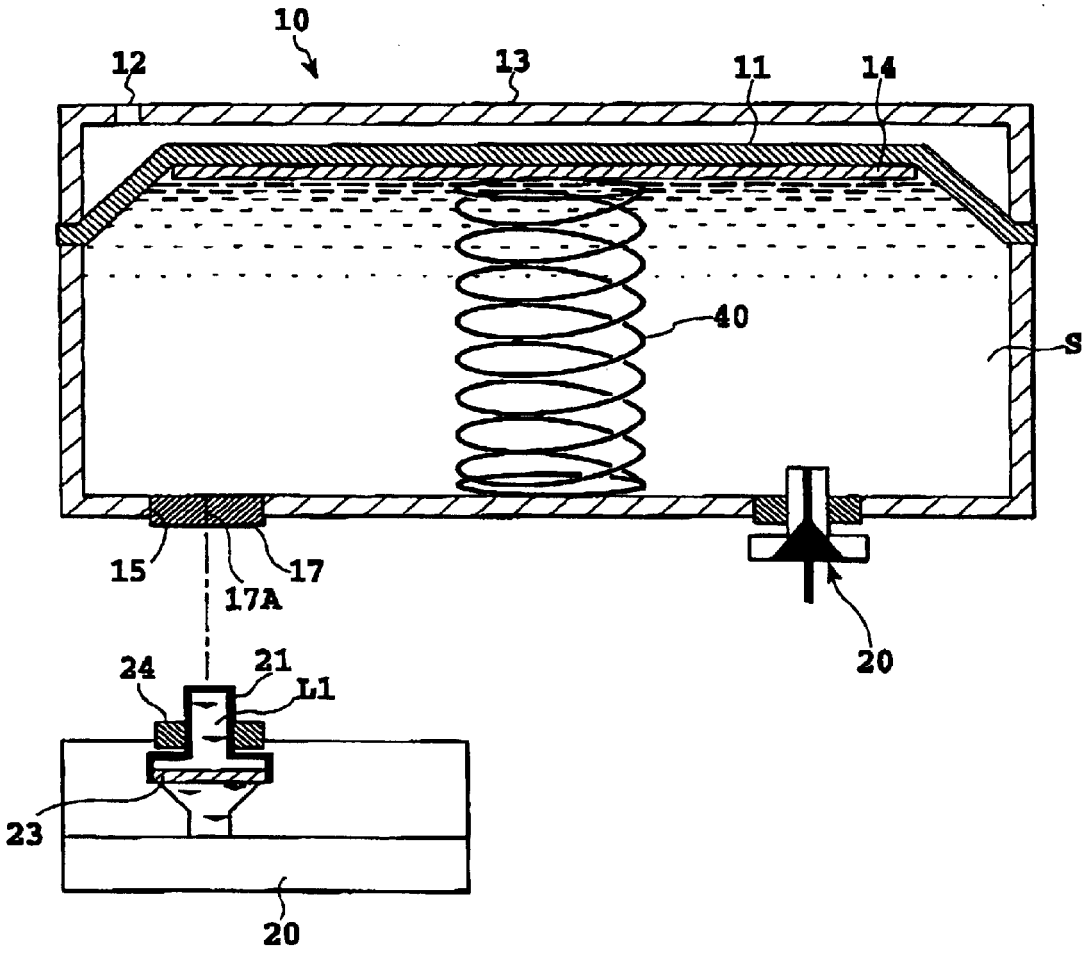
Figure 20:
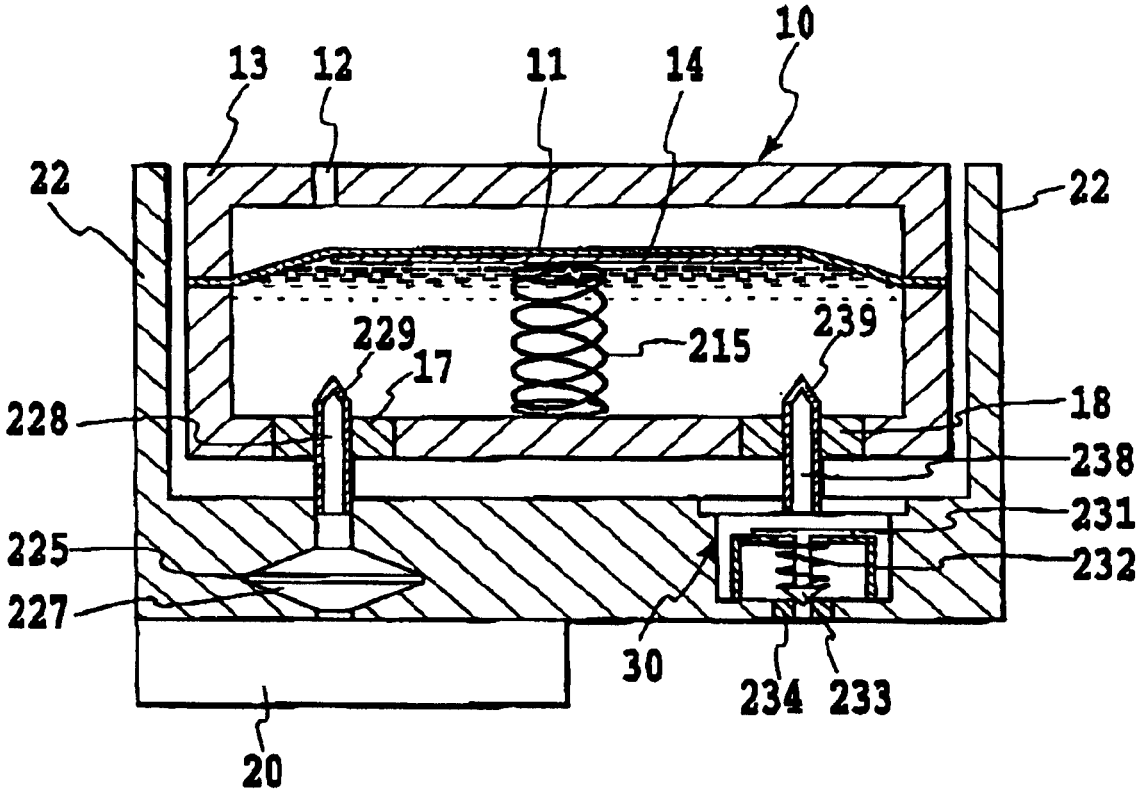
Figure 21A:
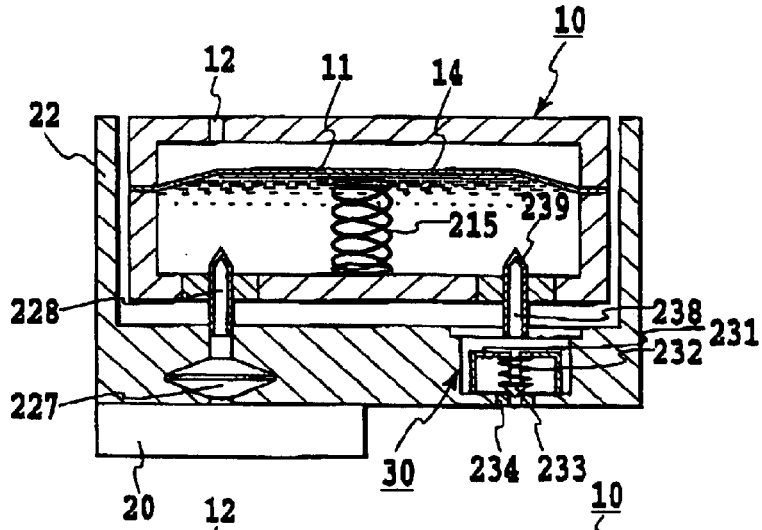
Figure 21B:
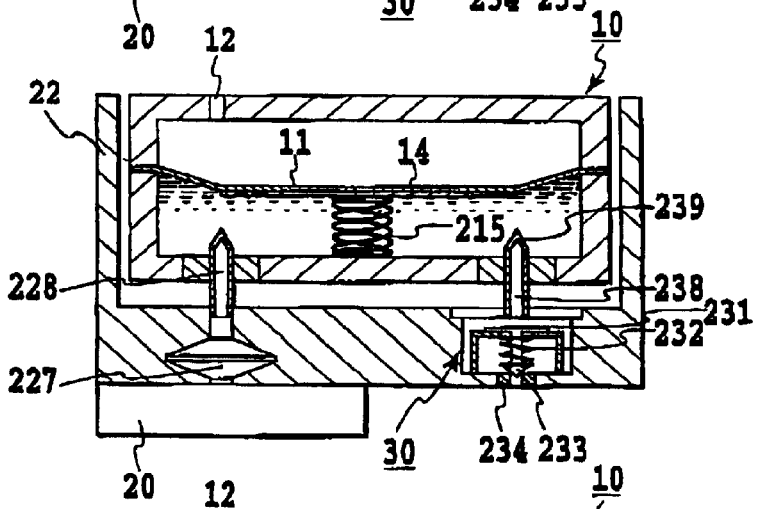
Figure 21C:
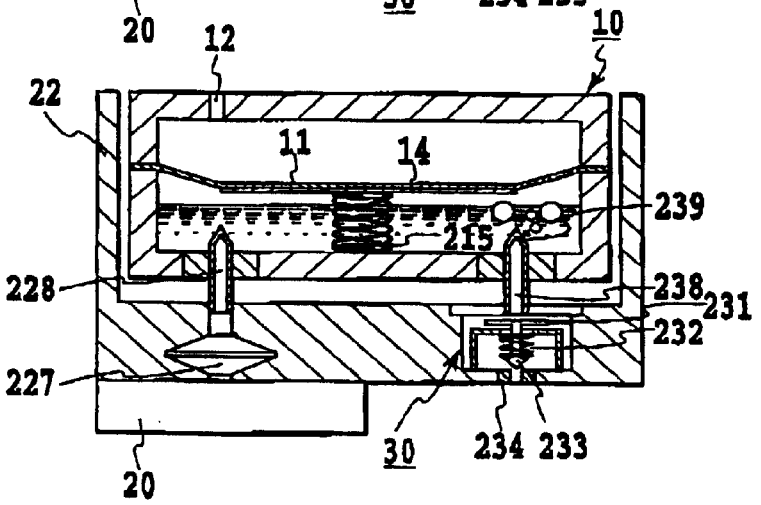
Figure 22:
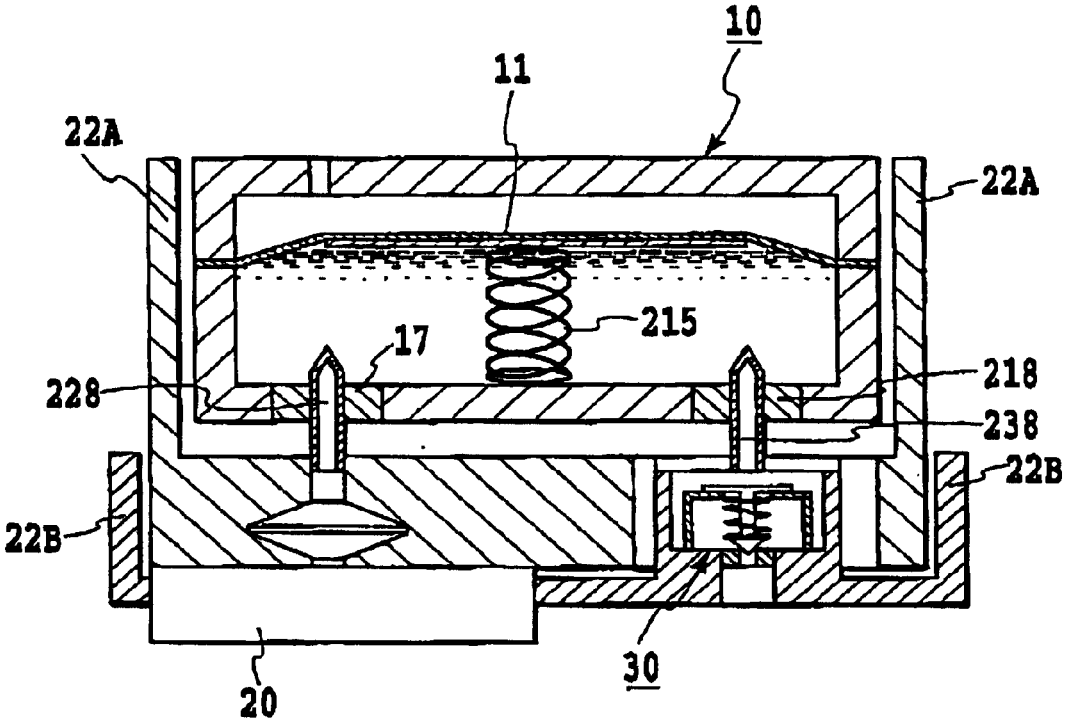
Figure 23:
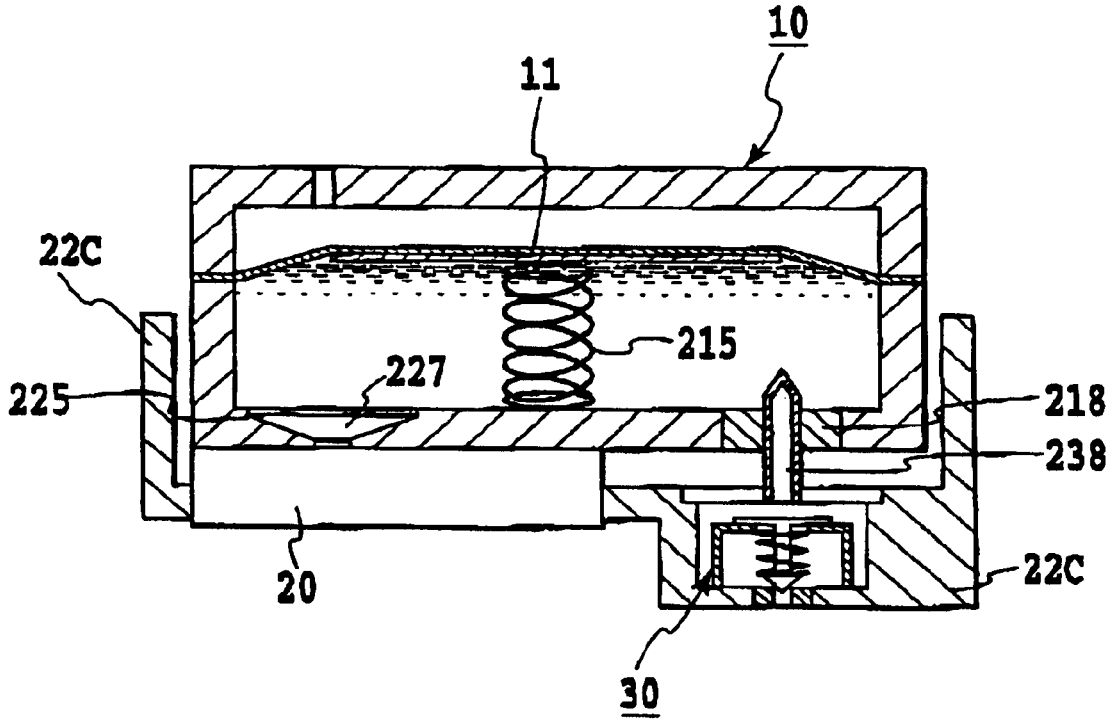
Figure 24:
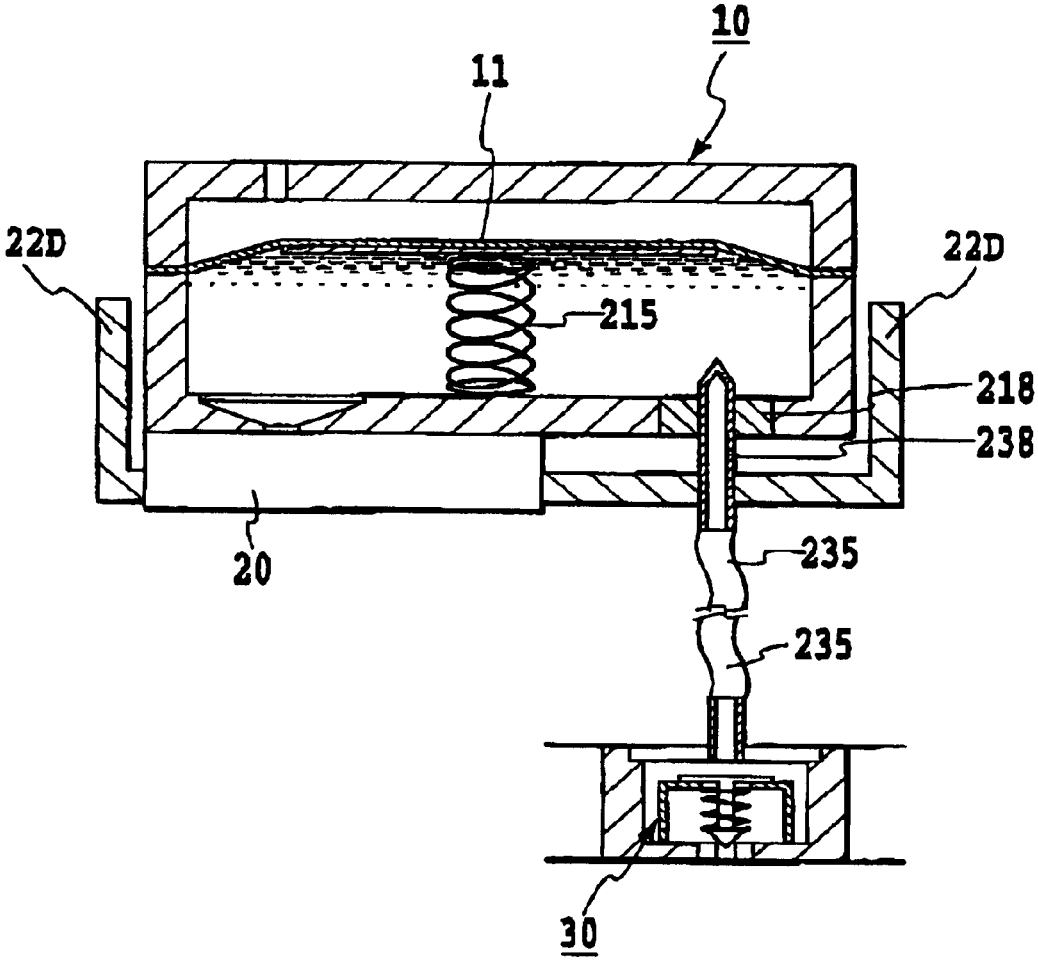
Figure 25:
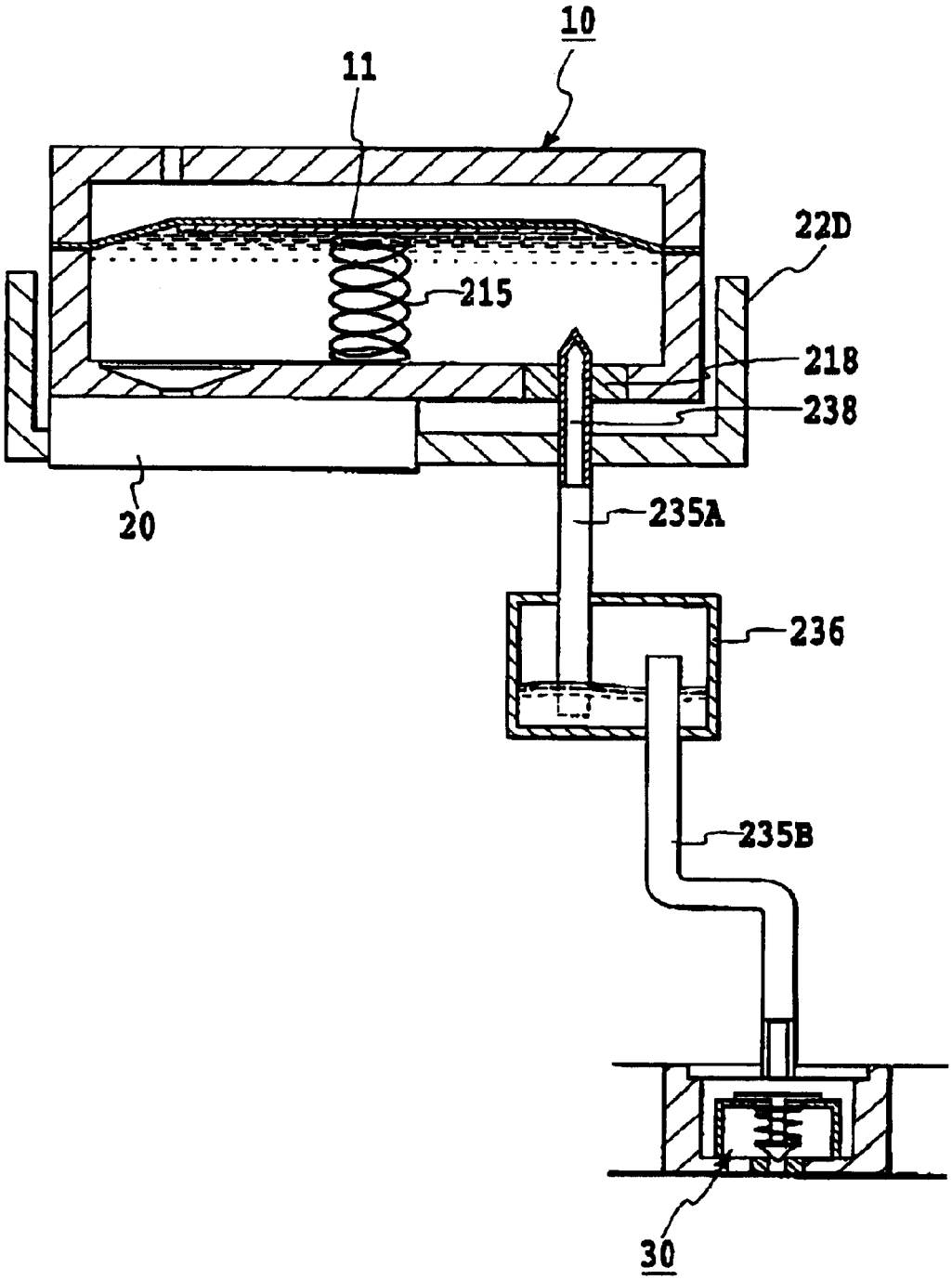
Figure 26A:
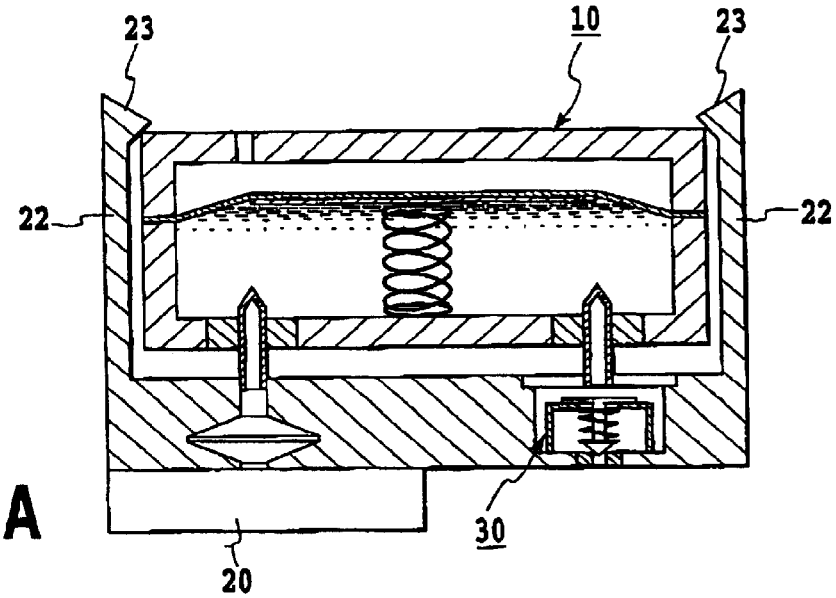
Figure 26B:
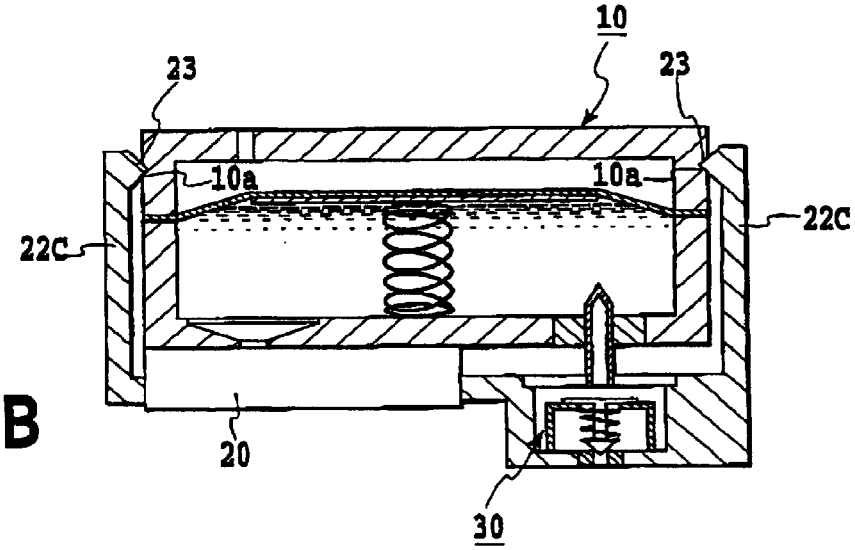
Figures 27A, 27B, 27C:
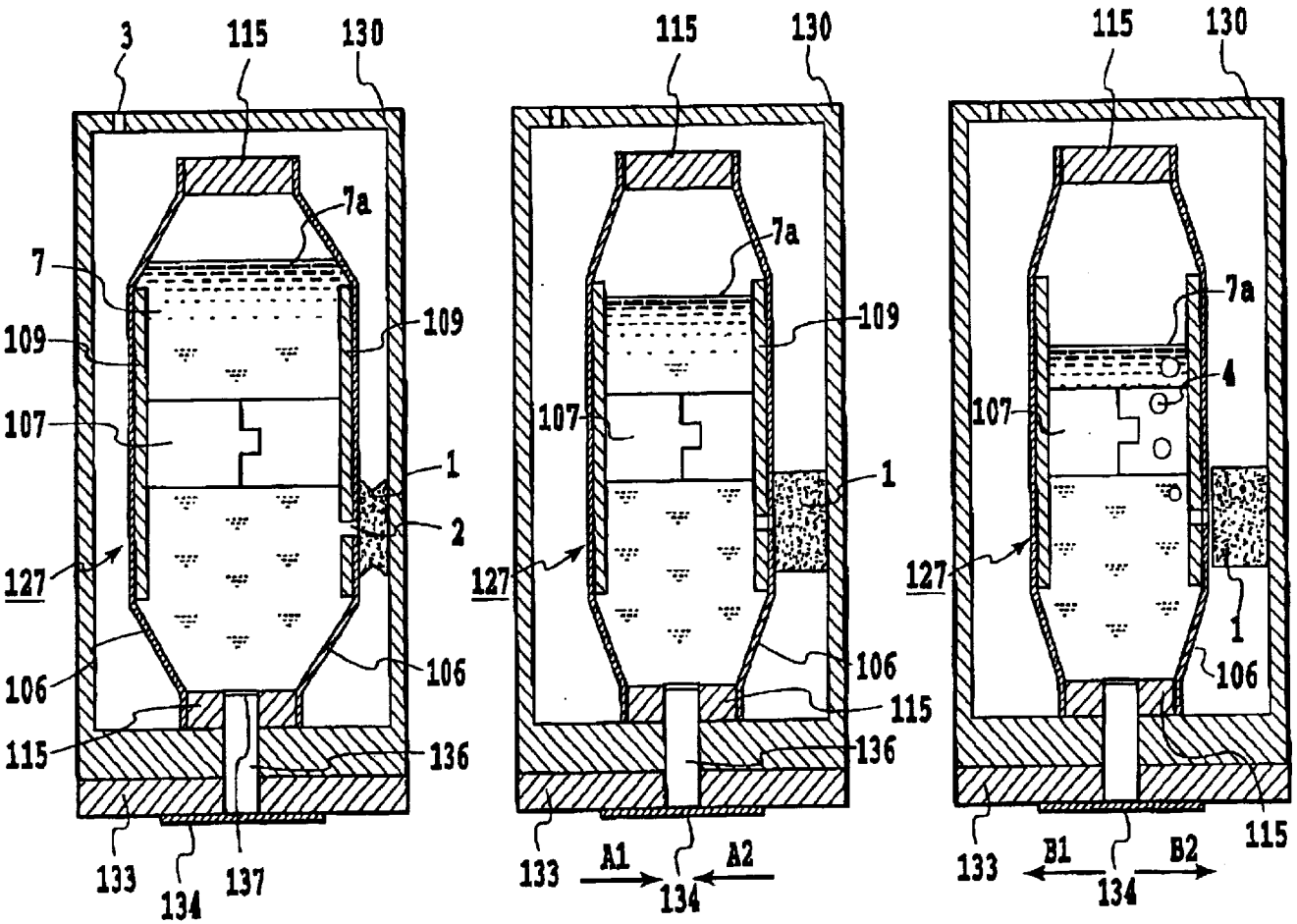
Figure 28C:
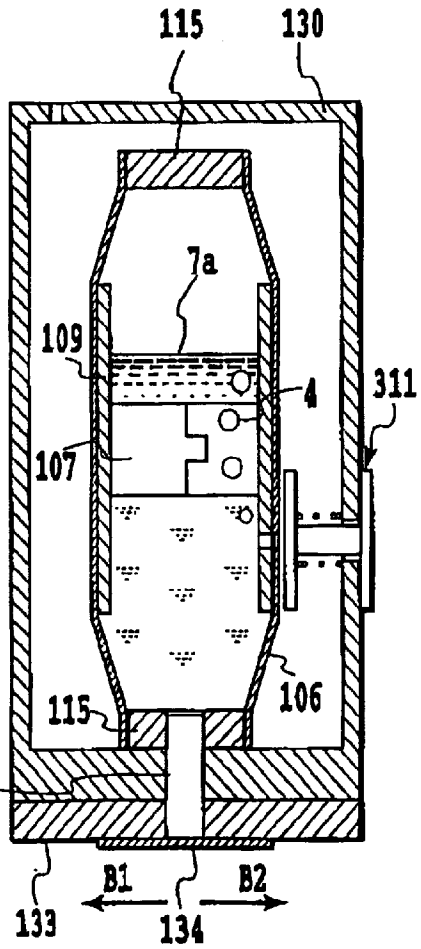
Figure 28B:
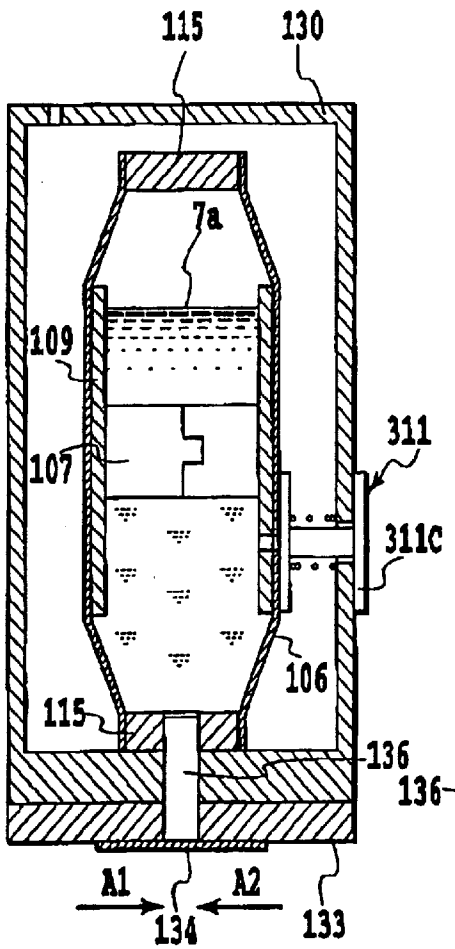
Figure 28A:
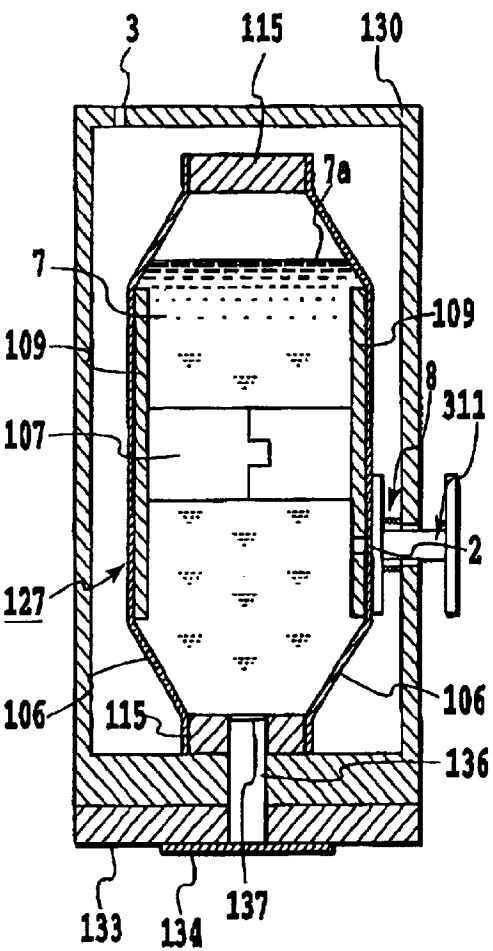
Figure 28D:
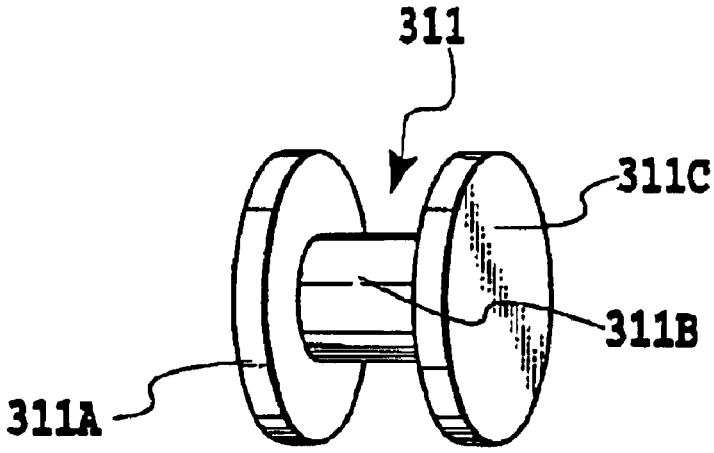
Figure 29:
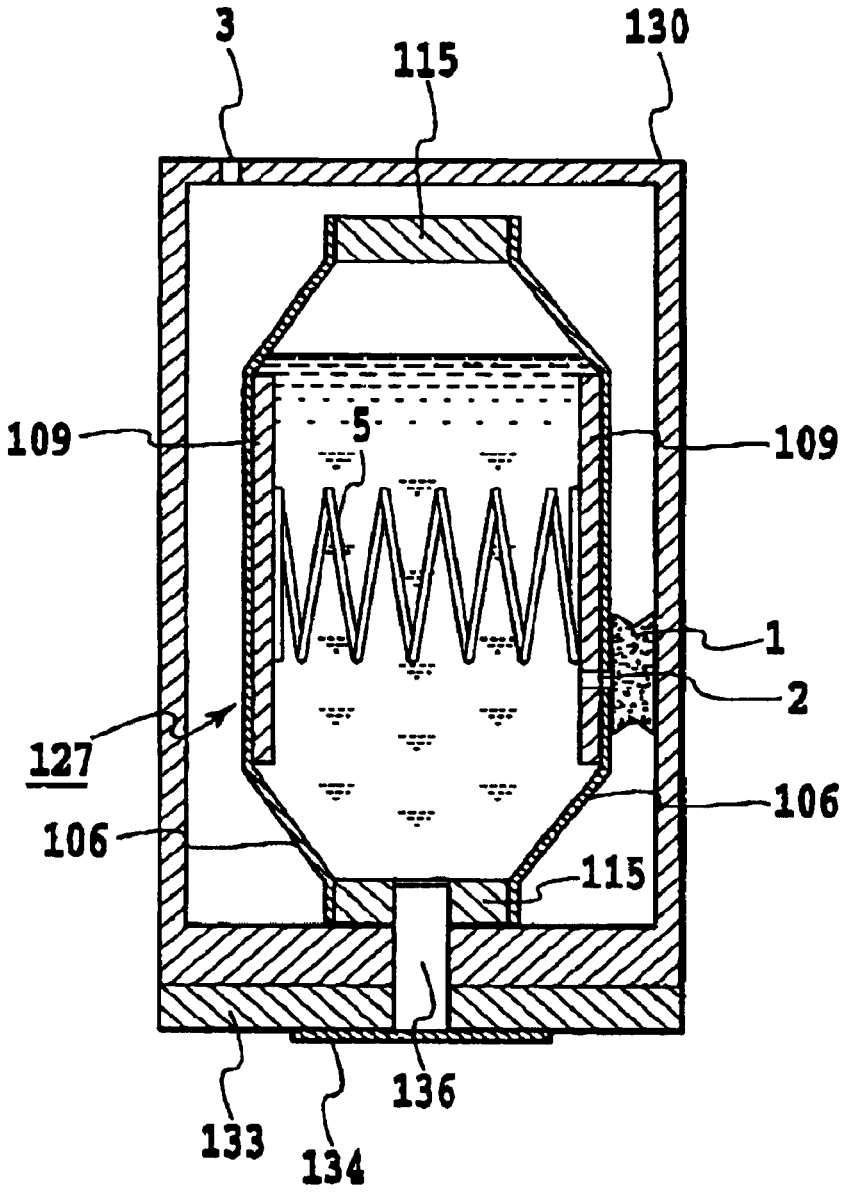
Figure 30:
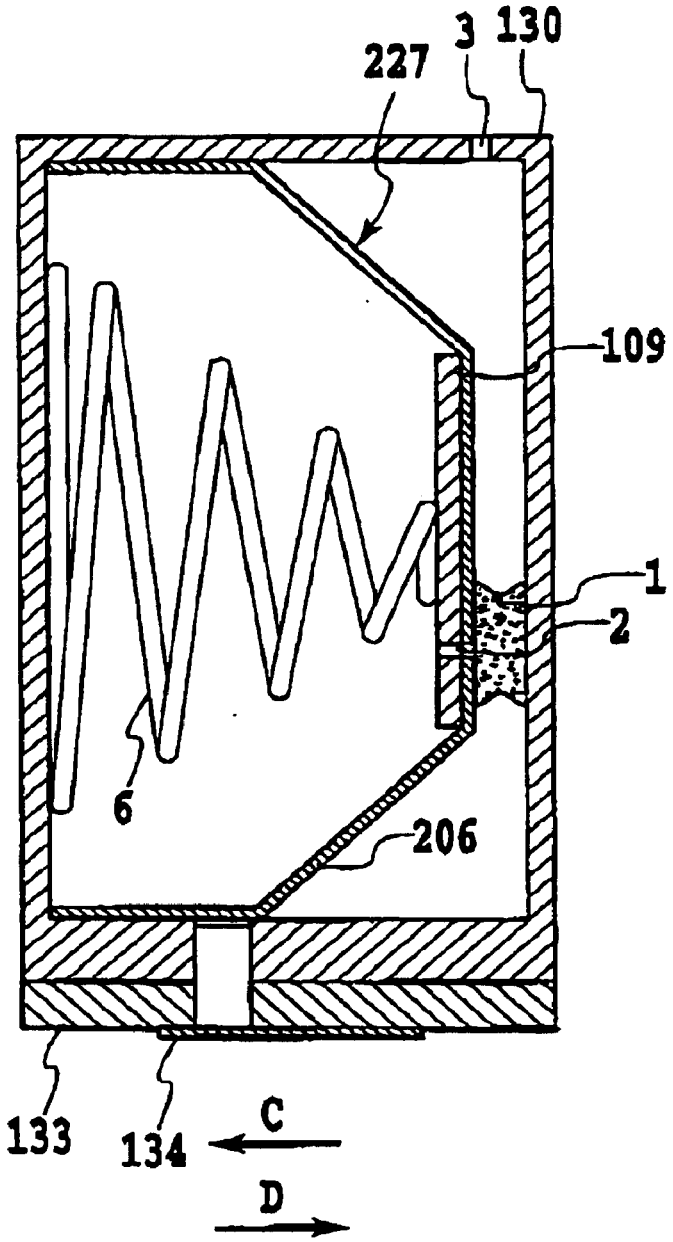
Figure 31:
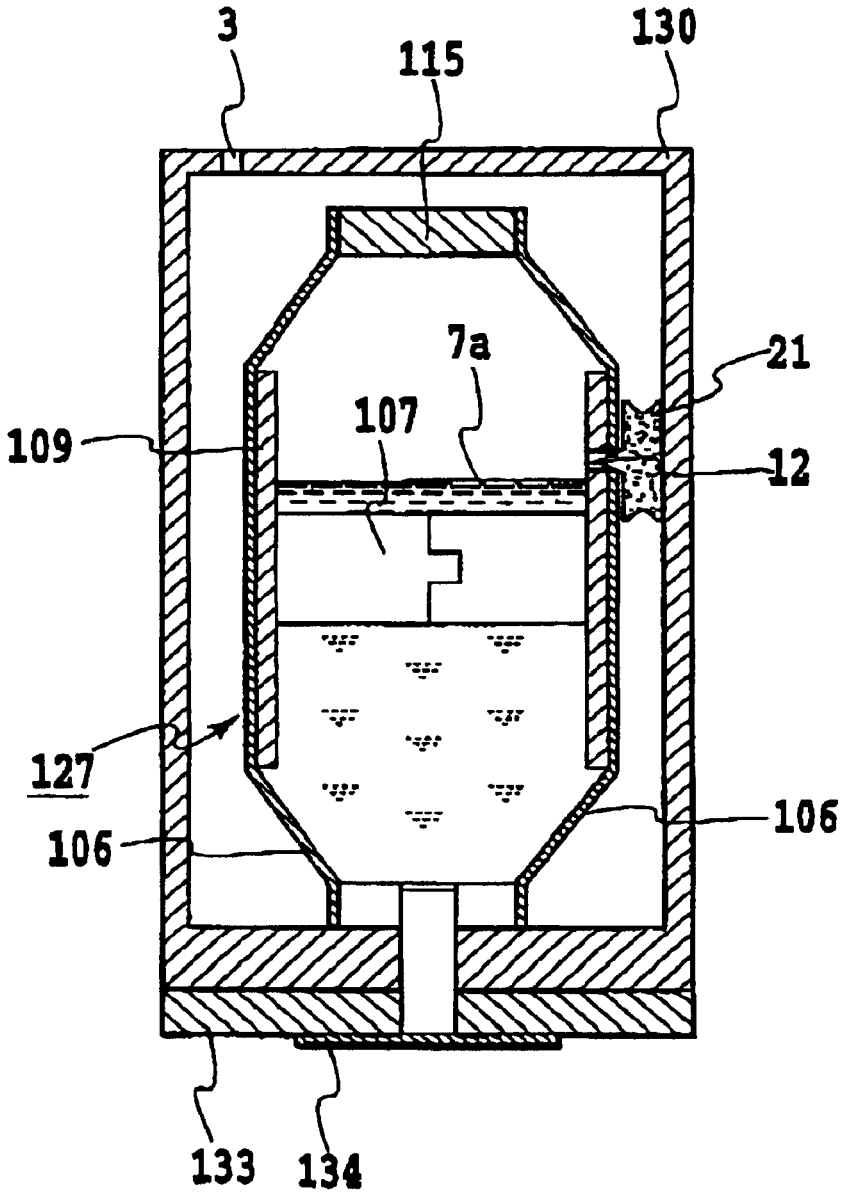
Figure 32:
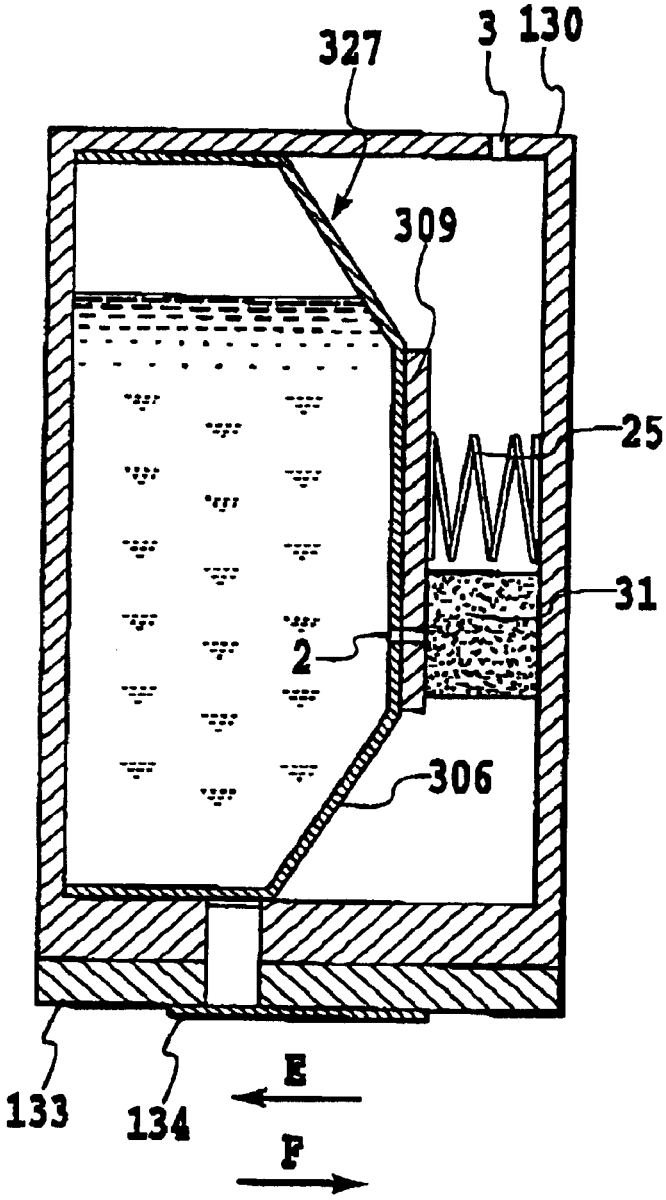
Figure 33:
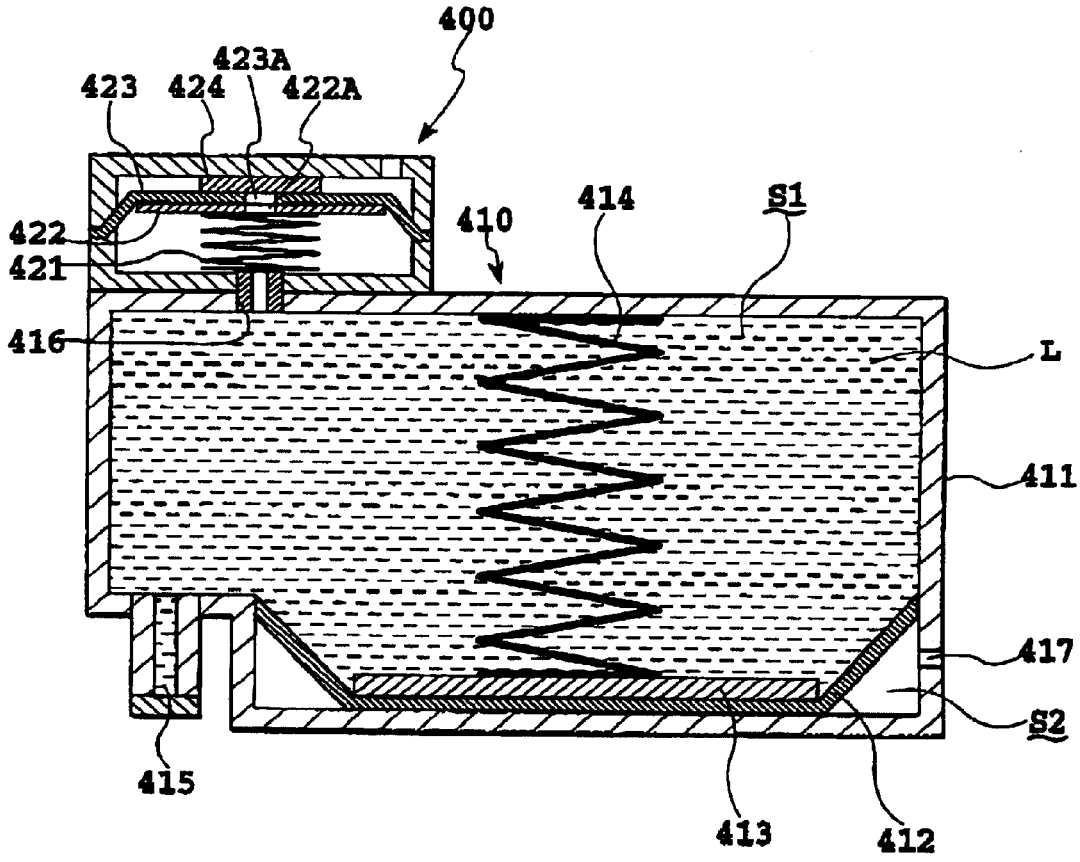

FIGS. 4A, 4B, and 4C are sectional views for explaining an operation of the ink tank in FIG. 2;

FIG. 5 is an illustration for explaining a relationship between the amount of supplying ink and changes in a pressure in a containing space S when the ink tank in FIG. 2 is used;

FIG. 6 is a sectional view for explaining an operation of the ink tank in FIG. 2;

FIG. 7 is a schematic sectional view of a configuration of an ink tank in a second embodiment of a basic configuration according to the present invention;

FIG. 8 is a schematic sectional view of a configuration of an ink tank in a third embodiment of a basic configuration according to the present invention;

FIG. 9 is a perspective view of a configuration of an ink tank in a fourth embodiment of a basic configuration according to the present invention;

FIGS. 10A, 10B, and 10C are illustrations of steps of forming a tank sheet of the ink tank shown in FIG. 9;

FIG. 11A is an illustration of a step of manufacturing a spring unit of the ink tank in FIG. 9, and FIG. 11B is an illustration of a step of manufacturing a spring/sheet unit of the ink tank in FIG. 9;

FIGS. 12A and 12B illustrate steps of manufacturing a spring/sheet/frame unit of the ink tank in FIG. 9;

FIG. 13 is an illustration of a step of combining the spring/sheet unit and the spring/sheet/frame unit of the ink tank in FIG. 9;

FIGS. 14A and 14B are sectional views of major parts at the combining step in FIG. 13;

FIG. 15 is a sectional view of an ink tank containing unit configured by using the ink tank in FIG. 9;

FIG. 16 is a sectional view of an ink tank containing unit configured by using a plurality of the ink tanks in FIG. 9;

FIG. 17 is a perspective view showing an example of an ink jet recording apparatus to which the present invention is applicable;

FIG. 18 is a schematic sectional view for explaining a first example for coupling of an ink tank, a one-way valve, and a recording head;

FIG. 19 is a schematic sectional view for explaining a second example for coupling of an ink tank, a one-way valve, and a recording head;

FIG. 20 is a schematic sectional view for explaining a third example for coupling of an ink tank, a one-way valve, and a recording head;

FIGS. 21A to 21C is illustrations for explaining a control of a negative pressure in the ink tank shown in FIG. 20 as a result of the supply of the ink, FIG. 22 is a schematic sectional view for explaining a fourth example for coupling of an ink tank, a one-way valve, and a recording head;

FIG. 23 is a schematic sectional view for explaining a fifth example for coupling of an ink tank, a one-way valve, and a recording head;

FIG. 24 is a schematic sectional view for explaining a sixth example for coupling of an ink tank, a one-way valve, and a recording head;

FIG. 25 is a schematic sectional view for explaining a seventh example for coupling of an ink tank, a one-way valve, and a recording head;

FIGS. 26A and 26B show two examples of mechanism for attaching an ink tank and recording head;

FIGS. 27A to 27C are schematic sectional views for explaining a configuration and an operation of a first embodiment of an ink supplying device having a one-way valve in another aspect of the present invention; FIG. 27A showing a state of the same in which an opening section for introducing atmosphere is sealed; FIG. 27B showing a state of the same immediately before separation of the atmosphere introducing opening section as a result of contraction of an ink tank; FIG. 27C showing a state of the same in which the atmosphere introducing opening section is opened to introduce air;

FIGS. 28A to 28D are schematic sectional views for explaining a configuration and an operation of a second example of an ink supplying device having a one-way valve in the other aspect of the present invention; FIG. 28A showing a state of the same in which an opening section for introducing atmosphere is sealed; FIG. 28B showing a state of the same immediately before separation of the atmosphere introducing opening section as a result of contraction of an ink tank; FIG. 28C showing a state of the same in which the atmosphere introducing opening section is opened to introduce air; FIG. 28D showing a configuration of a sealing member;

FIG. 29 is a schematic sectional view for explaining a configuration of a third embodiment of an ink supplying device having a one-way valve in the other aspect of the invention;

FIG. 30 is a schematic sectional view for explaining a configuration of a fourth embodiment of an ink supplying device having a one-way valve in the other aspect of the invention;

FIG. 31 is a schematic sectional view for explaining a configuration of a fifth embodiment of an ink supplying device having a one-way valve in the other aspect of the invention;

FIG. 32 is a schematic sectional view for explaining a configuration of a sixth embodiment of an ink supplying device having a one-way valve in the other aspect of the invention;

FIG. 33 is a schematic sectional view for explaining an example of a configuration of the ink tank focusing on a gas permeation.

Figure 34A:
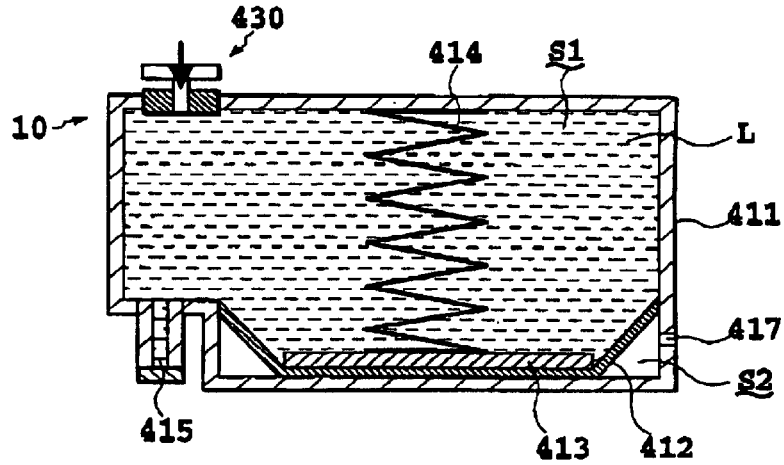
Figure 34B:
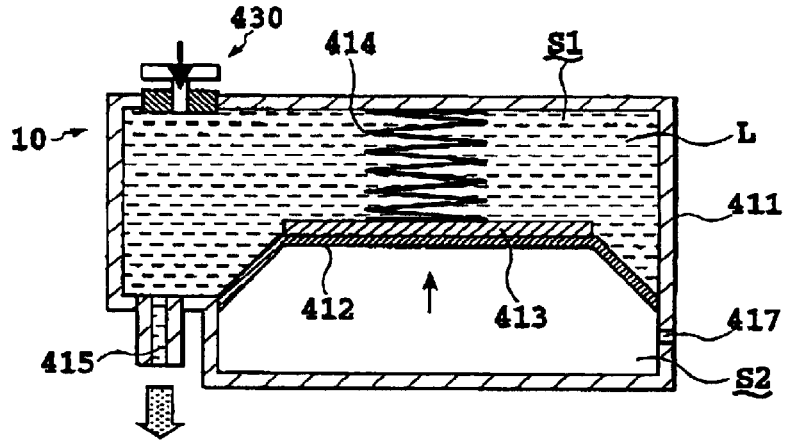
Figure 34C:
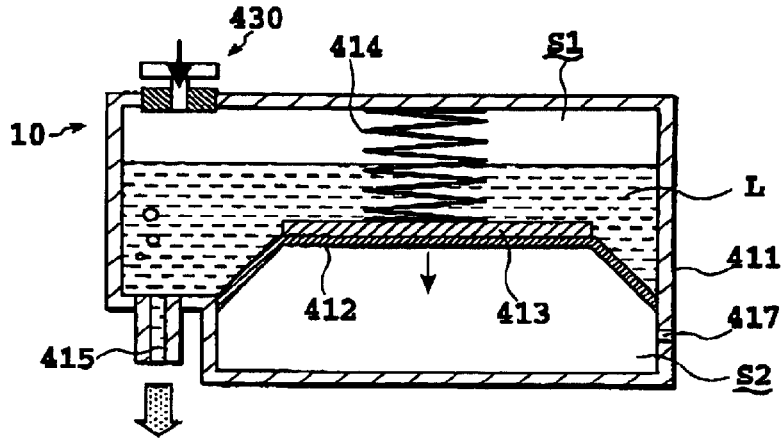
Figure 35:
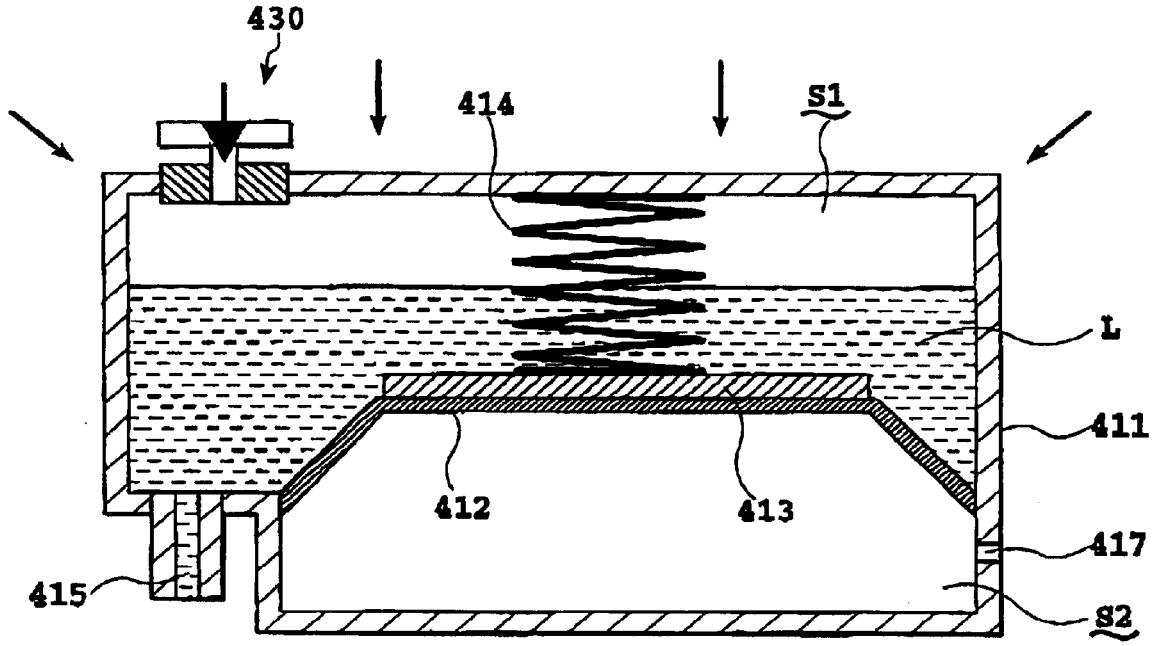
Figure 36:
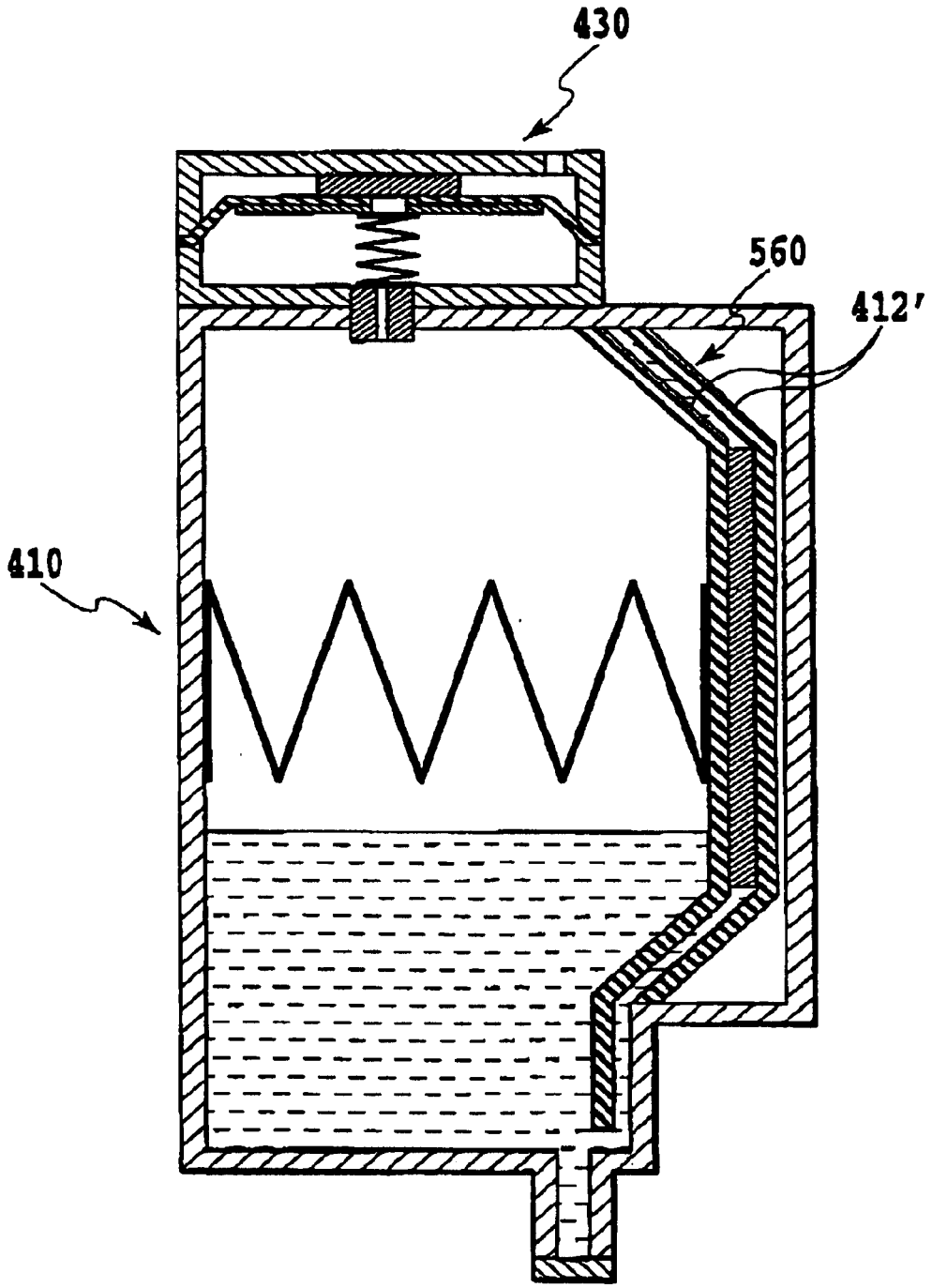

FIGS. 34A, 34B, and 34C illustrate states of use of the ink tank in FIG. 33;

FIG. 35 illustrates an osmotic pressure of a gas in the ink tank in FIG. 33;

FIG. 36 is a schematic sectional view for explaining an example of another configuration of the ink tank focusing on a gas transmission.

Figure 37:
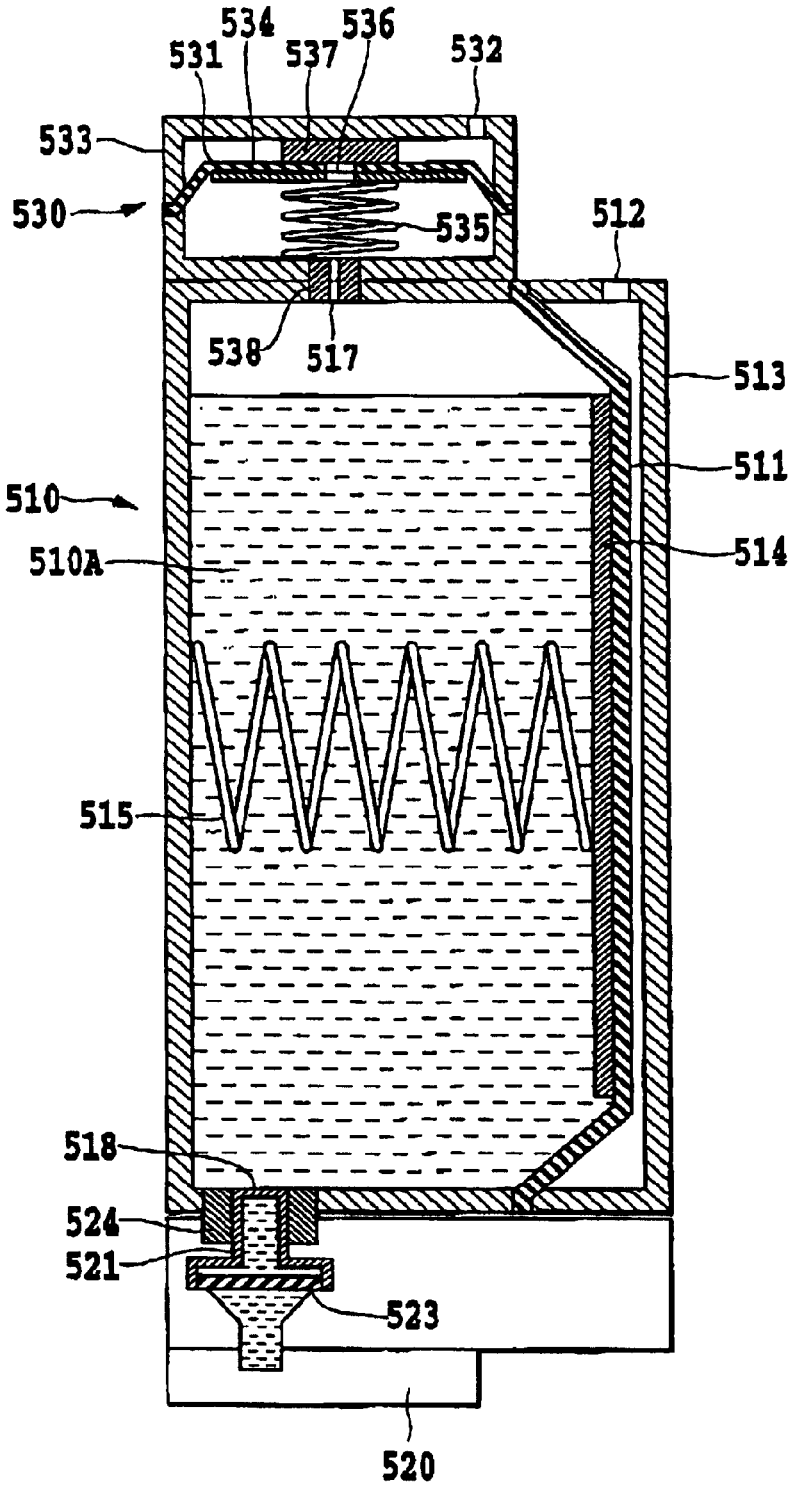
Figure 39:
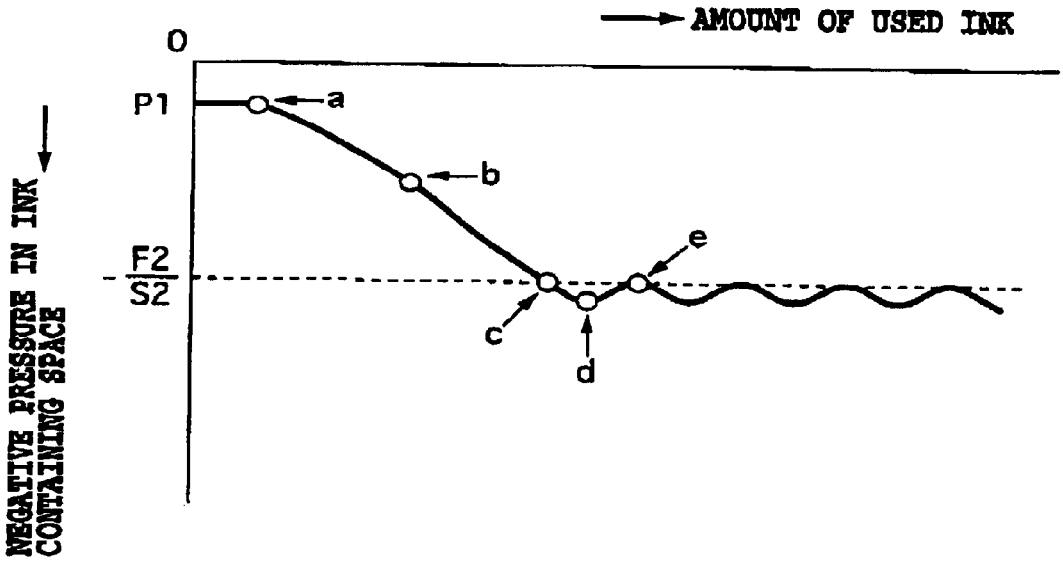
Figure 40:
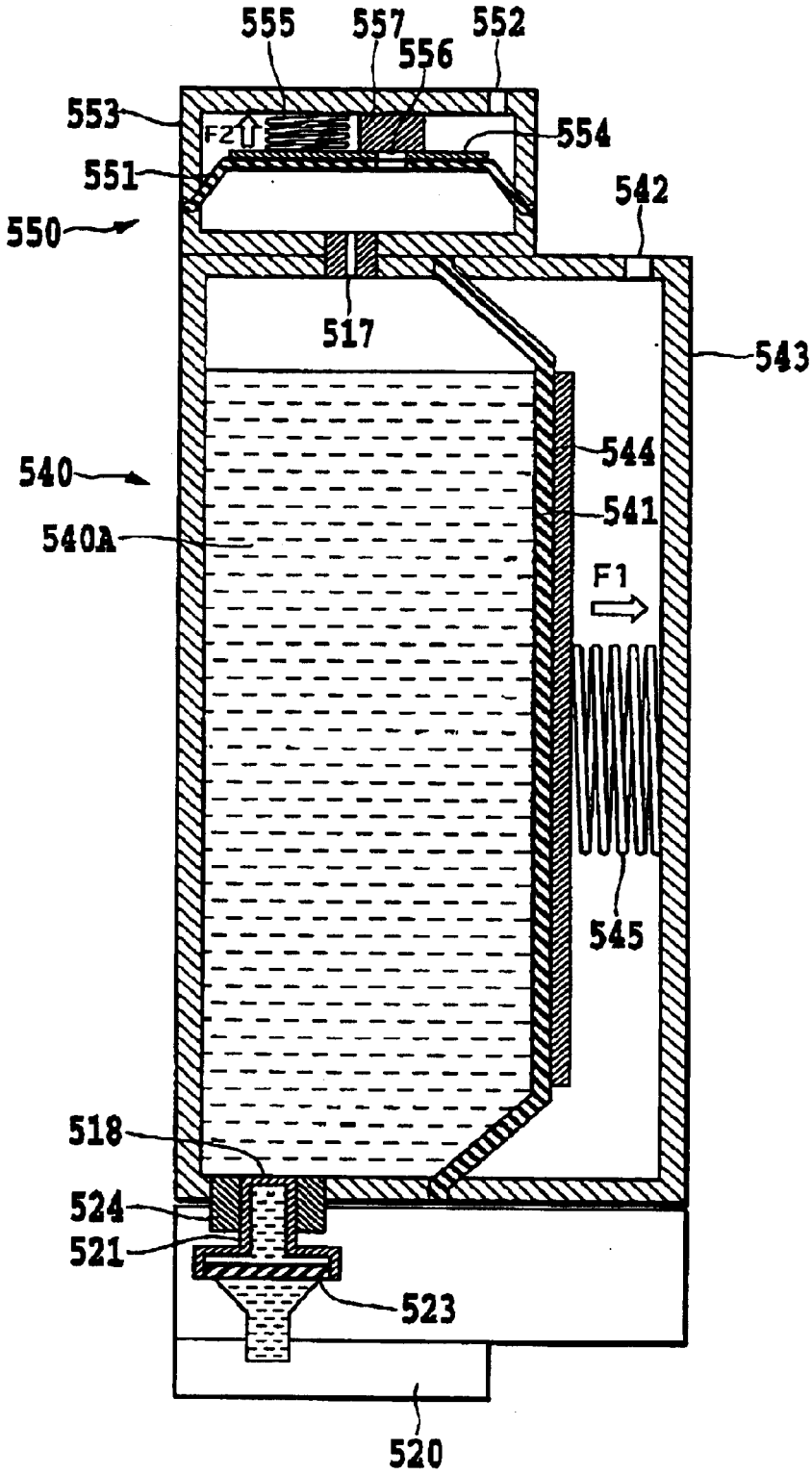
Figure 41:
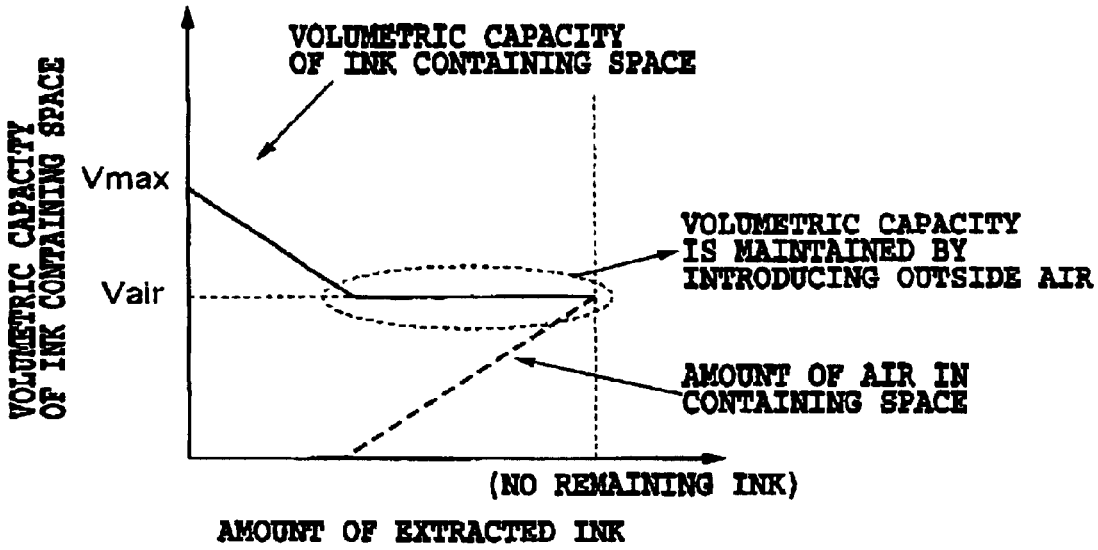
Figure 42A:
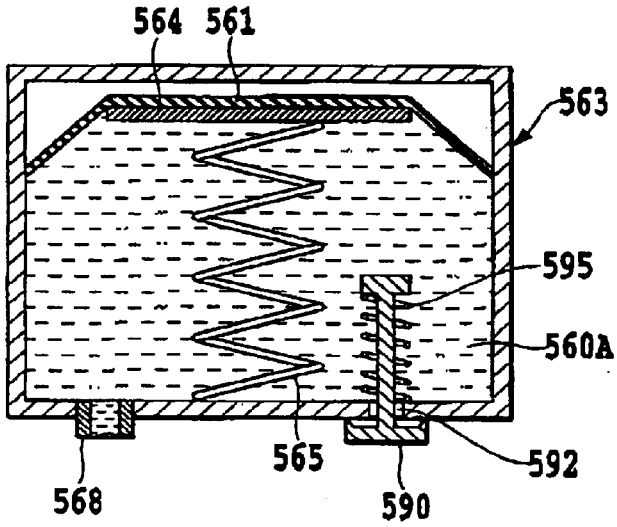
Figure 42B:
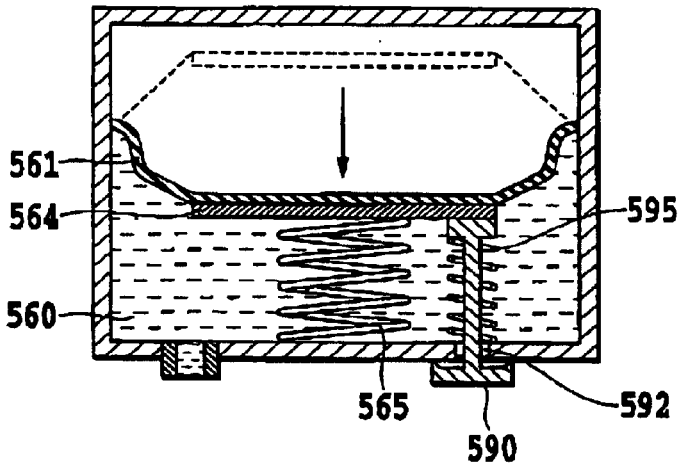
Figure 43A:
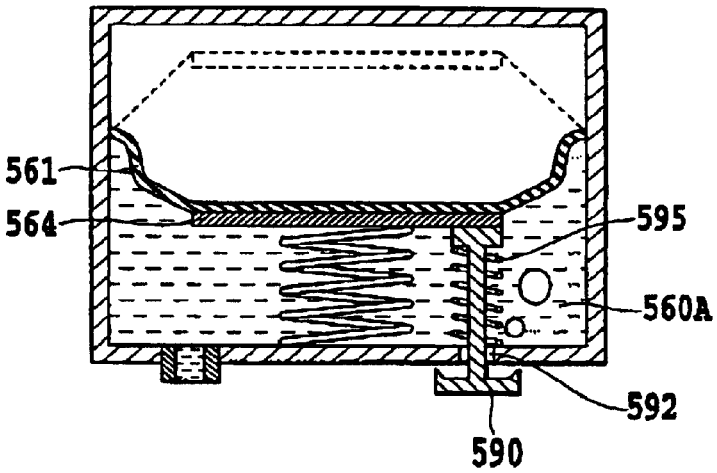
Figure 43B:
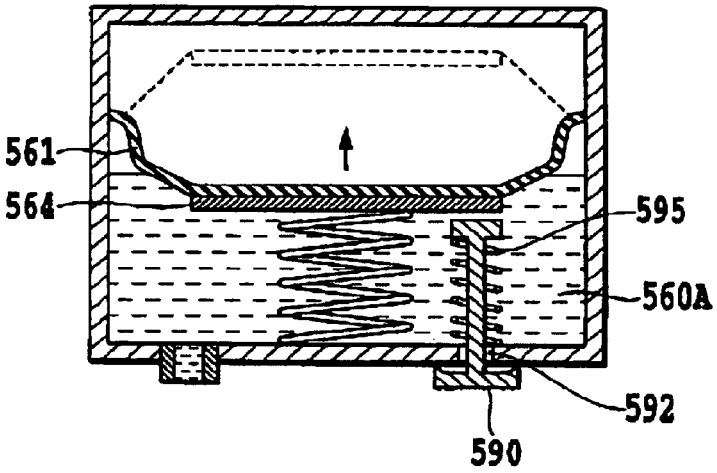
Figure 44:
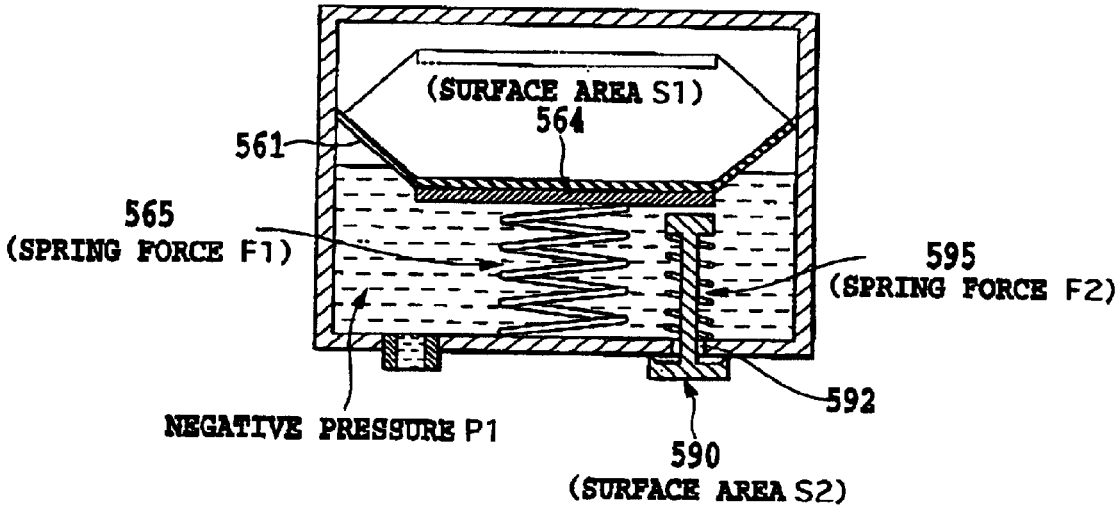
Figure 45:
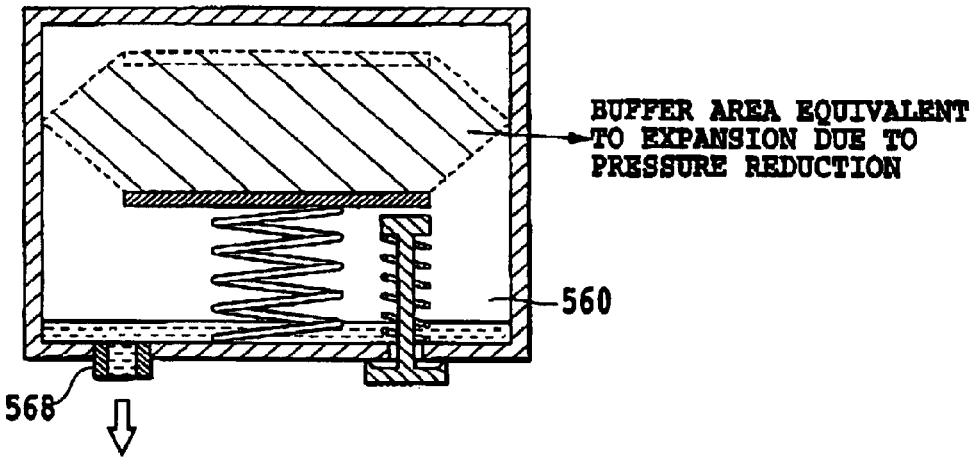

FIG. 37 is a schematic sectional view showing an example of an ink container which is a liquid container used in still another embodiment of the invention and onto which an ink jet recording head is integrally mounted;

FIGS. 38A to 38E are illustrations for explaining operations of the ink container shown in FIG. 37;

FIG. 39 is an illustration showing a relationship between a negative pressure in an ink containing space of the ink container shown in FIG. 37 and the amount of remaining ink;

FIG. 40 is a schematic sectional view showing another example of an ink container which is a liquid container used in still another embodiment of the invention and onto which an ink jet recording head is integrally mounted;

FIG. 41 is an illustration showing how a volumetric capacity of an ink containing space changes in accordance with the amount of extracted liquid (ink) in order to explain a function of a buffer area for preventing pressure fluctuations formed by the ink container shown in FIG. 37;

FIGS. 42A and 42B are schematic sectional views for explaining an example of a configuration and an operation of another embodiment of an ink container in which a preferable buffer area is formed;

FIGS. 43A and 43B are schematic sectional views for explaining an example of a configuration and an operation of still another embodiment of an ink container in which a preferable buffer area is formed;

FIG. 44 is an illustration for explaining design parameters for the configuration in FIG. 42A; and FIG. 45 is a schematic sectional view showing a state of the configuration in FIG. 42A in which ink has been extracted from a supply port to nearly use up the same.

FIGS. 46A to 46F are schematic sectional views for explaining an example of a configuration and an operation of an ink tank to be considered in order to have a design condition thereof generalize.

Figure 46A:
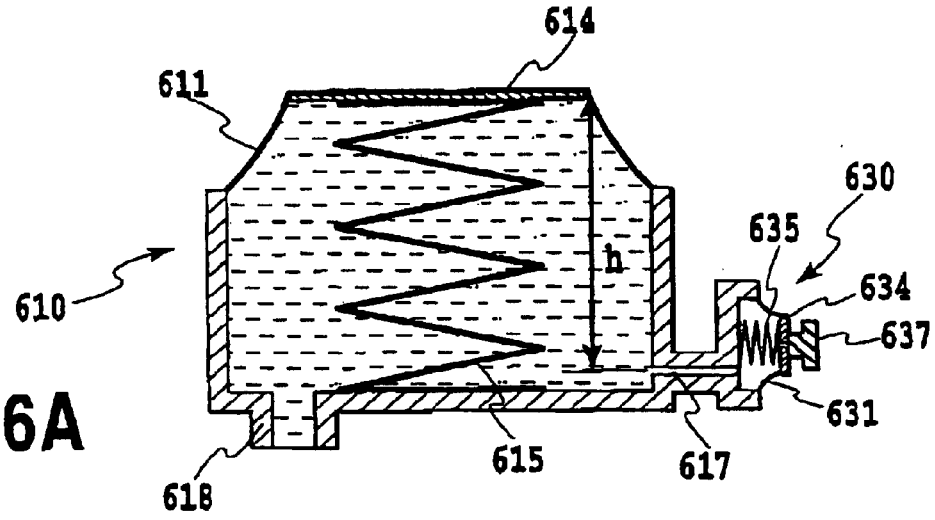
Figure 47:
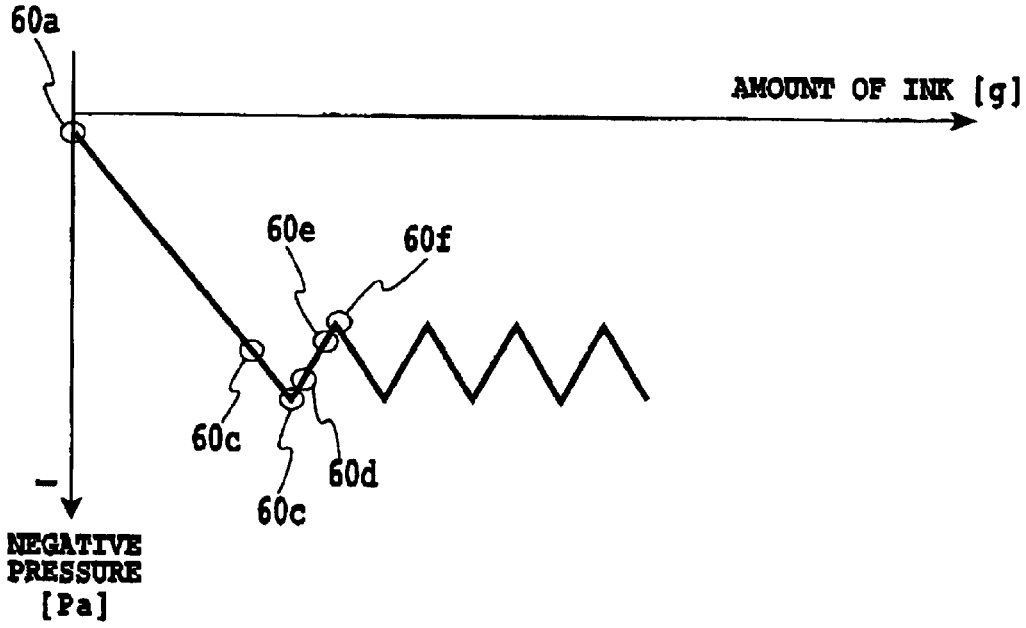
Figure 48:
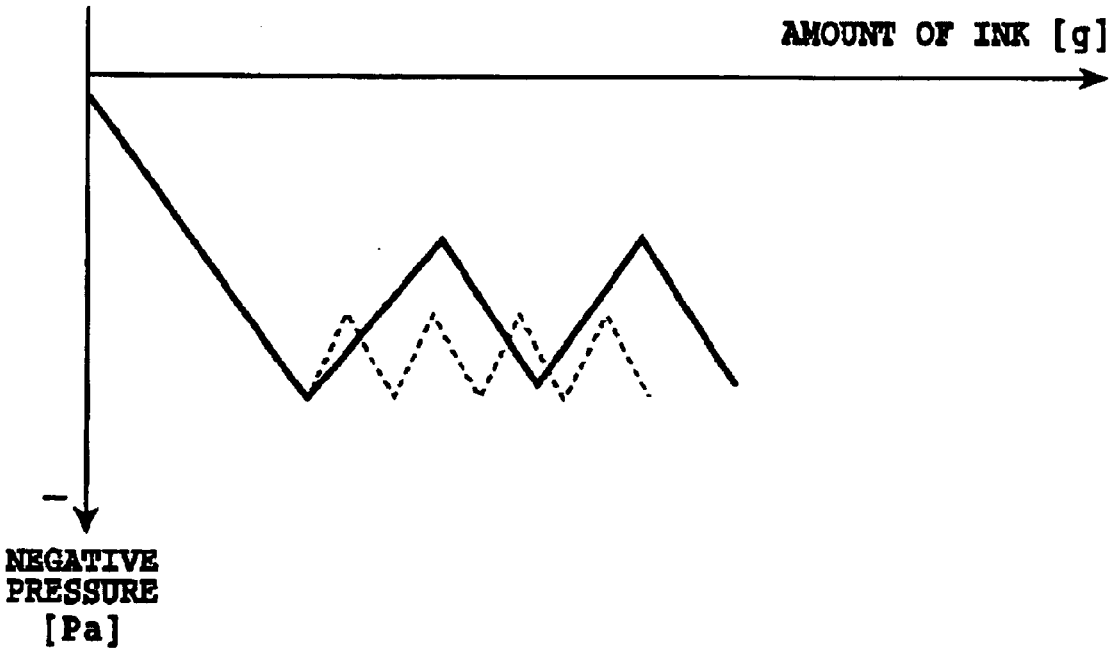
Figure 49A:
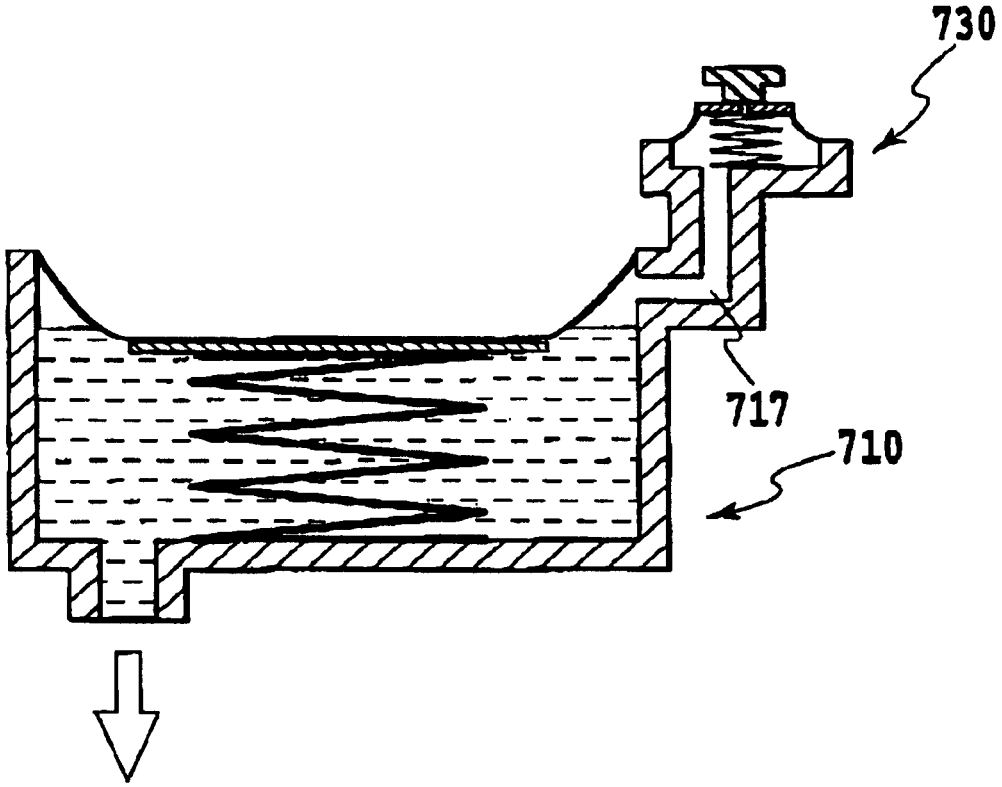
Figure 49B:
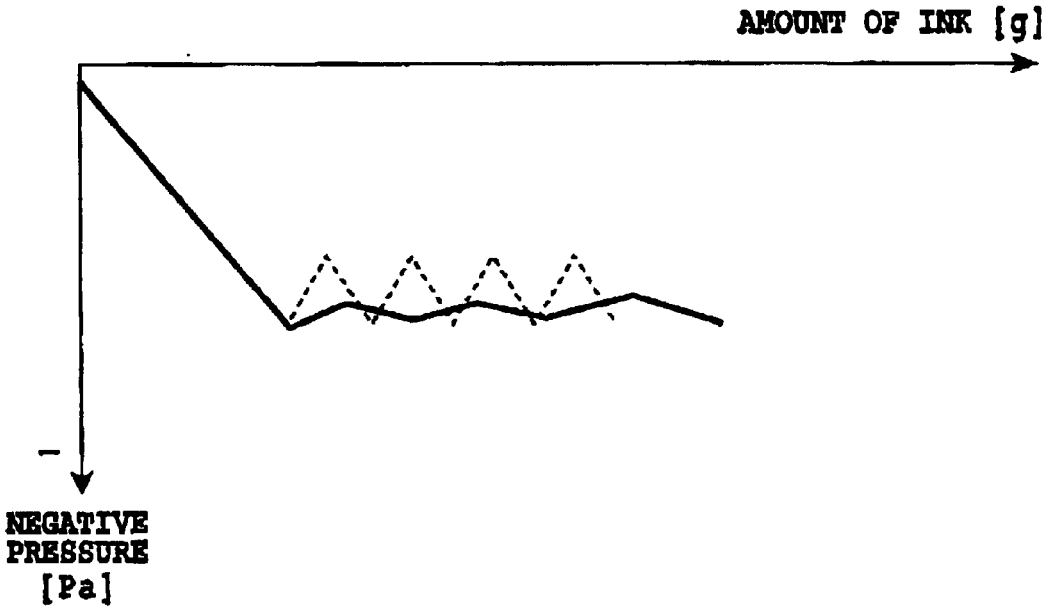
Figure 50A:
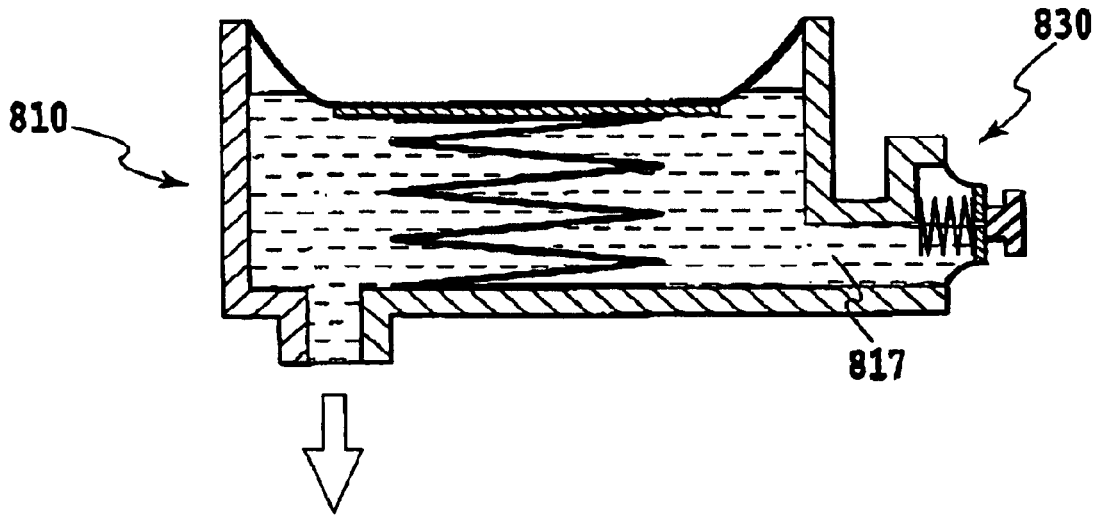
Figure 50B:
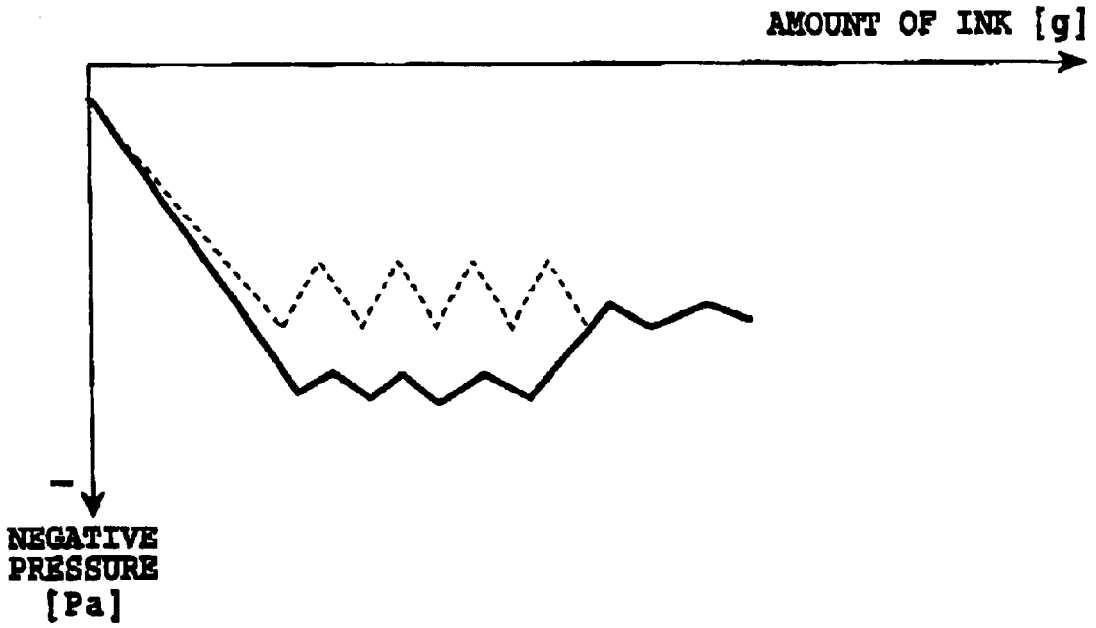

FIG. 47 illustrates a relationship between a negative pressure in an ink tank shown in FIG. 46A and the amount of remaining ink;

FIG. 48 illustrates a relationship between a negative pressure in a modified configuration of an ink tank shown in FIG. 46A and the amount of remaining ink;

FIGS. 49A and 49B each illustrates an example of a configuration of an ink tank different from the configuration shown FIG. 46A and a relationship between a negative pressure therein and the amount of remaining ink; and FIGS. 50A and 50B each illustrates an example of an ink tank of another configuration shown in FIG. 46A and a relationship between a negative pressure therein and the amount of remaining ink.

DETAILED DESCRIPTION OF THE PREFERRED EMBODIMENTS

The present invention will now be described in detail with reference to the drawings.

Various embodiments of the invention applied to an ink jet recording apparatus will be described below. Specifically, a liquid container contains ink to be supplied to an ink jet recording head, and the term "ink" may therefore be substituted for the term "liquid". Specifically, the present invention is effective for an ink containing color material. More specifically, the present invention is preferable for an ink containing pigment to ensure more excellent ink supply characteristic.

1. Embodiments of Basic Configuration 1.1 First Embodiment of Basic Configuration FIGS. 2 to 6 illustrate a first embodiment of a basic configuration of the invention.

In FIG. 2, reference numeral 10 represents a cartridge type ink tank (also referred to as "ink cartridge") in which ink can be contained, and reference numeral 20 represents a recording head that can eject ink supplied from the ink tank 10. The recording head 20 is not limited to any particular method of ejecting ink and, for example, thermal energy generated by an electrothermal conversion body may be used as energy for ejecting ink. In this case, film boiling of ink may be caused by heat generated by the eletcrothermal transducer, and ink may be ejected through an ink ejection port by foaming energy at that time. The ink tank 10 and the recording head 20 in the present embodiment may be separably or inseparably coupled to configure an ink jet cartridge that can be mounted to and detached from an ink jet recording apparatus. Therefore, the cartridge type ink tank 10 or the recording head 20 may be independently replaced with new ones, or the ink jet cartridge as a whole may be replaced with new one.

An ink containing space S is defined by a movable member 11 in the ink tank 10. A space above the movable member 11 in the ink tank 10 is exposed to the atmosphere at an atmosphere communication port 12 to be put under a pressure equal to the atmospheric pressure. An outer casing 13 of the ink tank 10 serves as a shell for protecting the movable member 11 from an external force. The movable member 11 of the present embodiment is constituted by a deformable flexible film (sheet member) whose configuration in a central section thereof is regulated by a plate 14 and which has a trapezoidal side configuration. As will be described later, the movable member 11 is deformed in accordance with changes in the amount of ink in the containing space S and fluctuations of a pressure in the same. In such cases, the peripheral section of the movable member 11 is expanded and contracted or deformed in a good balance, and the central section of the moveable member 11 moves up and down with a substantially horizontal attitude or orientation thereof maintained. Since the movable member 11 is thus smoothly deformed (moved), the deformation will cause no shock, and there will be no abnormal pressure fluctuation attributable to shock in the containing space S.

In the ink containing space S, there is provided a spring member 40 in the form of a compression spring for exerting a force that expands the movable member 11 outward through the plate 14 to generate a negative pressure within a range in which an ink ejecting operation of the recording head can be performed in equilibrium with an ability for holding meniscus formed at an ink ejecting port of the recording head. FIG. 2 shows a state in which the containing section S is substantially fully charged with ink, and the spring member 40 is compressed to generate an adequate negative pressure in the ink tank even in this state.

The recording head 20 is equipped with hollow needles 21 and 22 that can be stuck into rubber plugs 17 and 18. The hollow needle 21 is stuck into the rubber plug 17 to form a supply channel L1 for supplying the ink in the containing space S to the recording head 20. A filter 23 is provided in the supply channel L1. Reference numeral 24 represents a sealing member such as a rubber that is in tight contact with the rubber plug 17. The other hollow needle 22 is stuck into the rubber plug 18 to form a communication channel L2 for exposing the containing space S to the atmosphere. A one-way valve 30 that is schematically shown in FIG. 2 is provided in the communication channel L2. Reference numeral 25 represents a sealing member such as a rubber that is in tight contact with the rubber plug 18. The rubber plugs 17 and 18 may be formed with slits 17A and 18A to allow the hollow needles 21 and 22 to be stuck easily. When the hollow needles 21 and 22 are not stuck into the slits 17A and 18A, the slits are closed by an elastic force of the rubber plugs 17 and 18. An ink supply port 15 and a communication port 16 are formed at the bottom of the ink tank 10, and they are closed by the rubber plugs 17 and 18. Therefore, the ink containing space S is completely sealed when the hollow needles 21 and 22 are not stuck and is substantially sealed when the needles are stuck except for the ink supply port 15 and the communication port 16.

The schematically illustrated one-way valve shown in figures shows its function symbolically. The states of the valve in the figures do not indicate an opening state or a closing state of the valve as they are. Other figures illustrating the one-way valve symbolically as above are to be considered likewise.

Figure 3A:
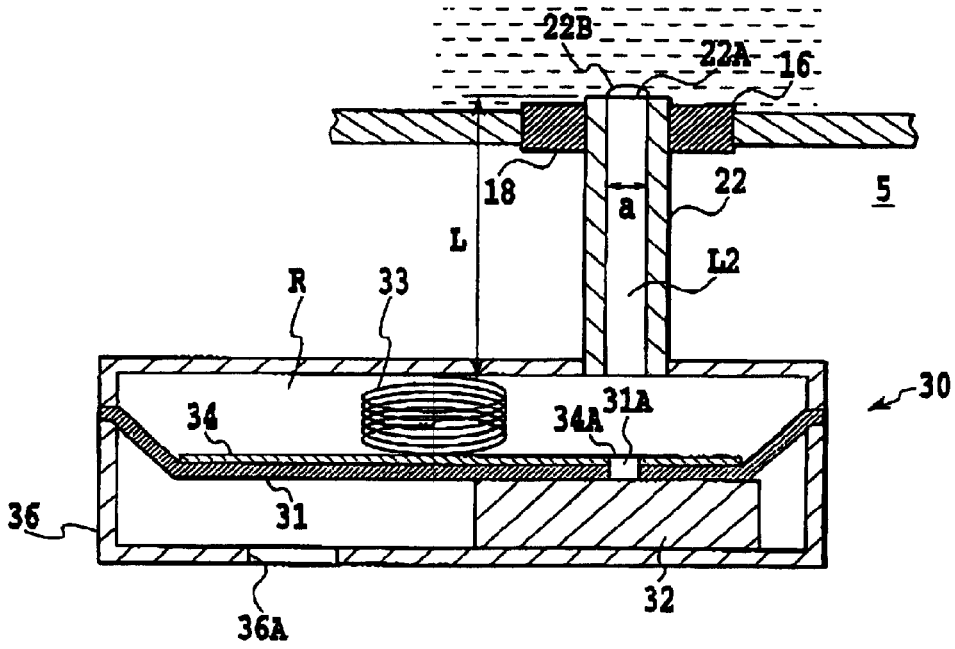
FIGS. 3A and 3B are sectional views for explaining operations of a one-way valve in FIG. 2.
Figure 3B:
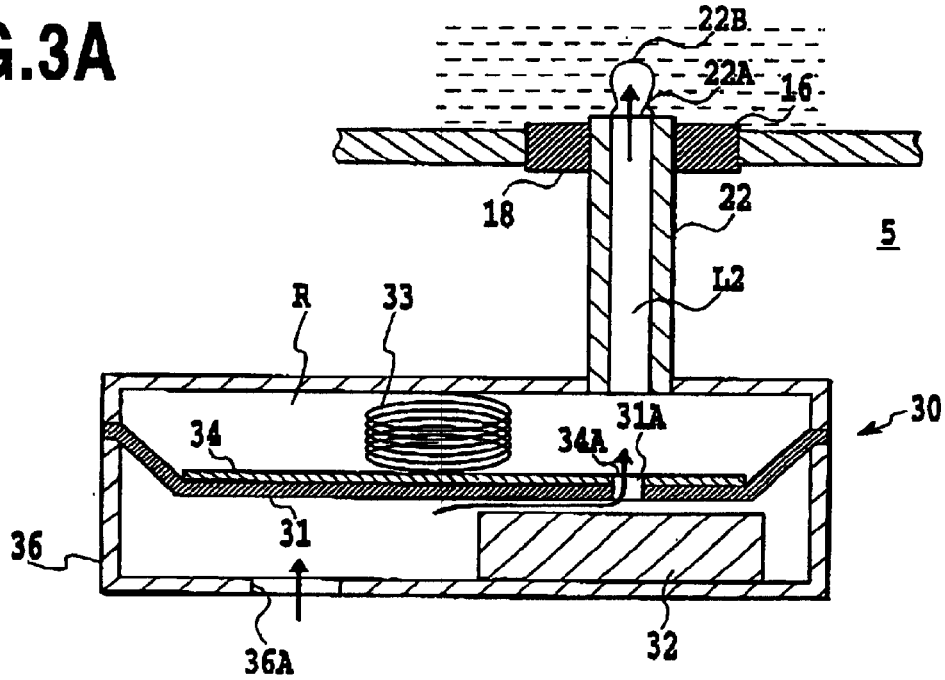

FIGS. 3A and 3B illustrate an example of a specific configuration and an operation of the one-way valve 30 according to the present invention when applied to the configuration shown in FIG. 2. It is a matter of course that such configuration in performing the operation can be utilized in the similar manner to the other examples which will be explained hereinafter.

In FIG. 3A, the one-way valve 30 of the present embodiment has a configuration to be connected to the ink tank 10 through a hollow needle (tube) 22 having direct communication with the tank. Such valve herein is configured as a diaphragm valve utilizing a diaphragm 31. Specifically, the diaphragm 31 is formed with an opening section 31A at a fixed position in a face-to-face relationship with a sealing member 32 provided with a housing 36 in a fixed manner. The opening 31A is normally sealed with the sealing member 32. The diaphragm 31 is urged by a spring member 33 downward in FIG. 3A through a support plate 34 explained later. The opening 36A having a communication with the atmosphere is provided on the housing 36 that constitutes a valve chamber R in which the diaphragm 31 and the spring member 33 are provided, and the sealing member 32 is fixed in a position in a face-to-face relationship with the opening 31A. When the opening section 31A is pressed against the sealing member 32 as shown in FIG. 3A, the opening section 31A is closed to block the communication channel L2 between the valve chamber R and the atmosphere. The support plate 34 is in tight contact with the diaphragm 31 and has an opening 34A corresponding to the opening section 31A as well. An establishment of communication between the valve chamber R and the ink tank 10 through the hollow needle 22 will results in a presence of ink in the ink tank to the extent of an end of the hollow needle 22 or of a certain position within the hollow needle. Therefore, the valve chamber R has the same internal pressure as that in the ink containing space S.

When ink is supplied from the ink tank 10 to the recording head 20 to reduce the amount of ink in the containing space S, the pressure in the containing space S (inner pressure) decreases (the negative pressure increases) accordingly. When the pressure in the containing space S becomes equal to or less than a predetermined value (equal to or more than the predetermined negative pressure), the opening section 31A gets away from the sealing member 32 to have a communication with atmosphere. That is, the air in the valve chamber R is supplied due to the reduction of the pressure within the containing space S, resulting in an increase of the negative pressure in the valve chamber R. When the negative pressure in the valve chamber R reaches a predetermined value, the diaphragm 31 and the support plate 34 move toward a side of the valve chamber R against the urging force of the spring member 33 because a difference between the pressures inside and atmosphere (outside the chamber R) excesses the urging force of the spring member 33, resulting in a separation of the opening section 31A from the sealing member 32. As a result thereof, the opening section 31A opens to introduce outside air under a pressure higher than that in the valve chamber R into the valve chamber R. Such introduction of outside air moderates the pressure in the valve chamber R and the containing space S, and the opening section 31A is then closed again by the urging force of the spring member 33. Up to this point, the pressure in the valve chamber R rises near to that of the atmosphere. The urging force of the spring 33 causes a displacement of the diaphragm 31 toward the seal member 32 to establish a tight contact therebetween in order to keep the predetermined negative pressure.

Such an function of opening and closing the one-way valve 30 keeps the pressure in the valve chamber R and the ink containing space S at the predetermined pressure (a pressure smaller than that of the atmosphere).

The valve chamber R and the ink containing space S are in communication with each other through the hollow needle 22, and an opening 22A at the end of the hollow needle 22 is in contact with ink, which results in the formation of meniscuses 22B, an interface formed between the ink and the air that projects toward the ink containing space S, at the opening 22A.

When the negative pressure in the containing space S exceeds the predetermined value due to a supply of ink into the recording head 20, a pressure difference occurs between the interior of the containing space S and the valve chamber R. At the instant when the pressure difference exceeds a meniscus holding capacity, air is introduced into the containing space S to eliminate the pressure difference. Next, according to a continuous reduction of the pressure within the containing space S, the diaphragm 31 is displaced upward in FIGS. 3A and 3B by the pressure while compressing the spring member 33, which opens the opening section 31A to introduce air into the valve chamber R. This moderates the negative pressure in the valve chamber R and produces a pressure difference between the interior of the containing space S and the valve chamber R at the same time, and air consequently breaks the meniscuses at the opening 22A at the end of the hollow needle 22 to be introduced into the containing space S.

At the instant when opening section 31A is opened to start the introduction of air, turbulence may occur in the air flow. In the present example, however, since the valve chamber R and the ink containing space S are in communication with each other through the hollow needle 22 and the opening 22A at the end of the hollow needle 22 has a configuration to allow meniscuses to be formed, there will be no flow of a great amount of ink into the valve chamber R.

Even when ink enters the valve chamber R as a result of an ambient change or a swing of the apparatus during transportation, since the ink is returned to the containing space S as a result of the operation of introducing air to adjust the negative pressure in the ink containing chamber S, the ink tank 10 and the one-way valve 30 eventually return to preferable states.

Taking the above operation into consideration, it is preferable to determine an opening dimension a of the opening 22A at the end of the hollow needle 22 such that the meniscus holding capacity will be smaller than the force to open the opening section 31A into the valve chamber R. For example, the opening preferably has a circular configuration with an opening diameter of 5 mm or less and more preferably has a circular configuration with an opening diameter of 1 mm or less. A length L of the hollow needle 22 is preferably such a dimension that ink is unlikely to reach the valve chamber R even when it is moved toward the valve chamber R by turbulence in the air flow as described above, the dimension precisely being 0.5 mm or more and more preferably being 5 mm or more, for example.

Such configurations are quite advantageous under conditions other than conditions of the actual use of the apparatus such as a swing of the apparatus during transportation and an ambient change, and it provides very preferable performance with regard to the stability of a negative pressure in relation to the recording head.

Such opening and closing functions of the one-way valve 30, the interiors of the valve chamber R and the ink containing space S are kept at a constant pressure.

FIGS. 4A, 4B, and 4C illustrate an ink supplying operation of the ink tank 10 that is coupled with the recording head 20.

FIG. 4A shows a state of the ink tank 10 that is reached when a small amount of ink is consumed from an initial state (FIG. 2) in which the containing space S is fully charged with ink. FIG. 4B shows a state in which the movable member 11 has been displaced downward (in the direction of compressing the spring member 40) as a result of ink consumption. The movable member 11 is at its maximum downward free displacement in the state shown in FIG. 4B, and the flexible film as the movable member 11 is tensioned and also subjected to a load from the spring member 40 when the ink is further consumed, which increased the negative pressure in the containing space S. When the negative pressure in the containing space S exceeds a predetermined air introducing pressure, the one-way valve 30 opens as described above to introduce outside air into the containing space S as shown in FIG. 4C. Therefore, the pressure in the containing space S is not decreased below the predetermined pressure, and a constant pressure is maintained in the containing space S. As a result, ink is supplied to the recording head 20 with stability to allow a recording operation to be performed as desired. Therefore, an ink tank having the above-described configuration will be preferred for the efficient and adequate application of the present invention.

FIG. 5 shows a relationship between the amount of ink supplied using the ink tank in the present embodiment of the invention and changes in the pressure in the containing space S. In a configuration as disclosed in the above-cited Japanese Patent Application Laid-open No. 7-125240 (1995) or Japanese Patent Application Laid-open No. 7-125241 (1995) in which an enclosed system is established by balancing a force originating from ink meniscus (a liquid seal) formed in the region of an annular orifice and a negative pressure provided by a spring, the introduction and blocking of air is performed with poor response and a pressure in a tank fluctuates significantly for reasons including the fact that the configuration involves an operation of breaking and re-forming the liquid seal before and after the introduction of air in response to an increase in the negative pressure and the fact that the ink level in the tank is unstable. On the contrary, in the present embodiment of the invention, the introduction (FIG. 4C) and blocking (FIG. 4B) of air is quickly and stably performed to maintain a stable negative pressure or stable supply of ink in a wide range until ink is used up as shown in FIG. 5. When air residing in the containing space S is expanded as a result of a decrease in the outside air pressure or an increase in the ambient temperature, the movable member 11 is displaced upward as shown in FIG. 6. That is, the movable member 11 is displaced upward according to the expansion of air in the containing space S to absorb a pressure change resulting from the expansion of air. Further, the spring member 40 exerts a load in the direction of urging the movable member 11 upward. A constant pressure is therefore reliably maintained in the containing space S. As a result, ink can be supplied to the recording head 20 with stability to perform a recording operation as desired. As shown in FIG. 3A, the one-way valve 30 remains closed or blocked even when air in the containing space S expands as shown in FIG. 6, which prevents ink in the ink tank 10 from leaking out.

In order to allow an increase in the volume of air introduced into the containing space S, the amount of an increase in the volumetric capacity of the space (Vs) as a result of deformation (upward displacement) of the movable member is preferably determined equal to or greater than the amount of an increase of introduced air ($\Delta Vi$).

Since the level of ink in the ink tank 10 is decreased in accordance with the amount of ink consumed in (extracted or supplied from) the ink tank 10 by introducing outside air into the ink tank 10 through the one-way valve 30 as described above, the ink in the ink tank 10 can be substantially completely extracted through the supply port 15. In addition, since the one-way valve 30 prevents the ink or air (fluid) in the ink tank 10 from being extracted or leaked to the outside, the ink in the ink tank 10 will not leak out through the communication port 16 regardless of the attitude or orientation of the ink tank 10 in use. Therefore, there is no particular restriction on the attitude of the ink tank 10 in use.

The one-way valve 30 is not limited to the configuration utilizing a diaphragm described in the present example, and various configurations may be employed including a configuration similar to that of a general check-valve in which a valve body is pressed against a valve seat by an urging force of a spring member. In summary, what is required for the one-way valve 30 is to prevent extraction or leakage of fluid (ink and gas) from the ink tank 10 to the outside and to allow introduction of air (gas) into the ink tank 10 from the outside. In case that ink exists outside the one-way valve 30 (under the diaphragm 31 in FIG. 3B, for example) i.e., outside the ink tank 10 corresponding to the configuration thereof, the one-way valve 30 allows the external ink to be introduced into the ink tank 10.

The position of the communication port 16 of the ink tank 10 is not limited to the bottom of the ink tank 10, and it may be in any position of the tank. For example, the communication port 16 may be provided in a top or side section of the ink tank 10 where air introduced into the containing space S is located.

1.2 Second Embodiment of Basic Configuration

FIG. 7 illustrates a second embodiment of the basic configuration of the invention. In the illustrated configuration, a spring member 42 in the form of a tension spring is provided outside an ink containing space S, the spring member 42 exerting a force that expands a movable member 11 outward to generate a negative pressure within a range in which an ink ejecting operation of a recording head can be performed in equilibrium with an ability to hold meniscuses formed at an ink ejecting section of the recording head.

That is, the function of the spring member 42 is substantially the same as the function of the spring member 40 of the first embodiment. However, since the present embodiment has a configuration in which the spring member 42 is not in direct contact with ink, the spring member itself has a long shelf life and improved stability, and freedom in selecting an ink material increases.

1.3 Third Embodiment of Basic Configuration

While the first embodiment has a configuration in which the spring member is provided to generate a negative pressure, the spring member may be omitted by forming the deformable flexible film to serve as a movable member using a material having spring properties. Specifically, the flexible film may be a material provided with a property of being displaced in the direction of increasing the volumetric capacity of the containing space S to have the flexible film itself serve as a spring member as an urging unit.

FIG. 8 shows an embodiment of such a configuration in which a movable member 11' is formed using a flexible film having appropriate spring properties to achieve a function substantially similar to that of the spring member 40 in the first embodiment. The present embodiment is advantageous in that ink containing efficiency is improved and in that the manufacturing cost of an ink tank is reduces because no special spring member is disposed.

An ink tank having such a flexible film may be obtained by forming an ink tank outer wall and an ink containing inner wall that can be deformed such that it is separated from the outer wall simultaneously at the same step using a direct blow forming, as disclosed in Japanese Patent Application Laid-open No. 9-267483 (1997), for example.

For example, such an ink tank may be used in a case in which a negative pressure can be maintained in a range that is somewhat appropriate for a recording head in consideration to a water head difference attributable to the positional relationship between the ink tank and the recording head and the magnitude of a negative pressure generated at the recording head and in which no problem occurs during the ejection of ink from the recording head even though no spring is used.

1.4 Fourth Embodiment of Basic Configuration

While the spring member in the first embodiment has been described as having a configuration like a coil spring, a configuration is possible in which a plate or leaf spring is used.

FIG. 9 is a perspective view of an ink tank 127 with such a configuration, the tank having an enclosed structure in which top and bottom spring/sheet units 114 are mounted to openings at the top and bottom of a square frame 115. As will be described later, the spring/sheet unit 114 is constituted by a spring unit 112 including a spring 107 and a pressure plate 109 and a flexible tank sheet (flexible member) 106. The frame 115 is formed with an ink supply port 15 and a communication port 16.

FIGS. 10A to 14B illustrate a method of manufacturing such an ink tank 127.

First, FIGS. 10A, 10B, and 10C are illustrations of steps of forming the flexible tank sheet 106 with a convex shape.

A sheet material 101 for forming the tank sheet 106 is formed from a raw material into a sheet having a large size, and the sheet material 101 is an important factor of the performance of the ink tank. The sheet material 101 has low permeability against gases and ink components, flexibility, and durability against repeated deformations Such preferable materials include PP, PE, PVDC, EVOH, nylon, and composite materials with deposited aluminum, silica or the like. It is also possible to use such materials by laminating them. In particular, excellent ink tank performance can be achieved by laminating PP or PE that has high chemical resistance and PVDC, EVOH that exhibits high performance in blocking gases and vapors. The thickness of such a sheet material 101 is preferably in the range from about 10 $\mu$m to 100 $\mu$m taking softness and durability into consideration.

As shown in FIG. 10A, such a sheet material 101 is formed into a convex shape using a forming die 102 having a convex portion 103, a vacuum hole 104, and a temperature adjusting mechanism (not shown). The sheet material 101 is absorbed by the vacuum hole 104 and formed into a convex shape that is compliant with the convex portion 103 by heat from the forming die 102. After being formed into the convex shape as shown in FIG. 10B, the sheet material 101 is cut into a tank sheet 106 having a predetermined size as shown in FIG. 10C. The size is only required to be suitable for manufacturing apparatus at subsequent steps and may be set in accordance with the volume of the ink tank 127 for containing ink.

FIG. 11A is an illustration of a step of manufacturing the spring unit 112 used for generating a negative pressure in the ink tank 127. A spring 107 that is formed in a semicircular configuration in advance is mounted on a spring receiving jig 108, and a pressure plate 109 is attached to the same from above through spot welding using a welding electrode 111. A thermal adhesive 110 is applied to the pressure plate 109. A spring unit 112 is constituted by the spring 107 and the pressure plate 109.

FIG. 11B is an illustration of a step of mounting a spring unit 112 to the tank sheet 106. The spring unit 112 is positioned on an inner surface of the tank sheet 106 placed on a receiving jig (not shown). The thermal adhesive 110 is heated using a heat head 113 to bond the spring unit 112 and the tank sheet 106 to form a spring/sheet unit 114.

FIG. 12A is an illustration of a step of welding the spring/sheet unit 114 to the frame 115. The frame 115 is secured to a frame receiving jig 116. After the flame 115 is positioned and placed on the jig 116, a sheet absorbing jig 117 surrounding the frame 115 absorbs the spring/sheet unit 114 to a vacuum hole 117A to hold the unit 114 and the frame 115 without relative misalignment. Thereafter, a heat head 118 is used to thermally weld annular joint surfaces of a top side circumferential edge of the frame 115 and a circumferential edge of the tank sheet 106 of the spring/sheet unit 114 in the figure. Since the sheet absorbing jig 117 sets the top circumferential edge of the frame 115 in FIG. 12A and the circumferential edge of the tank sheet 106 of the spring/sheet unit 114 in a uniform face-to-face relationship, the bonding surfaces are quite uniformly thermally welded and sealed. Therefore, the sheet absorbing jig 117 is important for thermal welding in order to provide uniform sealing.

FIG. 12B is an illustration of a step of cutting off a part of the tank sheet 106 protruding from the frame 115 with a cutter (not shown). A spring/sheet/frame unit 119 is completed by cutting off the part of the tank sheet 106 protruding from the frame 115.

FIG. 13, FIG. 14A, and FIG. 14B are illustrations of steps of thermally welding another spring/sheet unit 114 fabricated through the above-described steps to such a spring/sheet/frame unit 119.

As shown in FIG. 13, the spring/sheet/frame unit 119 is mounted on a receiving jig (not shown), and the periphery of the spring/sheet/frame unit 119 is surrounded by an absorbing jig 120 whose position is defined relative to the receiving jig. The receiving jig is in surface contact with an outer planar section 106A of the tank sheet 106 of the spring/sheet/frame unit 119 to hold the planar section 106A as shown in FIGS. 14A and 14B. The other spring/sheet unit 114 is absorbed and held by a holding jig 121 at an outer planar section 106A of the tank 106 thereof, and the holding jig 121 is lowered to fit ends 107A and 107B of the spring 107 of the spring/sheet unit 114 and ends 107A and 107B of the spring 107 of the spring/sheet/frame unit 119 substantially simultaneously. The ends 107A of the springs 107 have a convex shape, and the other ends 107B have a concave shape, which causes them to fit each other respectively an a self-alignment basis. A single spring member is formed by combining those springs 107 as a pair of spring member forming bodies.

The holding jig 121 is further lowered to compress the pair of springs 107 as shown in FIG. 14A. In doing so, the holding jig 121 widely presses the top planar section 106A of the spring/sheet unit 114 in FIG. 13, i.e., a top flat region of the tank sheet 106 that is formed in a convex configuration. As a result, the position of the planar section 106A of the tank sheet 106 is regulated, and the spring/sheet unit 114 approaches the unit 119 and the jig 120 located below the same while being kept in parallel with them. Therefore, as shown in FIG. 14B, the circumferential edge of the tank sheet 106 of the spring sheet unit 114 is absorbed and held at the vacuum hole 120A in contact with a surface of the absorbing jig 120, and it is also put in a uniform face-to-face relationship with the welding surface (the top joint surface in the same figure) of the frame 115. In this state, annular joint surfaces of the top circumferential edge of the frame 115 of the spring/sheet/frame unit 119 and the tank sheet 106 of the spring/sheet unit 114 are thermally welded to each other with a heat head 122.

By compressing the pair of springs 107 while thus maintaining parallelism between the planar section 106A of the tank sheet 106 of the upper unit 114 and the planar section 106A of the tank sheet 106 of the lower unit 119, ink tanks 127 having high parallelism between the planar sections 106A of the pair of tank sheets 106 thereof can be produced on a mass production basis with stability. Since the pair of springs 107 are symmetrically and uniformly compressed and deformed in FIGS. 14A and 14B, there will be no force that can incline the spring/sheet unit 114, which makes it possible to produce ink tanks 127 having high parallelism between the planar sections 106A of the pair of tank sheets 106 thereof with higher stability. Further, since the pair of springs 107 are symmetrically and uniformly compressed and deformed in FIGS. 14A and 14B, the interval between the planar sections 106A of the pair of tank sheets 106 in a face-to-face relationship changes with higher parallelism maintained, which consequently makes it possible to supply ink with stability. Further, the ink tank 127 has high sealing property, pressure resistance, and durability because no force acts to incline the planar section 106A of the flexible tank sheet 106.

Thereafter, the part of the tank sheet 106 protruding from the frame 115 is cut off to complete the ink tank 127 as shown in FIG. 10. The interior of the ink tank 127 has an enclosed structure that is in communication with the outside only through the ink supply port 15 and the communication port 16.

FIG. 15 is a sectional view of the ink tank containing chamber 130 having the ink tank manufactured through the above processes.

Ink can be reserved in the ink tank 127, and the ink is supplied from the ink supply port 15 of the ink tank 127 to a supply channel 136 through a filter 137 and is then further supplied to the head chip 133. A heater board 134 is bonded to the head chip 133 of the present embodiment to form an ink jet recording head, and the heater board 134 is formed with ink paths and orifices and is provided with electrothermal transducers (heaters) to be able to eject ink supplied from the ink tank 127. Air can be introduced into the ink tank 127 through the communication port 16 in a similar manner with the above embodiments. The ink tank containing chamber 130 having the generally enclosed structure formed by the lid 132 is in communication with the outside only through a small hole 142.

An ink tank containing chamber 130 may be constructed in which a single ink tank 127 is contained or in which a plurality of ink tanks 127 are contained.

FIG. 16 shows such a structure in which a plurality of ink tanks 127 are contained. The ink tanks 127 are mounted to an ink tank mounting section 131 using welding or bonding. Thereafter, a lid 132 is mounted to an opening of the ink tank containing chamber 130 using welding or bonding to form a semi-enclosed space in the ink tank containing chamber 130.

1.5 Example of Structure of Ink jet Printing Apparatus

FIG. 17 is a perspective view of an example of an ink jet recording apparatus as a liquid-consuming apparatus to which the invention can be applied.

Such a recording apparatus is a serial type ink jet printing apparatus. In the recording apparatus 50 of the present embodiment, a carriage 53 is guided by guide shafts 51 and 52 such that it can be moved in main scanning directions indicated by the arrow A. The carriage 53 is moved back and forth in the main scanning direction by a carriage motor and a driving force transmission mechanism such as a belt for transmitting a driving force of the same motor. The carriage 53 carries an ink jet recording head 20 (not shown in FIG. 17) and an ink tank (ink container) 10 for supplying ink to the ink jet recording head. The ink tank 10 has a structure similar to the above embodiment, and it may form an ink jet cartridge in combination with the ink jet recording head. Paper P as a recording medium is inserted into an insertion hole 55 provided at a forward end of the apparatus and is then transported in a sub-scanning direction indicated by the arrow B by a feed roller 56 after its transporting direction is inverted. The recording apparatus 50 sequentially forms images on the paper P by repeating a recording operation for ejecting ink toward a printing area on the paper P while moving the recording head 20 in the main scanning direction and a transporting operation for transporting the paper P in the sub-scanning direction a distance equivalent to a recording width.

The ink jet recording head 20 may utilize thermal energy generated by an electrothermal transducer element as energy for ejecting ink. In this case, film boiling of ink is caused by the heat generated by the electrothermal transducer element, and ink is ejected from an ink ejection port by foaming energy generated at that time. The method of ejecting ink from the ink jet recording head is not limited to such a method utilizing an electrothermal transducer element and, for example, a method may be employed in which ink is ejected utilizing a piezoelectric element.

At the left end of the moving range of the carriage 53 in FIG. 17, there is provided a recovery system unit (recovery process unit) 58 that faces a surface of the ink jet printing head carried by the carriage 53 where an ink ejecting portion are formed. The recovery system unit 58 is equipped with a cap capable of capping the ink ejection portion of the recording head and a suction pump capable of introducing a negative pressure into the cap, and the unit can performs recovery process (also referred to as "suction recovery process") for maintaining a preferable ink ejecting condition of the ink jet recording head by introducing a negative pressure in the cap covering the ink ejection portion to absorb and discharge ink through the ink ejection ports. Further, a recovery process for maintaining a preferable ink ejecting condition of the ink jet recording head by ejecting ink towards the cap (also referred to as "ejection recovery process") may be performed.

In the recording apparatus of the present embodiment, ink is supplied to the ink jet recording head 20 from the ink tank 10 carried by the carriage 53 along with the ink jet recording head 20.

1.6 Modification

At least a part of the inner wall of the containing space S of the ink tank 10 may be constituted by a movable member 11 such as a flexible film that can be deformed and, alternatively, the entire inner wall may be constituted by such a member. In such a case, a step of coupling the movable member 11 on an exterior casing 13 can be omitted so that the number of parts to be used can be reduced, which contributes to produce a good effect in reducing manufacturing cost. Instead of providing such a deformable member, a member that is displaced in accordance with the volumetric capacity of the containing space S may be provided in a part of the wall.

Positions where the ink supply port 15 and the communication port 16 are to be formed may be set in the ink tank 10 in advance, and the ink supply port 15 and the communication port 16 may be formed when the ink tank 10 is used. What is required for the ink tank 10 is to be able to contain ink, and it is not necessarily required to contain ink in advance.

While a configuration of an ink tank that is inseparably or separably integrated with a recording head and scanned in a main direction has been described in the above embodiments, the invention may be applied to an ink tank that is provided separately from a recording head and that is provided with a unit for supplying ink to the recording head through a tube and generating a required negative pressure.

2. Embodiments of Connection of Ink Tank, One-way Valve, and Recording Head

While it is possible to configure an ink jet cartridge that can be attached to and detached from an ink jet recording apparatus by coupling a recording head 20 and a one-way valve 30 with an ink tank 10 such that they can not be separated from each other, configurations are possible in which both or either of the recording head and one-way valve is separable.

In this section, a description will be made on several embodiments of modes of coupling an ink tank, a one-way valve, and a recording head.

2.1 First Embodiment of Mode of Coupling of Ink Tank, One-way Valve, and Recording Head FIG. 18 shows a configuration in which an ink tank 10 and a recording head 20 are coupled such that they cannot be separated from each other and in which the ink tank 10 and a one-way valve 30 are separably coupled. In the present example, it is possible to replace the combination of the ink tank 10 and the recording head 20, the one-way valve 30 alone, or the resultant ink jet cartridge as a whole with new one.

Here, since each of the functional members is replaceable, even if a lessening function would occur while a long-term use, only the degraded part can be replaced. The maintenance cost can be reduced, accordingly. Further, in the case where the same ink tank 10 is used for a different recording head or recording apparatus, or in the case where an using method differs in using the same recording head, the optimum negative pressure value applied to the recording head may differ in each case. However, even with the same ink tank 10, the negative pressure value can freely set only by replacing the one-way valve 30, which contributes to produce a distinctively versatile system.

2.2 Second Embodiment of Mode of Coupling Ink Tank, One-way Valve, and Recording Head FIG. 19 shows a configuration in which an ink tank 10 and a one-way valve 30 are coupled such that they cannot be separated from each other and in which the ink tank 10 and a recording head 20 are separably coupled. In the present embodiment, it is possible to replace the combination of the ink tank 10 and the one-way valve 30, the recording head 20 alone, or the resultant ink jet cartridge as a whole with new one. A filter 23 may be provided in the ink tank 10.

In such a configuration, no specific part is required for enabling a separation between the ink tank 10 and the one-way valve 30. Thus, as a whole, it is effective to achieve a cost reduction in manufacturing.

Alternatively, the ink tank 10 and the recording head 20 may be separably coupled, and the ink tank 10 and the one-way valve 30 may be separably coupled, which makes it possible to replace each of the ink tank 10, the recording head 20, and the one-way valve 30 alone with new one. In this case, the filter 23 may be provided in the ink tank 10.

Since the ink tank 10 and the one-way valve 30 are configured in a separable manner to each other, care is not needed for protecting the one-way valve, which is comparably a precision part, while distributing the ink tank 10, resulting in realizing a distribution with a simple packaging of the ink tank.

2.3 Third Embodiment of Mode of Coupling Ink Tank, One-way Valve, and Recording Head FIG. 20 is a sectional view showing a third embodiment of a mode for coupling an ink tank, a one-way valve, and a recording head.

In the present embodiment, a one-way valve 20 is provided integrally with a recording head chip (hereinafter also simply referred to as "recording head") as illustrated. An ink tank is detachably mounted to the one-way valve 30 that is provided integrally with the recording head 20.

The one-way valve 30 is provided in a part of a holder 22 for holding the recording head 20, and a hollow joint needle 238 is mounted to the valve, the needle being in communication with the channel opened and closed or blocked by the valve. The one-way valve 30 is primarily constituted by a movable member 231 having a sealing elastic body 233 mounted on an end thereof and a spring 232 for urging the movable member 231 to operate in the direction of closing the valve. Specifically, when the movable member 231 is urged downward in the figure by the spring 232 in accordance with a difference between pressures acting on both sides thereof (both sides of the same in the vertical direction of the figure), the sealing elastic body 233 abuts on another sealing elastic body 234 provided around a hole serving as an atmosphere communication hole to close the valve. When the pressure difference urges the movable member 231 upward in the figure and the force is greater than the urging force of the spring 232, the movable member 231 operates upward to open the valve.

While a needle valve is illustrated as the one-way valve by way of example, a diaphragm valve as described above may obviously be used. This equally applies to a fourth and later embodiments of modes of connecting an ink tank, a one-way valve, and a recording head.

A joint needle 228 for supplying ink is also provided on the recording head holder 22. A hollow in this needle is in communication with an ink channel 227 having a filter 225 of the recording head 20. The recording head 20 has a plurality of ink ejection ports (not shown). An electrothermal transducer element (not shown) for generating bubble in ink by generating thermal energy is provided in an ink path (not shown) in communication with each of the ejection ports. Ink is supplied from the ink tank to the ink paths through the ink channel 227.

Briefly speaking, an ink tank 10 has a flexible movable member 11 that forms a part of an ink containing section thereof and a spring 215 for urging the movable member 11 upward in the figure. This configuration makes it possible to generate a negative pressure in a proper range for forming adequate meniscuses at ink ejecting ports of a recording head 20 as will be described later with reference to FIGS. 21A, 21B, and 21C. Specifically, a space above the movable member 11 in the ink tank 10 is covered by an outer casing 13, and an atmosphere communication port 12 is provided on the outer casing 13, which makes it possible to exert the atmospheric pressure to the movable member 11. The outer casing 13 serves as a shell for protecting the movable member 11 from an external force. The movable member 11 of the present embodiment is constituted by a deformable flexible film (sheet member) whose configuration in a central section thereof is regulated by a pressure plate 14 and which is deformable in a peripheral section thereof. That is, the urging force of the spring 215 can be transmitted to a relatively large area of the flexible film with the pressure plate 14. The movable member 11 has a convex configuration in the central section and a trapezoidal side configuration. As apparent from the above, the movable member 11 can be deformed in accordance with a change in the amount of ink in the containing space thereof and fluctuations of a pressure in the same. In such cases, the peripheral section of the movable member 11 is expanded and contracted or deformed in a good balance, and the central section of the moveable member 11 moves up and down with a substantially horizontal attitude thereof maintained. Since the movable member 11 is thus smoothly deformed (moved), the deformation will cause no shock, and it is therefore possible to prevent occurrence of abnormal pressure fluctuations attributable to shock in the containing space. Even when there is a relatively great change in the pressure or temperature of outside air, it can be absorbed by the displacement of the movable member as described above.

Rubber plugs 18 and 17 to be connected the joint needle 238 of the one-way valve 30 and the joint needle 228 for supplying ink respectively are provided at the bottom of the ink tank 10. As a result, the ink containing section becomes a completely sealed space to prevent leakage of ink when the ink tank is left alone without being mounted in the holder 22. The operation of mounting the ink tank 10 in the holder 22 is carried out by inserting the joint needles to the respective rubber plugs. As a result of the insertion, air or ink can be communicated through joint needle holes 239 and 229 of respective joint needles.

As described above, the use of the one-way valve for the introduction of the atmosphere makes it possible to introduce the atmosphere from the outside preferably unlike the above-described example of the related art utilizing a liquid seal in which problems can occur including leakage of contained ink due to breakage of the liquid seal attributable to various conditions such as an extremely great difference between air pressures inside and outside the container and a shock or drop that occurs during the handling of the ink tank. In order to form meniscus at the liquid seal in the example of the related art properly, the annular orifice must be designed in accordance of specifications such as the capacity of the ink tank in which the liquid seal is used. It is therefore impracticable to use liquid seal units of one type in various ink tanks for general purposes. On the contrary, a one-way valve can be used for ink tanks of a relatively wide range of specifications because it does not involve formation of meniscus, although it depends on the elastic modulus of the spring used.

As described above, for example, when an ink tank and a one-way valve are connected, ink meniscuses are formed at the region of the joint needles in most cases depending on the pressure at that time without any particular process for forming ink meniscuses even if the one-way valve is provided separately from the ink tank, which allows the valve to operate properly thereafter. Since a one-way valve does not create any particular problem even when it is provided separately from an ink tank as thus described, there is no limit on the position of the valve for introducing the atmosphere, which makes it possible to improve freedom in designing a recording apparatus.

Further, because of the freedom in designing with respect to the position where the valve is disposed as descried above, the holder 22 holding the recording head 20 and the one-way valve 30 may be fixed on a carriage of the ink jet recording apparatus shown in FIG. 17 or may constitute a part of the carriage. That is, an ink jet recording apparatus can be configured with a capability of replacing an ink tank alone by using a recording head that has sufficient durability with respect to an actual period of use of the apparatus, or by using ink that allows the performance of the recording to be maintained for such a period. As a result, the running cost of the apparatus can be substantially limited to the cost required for tank replacement except for the recording medium such as paper.

An ink tank in an initial state that is newly put in use is completely charged with ink, and the spring 215 is fully expanded in an allowable range, in which state a minimum negative pressure or, conversely, a slightly positive pressure is normally considered to exist in the ink containing chamber. However, a high negative pressure may exist when it is mounted because of ambient conditions and the state of transportation. In the event that the joint needle 228 of the recording head 20 enters the containing space of an ink tank 10 prior to the joint needle 238 of the one-way valve 30, a great negative pressure in the excess of an ability for holding ink meniscuses formed at the ink ejection ports of the recording head may act on the recording head 20 before air is introduced through the one-way valve 30 to provide an proper negative pressure, which can cause ink to be sucked from the recording head 20.

In such a case, an operation may be performed to discharge ink through the ejection ports with a suction recovery device provided in the recording apparatus after the ink tank is completely mounted. However, in order to omit such a process and to suppress ink consumption, a configuration is preferably employed in which the joint needle 238 of the one-way valve 30 enters the containing space prior to the joint needle 228 of the recording head 20. Specifically, that is a configuration in which the joint needle 238 of the one-way valve 30 is made longer than the joint needle 228 of the recording head 30 when the joint holes 239 and 229 are provided at the ends of the joint needles 238 and 228, respectively. In such a configuration, the supply channel in the recording head 20 is formed after the joint needle 238 of the one-way valve 30 enters the containing space to provide a proper negative pressure through the introduction of air through the one-way valve 30.

FIGS. 21A, 21B, and 21C illustrate adjustment of a negative pressure in an ink tank associated with an operation of supplying ink from the ink tank that is specifically the ink tank 10 shown in FIG. 20.

FIG. 21A shows a state that is reached when a small amount of ink is consumed from an initial state of the ink tank 10 in which the ink containing space is fully charged with ink. Such ink consumption results in a decrease in the pressure in the containing space in accordance with the space corresponding to the volume of the consumed ink, and the movable member 11 is displaced downward accordingly. The displacement of the movable member 11 simultaneously causes displacement of the spring 215, and the spring 215 generates an elastic force in accordance with the displacement to obtain a state of equilibrium with generating. A negative pressure in the containing space in accordance with the elastic force in such a state of equilibrium is a negative pressure corresponding to the amount of ink at that time.

FIG. 21B shows a state in which further consumption of ink has further displaced the movable member 11 downward to cause the movable member 11 to reach the maximum downward free displacement. That is, when ink is consumed further in this state, tension acts between the flexible film as the movable member and the section holding the same to prevent displacement of the movable member 11.

When ink is further consumed in this state, a negative pressure is generated which is in accordance with the sum of the elastic force of the spring 215 and the tension (only the tension changes with the amount of ink). When the negative pressure exceeds a predetermined value in such a process, the movable member 231 of the one-way valve 30 is displaced upward against the elastic force of the spring 232 because of a relationship between the negative pressure and the atmospheric pressure to open the valve, and outside air is thus introduced into the containing space through the hole 239 in the joint needle 238. The negative pressure is thus kept at a proper value to supply ink properly during a subsequent ink ejecting operation of the recording head in accordance with the operation, which makes it possible to substantially use up the entire ink in the ink tank 10.

As described above, the pressure in the containing space will not decrease below the predetermined pressure, which makes it possible to always keep the negative pressure in the containing space in a predetermined range and allows stable supply of ink to the recording head 20 to perform a recording operation as desired.

When air residing in the containing section expands as a result of a reduction in the pressure of the outside air or an increase in the ambient temperature, the movable member 11 is displaced upward. That is, the movable member 11 absorbs a pressure change resulting from the expansion of air by being displaced upward in accordance with the expansion of the air in the containing space. Therefore, the pressure in the containing space will not increase beyond a predetermined value, and a predetermined pressure is always maintained in the containing space with improved reliability. Further, the one-way valve 30 remains closed to prevent the ink in the ink tank 10 from leaking out even when air in the containing space thus expands.

Since the one-way valve 30 prevents leakage of the ink or air in the ink tank 10 to the outside, the ink in the ink tank 10 will not leak out through the communication port 16 regardless of the attitude or orientation of the ink tank 10 in use. Therefore, no particular limit is put on the attitude of the ink tank 10 in use.

2.4 Fourth Embodiment of Mode of Coupling Ink Tank, One-way Valve, and Recording Head FIG. 22 is a sectional view showing a fourth embodiment of a mode for coupling an ink tank, a one-way valve, and a recording head.

In the present embodiment, an ink tank, a recording head, and a one-way valve are provided as separate elements. As shown in the figure, an ink tank 10 is held by a holder 22A on that is integral with a recording heed 20, and the recording head 20 along with the holder 22A is mounted on a carriage provided in an ink jet recording apparatus. This configuration is similar to the above embodiment in that a joint needle 238 of a one-way valve 30 and a joint needle 228 for supplying ink of the recording head 20 are respectively inserted into rubber plugs 18 and 17 of the ink tank 10 when the ink tank 10 is mounted.

The one-way valve of the present embodiment is also provided separately from the ink tank, which obviously provides advantages similar to the advantages described in the above embodiment and which provides another advantage as described below with respect to the position in which it is disposed. That is, a one-way valve having a life longer than the life of a recording head is used as the one-way valve of the present embodiment. Thus, the valve can be used even after the recording head is replaced with new one, and it can therefore be used for a period that is substantially the same as the life of a recording apparatus. As a result, the running cost of the apparatus can be reduced for the one-way valve.

2.5 Fifth Embodiment of Mode of Coupling Ink Tank, One-way Valve, and Recording Head FIG. 23 is a sectional view showing a fifth embodiment of a mode for coupling an ink tank, a one-way valve, and a recording head.

In the present embodiment, an ink tank and a recording head are formed integrally with each other and are separate from a one-way valve. As shown in the figure, an ink tank 10 and a recording head 20 are formed integrally with each other. Specifically, the ink tank 10 and the recording head 20 are connected through an ink channel 27 having a filter 225 therein. The unit constituted by the ink tank 10 and the recording head 20 integral with each other is mounted in a holder 22C. A one-way valve 30 is provided integrally with the holder 22C. In this configuration, only a joint needle 238 of the one-way valve 30 is inserted into a rubber plug 18 of the ink tank 10 when the ink tank 10 is mounted.

The one-way valve of the present embodiment is also provided separately from the ink tank, which obviously provides advantages similar to the advantages described in the above embodiment and which provides another advantage as described below with respect to the position in which it is disposed. For example, when special ink is used which can affect the durability of a recording head or ink tank, it is desirable to replace the recording head at the same time when the ink tank is replaced because of the consumption of the ink. On the contrary, the one-way valve may be fixed on a carriage of the ink jet recording apparatus or may constitute a part of the carriage just as in the case of the holder 22 in the embodiment according to FIG. 20. That is, a one-way valve having a life longer than the life of the recording head is used as the one-way valve of the present embodiment. Thus, the valve can be used even after the recording head is replaced with new one, and it can therefore be used for a period that is substantially the same as the life of the recording apparatus. As a result, the running cost of the apparatus can be reduced for the one-way valve.

2.6 Sixth Embodiment of Mode of Coupling Ink Tank, One-way Valve, and Recording Head FIG. 24 is a sectional view showing a sixth embodiment of a mode for coupling an ink tank, a one-way valve, and a recording head.

As shown in FIG. 24, the present embodiment is different from the above-described three embodiments in that a one-way valve 30 is fixed in a predetermined position on a recording apparatus; a joint needle 238 and the valve 30 are connected with a tube 235; and the joint needle 238 is fixed to a holder 22D in the form of a carriage. On the contrary, an ink tank 10 and a recording head 20 are formed integrally with each other, and the resultant integral unit is mounted in the holder 22D. The joint needle 238 fixed to the holder 22D is inserted into a rubber plug 18 of the ink tank 10 when the unit is mounted.

The one-way valve of the present embodiment is also provided separately from the ink tank, which obviously provides advantages similar to the advantages described in the embodiment according to FIG. 20 and which provides another advantage as described below with respect to the position in which it is disposed. For example, when a one-way valve is used which has high precision and consequently has a relatively large size, it can increase the size of a recording apparatus when provided on a carriage because the space occupied by the valve increases the size of the carriage itself. On the contrary, a valve having high precision can be used without increasing the size of an apparatus by providing the one-way valve in a predetermined position that allows efficient utilization of the space in the apparatus.

While the present embodiment utilizing a tube relates to an example in which an ink tank and a recording head are integral with each other, it will be apparent from the above description that the embodiment utilizing a tube is not limited to such cases in which an ink tank and a recording head are integral with each other and may be applied to the configurations shown in FIGS. 20 and 22 in which they are separate elements.

2.7 Seventh Embodiment of Mode of Coupling Ink Tank, One-way Valve, and Recording Head FIG. 25 is an illustration of a modification of the embodiment according to FIG. 24.

As shown in the figure, a buffer tank 236 is provided on the way of a channel constituted by tubes 235A and 235B connecting a one-way valve 30 and a joint needle 238. The purpose is to prevent ink that has entered the tube 235A through the joint needle 238 because of a relatively significant change in the ambience of the ink tank or a shock to the apparatus from reaching the one-way valve 30, thereby preventing the operation of the one-way valve 30 from being adversely affected by the ink. Specifically, even if ink enters the tube 235A through the joint needle 238, the ink is accumulated in the buffer tank 236, and it is possible to prevent the ink from entering the tube 235B that is directly connected to the one-way valve 30. While FIG. 25 shows a state in which a lower end of the tube 235A is immersed in ink accumulated in the buffer tank 236, the ink in the buffer tank is returned to the ink tank 10 in accordance with the relationship between pressures inside and outside the ink tank 10 when outside air is introduced through the one-way valve 30.

While a movable member 11 is configured such that it can be displaced to absorb any abrupt increase in the pressure in the ink tank 10 as described above, the buffering configuration of the present embodiment confronts cases in which ink can enter the tubes because of pressure changes or vibrations of ink that can not be absorbed by such displacement.

2.8 Mechanism for Mounting Ink Tank or Recording Head

FIGS. 26A and 26B schematically show configurations for mounting an ink tank or recording head as described above.

FIG. 26A shows a configuration for mounting and fixing an ink tank 10 according to the embodiment shown in FIG. 20. Specifically, clicks 23 provided on top ends of a holder 22 engage a top end of an ink tank 10 to fix the ink tank.

FIG. 26B shows a configuration for mounting and fixing an ink tank 10 according to the embodiment shown in FIG. 23 in which clicks 23 provided on top ends of a holder 22C engage a groove 10*a* formed In the vicinity of a top end of an ink tank 10 to fix the ink tank.

2.9 Modification

A configuration is also possible in which the atmosphere is introduced into an ink tank by force through a one-way valve to pressurize the same, and it also makes it possible to keep the pressure in the ink tank in a proper range.

In this connection, at least a part of an inner wall of a containing space in an ink tank may be constituted by a movable member such as a flexible film, and the inner wall as a whole may alternatively be constituted by an unmovable rigid member.

3. Other Embodiments of Ink Tank Utilizing One-way Valve

While an atmosphere communication section or one-way valve is disposed at a side section of an ink tank that is connected to a recording head in the above embodiments, the position of those elements is not limited to the embodiments, and they may be provided in any appropriate position. Embodiments will be described below in which an atmosphere communication section is provided on a movable member of an ink tank and in which a mechanism serving as a one-way valve is disposed in a container that contains an ink tank.

3.1 First Embodiment

FIGS. 27A, 27B, and 27C show a first embodiment. An ink tank 127 of the present embodiment is substantially the same as that shown in FIG. 9 in configuration and is contained in a container 130 that is substantially the same as that shown in FIG. 16. The ink tank of the present embodiment is different from the configuration in FIG. 9 in that an atmosphere introducing opening 2 is provided such that it extends through a tank sheet section 106 and a pressure plate 109 instead of providing a communication port 16 on the same side of a frame 115 where an ink supply port 15 is located. In the illustrated embodiment, a container 130 is shown as containing a single ink tank, and the interior of a containing space of the same is exposed to the atmosphere through an atmosphere communication port 3.

FIG. 27A shows an expanded state of the ink tank 127 that is reached by filling the ink tank 127 with ink 7. The ink 7 is supplied to a supply channel 136 through a filter 137 and is further supplied to a heater board 134 that is provided at a head chip 133 as an ink-consuming section.

Referring to FIG. 27A, the atmosphere introducing opening 2 is formed at a section where the tank sheet section 106 and the pressure plate 109 constituting the ink tank 127 are coupled. The atmosphere introducing opening 2 is closed by a sealing rubber 1 serving as a sealing member mounted to a tank containing chamber 130 in a position associated with the atmosphere introducing opening 2. In consideration to the fact that the circumference of the atmosphere introducing opening 2 must have planarity and any deviation from the relative positional relationship between the ink tank 127 and the sealing rubber 1 attributable to contraction or expansion of the tank must be avoided when the atmosphere introducing opening 2 is closed by the sealing rubber 1, the pressure plate 109 as a movable member having the atmosphere introducing opening 2 is preferably a member in the form of a flat plate that is rigid enough to avoid deformation due to contraction or expansion of the ink tank 127. In the present embodiment, a plate-like member constituted by SUS304 is used as the pressure plate 109.

The atmosphere introducing opening 2 is a hole which extends through the section where the tank sheet 106 and the pressure plate 109 are coupled to establish communication between the inside and outside of the ink tank 127, and it is required to be sized such that ink meniscus can be formed and such that air can be introduced at this section when it is spaced from the sealing rubber 1 or when the sealed state is canceled. Specifically, it preferably has a size ranging from about 0.01 mm to 2 mm in terms of the diameter. An appropriate size may be chosen in consideration to the physical properties such as surface tension and viscosity of the ink to be used and the rigidity and elasticity of the tank sheet 106. The shape of the atmosphere introducing opening 2 is not limited to the circular configuration, and elliptic or polygonal shapes having the above area may be employed without any particular restriction. Referring to the sealing rubber 1 that is tightly fitted to the atmosphere introducing opening 2, a member such as a rubber, elastomer, or elastic resin is preferably used because it must completely seal the atmosphere introducing opening 2 when put in contact with the same. When the ink tank 127 is expanded, the sealing rubber 1 is compressed to some degree by the expansion. That is, the sealing rubber 1 is compressed from a predetermined size of the same in an unloaded state (uncompressed state). Therefore, an expansion force of the ink tank 127 and a repellent force resulting from the compression of the sealing rubber 1 ensure the sealing of the atmosphere introducing opening 2. Further, grease that is highly resistant to ink is applied to the region around the atmosphere introducing opening 2 where the sealing rubber 1 and the tank sheet 106 are put in tight contact as occasions demand, which advantageously improves sealing properties.

A description will now be made on an operation that is performed when the amount of ink in the ink tank 127 is reduced as a result of ink consumption FIG. 27B illustrates contraction of the ink tank 127 as a result of a reduction of the internal volume of the same that proceeds with the consumption of ink. The contraction occurs as a result of a reduction in the volume of the ink in the ink tank, and the pressure plates 109 as movable members move in the directions indicated by the arrows A1 and A2 accordingly. The region of a spring 107 is pushed in the same directions as a result of the movement of the pressure plates 109, and a repellent force of the spring acts on the ink as a negative pressure accordingly. Therefore, the negative pressure to the ink gradually increases as the contraction of the ink tank 127 proceeds.

Further, the force compressing the sealing rubber 1 is gradually reduced as the contraction of the ink tank 127 thus proceeds, and the elasticity of the rubber returns the rubber to a predetermined initial size. FIG. 27B shows a state of the sealing rubber 1 immediately before the rubber is separated from the atmosphere introducing opening 2 in which the rubber has been expanded to the extremity (the rubber has been returned to the predetermined initial size) during the process. In the same state, the sealing rubber 1 is not compressed, and an urging force from the ink tank 127 starts acting on the sealing rubber 1.

When ink is further consumed thereafter, since the ink tank 127 is tempted to contract, the urging force of the ink tank 127 acting on the sealing rubber 1 substantially becomes zero, and the sealing rubber 1 is instantaneously separated from the atmosphere introducing opening 2 as shown in FIG. 27C. At that instant, air 4 is introduced into the ink tank 127 through the atmosphere introducing opening 2. The introduction of the air 4 increases the internal volume of the tank, and the tank sheet 106 is thereby expanded outward or in the directions indicated by the arrows B1 and B2 again to put the atmosphere introducing opening 2 in contact with the sealing rubber 1 again, which instantaneously seals the opening to return it to the state shown in FIG. 27B. In the same state, the level 7*a* of the ink contained in the tank is obviously lower than that in the state in FIG. 27A. The operations of entering the states in FIGS. 27B and 27C are repeated, which makes it possible to always keep the negative pressure in the tank in a predetermined range even if the consumption of ink proceeds. Air having substantially the same volume as that of ink consumed through the ink jet head is introduced into the ink tank. This makes it possible to replace the ink in the ink tank with the introduced air completely and to supply substantially the entire ink to the head, and the ink in the tank can therefore be efficiently consumed.

Further, since the sealing rubber 1 is provided such that it can expand and contract, any expansion of air in the ink tank 127 attributable to an increase in the ambient temperature of the ink tank 127 or a decrease in the pressure of outside air is quickly absorbed by the expansion of the ink tank 127 through the actions of the spring 107 and the movable members 109, and the expansion of the ink tank 127 is absorbed by the expanding and contracting operations of the sealing rubber 1. Since this keeps the negative pressure in the ink tank 127 unchanged and improves the sealing between atmosphere introducing opening 2 and the sealing rubber 1, there will be no leakage of ink through the atmosphere introducing opening 2.

The configuration of the present example to provide a mechanism for functioning as a one-way valve within the container which contains the ink tank enhances a reduction in size of the ink tank and the one-way valve as a whole. A utilization of the movable member provided in the ink tank will achieve a reduction of the number of the parts to be used for the one-way valve and a cost reduction in manufacturing the same.

3.2 Second Embodiment

FIGS. 28A, 28B, and 28C shows an embodiment in which a sealing member as shown in FIGS. 27A, 27B, and 27C is used in a different mode In this case, a sealing member 311 that can be moved in the direction of contraction of an ink tank 127 is provided instead of the sealing rubber 1 in FIGS. 27A, 27B, and 27C. As shown in FIG. 28D, the sealing member 311 is constituted by two discs 311A and 311C formed from a resin material and a shaft 311B connecting them. First, the disc 311A and the shaft 311B are bonded together using a machine screw or adhesive, and the bonded element is inserted through a hole 9 provided on a wall of an ink containing chamber 130 from inside. At this time, a coil spring 8 that is wound around the shaft 311B is interposed between the disc 311A and the wall of the ink containing chamber 130. Thereafter, the shaft 311B and the disc 311C are bonded together using a machine screw or adhesive to form the sealing member 311, and the sealing member 311 is mounted on the wall of the ink containing chamber 130. The spring constant of the coil spring 8 is set at a value lower than the spring constant of a spring 107 in the ink tank. While the sealing member 311 of the present embodiment is formed from a resin material, this is not limiting the invention. For example, it may be formed from a metal material.

In the present example, since the coil spring 8 is used as a member for generating a sealing force, more precise controlling of the negative pressure can be achieved and thus better durability is obtainable comparing to the case ensuring the sealing ability by using the sealing rubber as shown in FIGS. 27A to 27C.

An operation of an ink supplying device of the present embodiment having the above-described configuration will now be described.

FIG. 28A shows an expanded state of the ink tank 127. An urging force from pressure plates 109 resulting from the expansion of the ink tank 127 forces the sealing member 311 to protrude outward from the ink containing chamber. At this time, the coil spring 8 is contracted.

Subsequently, the state shown in FIG. 28B is entered as a result of ink consumption. The ink tank 127 contracts in the same manner as that described with reference to FIGS. 27A, 27B, and 27C, and the pressure plates 109 move in the directions indicated by the arrows A1 and A2. Concurrently, the sealing member 311 follows the movement of the pressure plate 109 in the direction indicated by the arrow A2 due to the spring force of the coil spring 8. During this operation, an atmosphere introducing opening 2 is kept sealed by the disc 311A of the sealing member 311. Since the sealing member 311 is a hard formed part in practice and is capable of moving only a distance equivalent to the length of the shaft 311B, the disc 311C eventually abuts on an outer wall surface of the ink containing chamber 130, which is the state shown in FIG. 28B. This state is substantially the same as the state shown in FIG. 27B for the above embodiment.

When ink consumption is continued further, the sealing member 311 and the atmosphere introducing opening 2 are separated from each other to cancel the sealing of the atmosphere introducing opening 2. Then, air is immediately introduced through the atmosphere introducing opening 2 as shown in FIG. 28C to increase the internal volume of the tank. As a result, a tank sheet 106 expands outward or in the directions indicated by the arrows B1 and B2, and the atmosphere introducing opening 2 is instantaneously sealed by the sealing member 311 again to return to the state in FIG. 28B. In this state, the level of the contained ink is obviously lower than that in the state shown in FIG. 28A. The operations of entering the states in FIGS. 28B and 28C are repeated to make it possible to keep a negative pressure in the tank in a predetermined range even if ink consumption proceeds.

In order to improve the sealing between the atmosphere introducing opening 2 and the sealing member 311, it is advantageous to apply a rubber sheet on the surface of the disc 311A of the sealing member 311 that is put in contact with the tank sheet 106 and to apply grease that is highly resistant to ink around the region of the same associated with the atmosphere introducing opening 2.

3.3 Third Embodiment

FIG. 29 shows an embodiment in which the spring provided in the ink tank 127 is changed from a plate spring to a coil spring, the configuration being otherwise the same as that in FIG. 27A. In the present embodiment, an ink tank 127 is contracted and expanded in the same manner as in the first embodiment by a coil spring 5, and a sealing rubber 1 also operates similarly, which makes it possible to keep a negative pressure in the ink tank 127 in a predetermined range.

In the present example, a coil spring is used for a spring to be used in the ink tank 127. It is easy for the coil spring to follow a displacement in the inclination direction of the pressure plate 109. Even if a sealing face of the sealing rubber 1 and the pressure plate 109 are not in parallel, the pressure plate 109 can be in a close contact with the sealing face of the sealing rubber 1 with ease, thus enhancing a sealing ability.

3.4 Fourth Embodiment

FIG. 30 shows an embodiment in which a part of a tank sheet is bonded to an inner wall of a tank containing chamber 130 and in which an ink tank 227 is constituted by a tank sheet 206 which contracts and expands only on one side thereof. Therefore, the present embodiment involves only one pressure plate 109 to serve as a movable member. Further, the spring provided in the ink tank in this case is a conical coil spring 6. The tank sheet 206 contracts inward or in the direction indicated by the arrow C as ink is consumed, and the pressure plate 109 simultaneously moves inward in the tank to serve as a movable member also in such a configuration.

As a result, an atmosphere introducing opening 2 is separated from the sealing rubber 1 to introduce air through the atmosphere introducing opening 2 in the same manner as described in the first embodiment. The introduction of air causes the tank to expand outward or in the direction indicated by the arrow D again, which results in an increase in the internal volume of the ink tank 227 to put the atmosphere introducing opening 2 and the sealing rubber 1 in tight contact with each other again. Those operations are repeated to make it possible to keep a negative pressure in the ink tank in a predetermined range.

3.5 Fifth Embodiment

In FIG. 31, an atmosphere introducing opening 12 is provided above an ink tank 127 having the same configuration as that in the embodiment according to FIGS. 27A, 27B, and 27C, and a sealing rubber for closing the atmosphere introducing opening is a sealing rubber 21 that has a conical configuration in a part thereof to be put into contact with the atmosphere introducing opening 12. Such a configuration provides the following advantages. First, since the atmosphere introducing opening 12 is located in an upper part, air introduced through the same passes through ink when a great amount of ink is present in the tank or when the level 7A of ink is higher than the atmosphere introducing opening 12. Therefore, when the amount remaining ink becomes small as a result of ink consumption, air introduced through the air introducing opening 12 directly flows to a section where air is accumulated without passing through the ink. This makes it possible to prevent bubbling that otherwise occurs when air bubbles pass through ink. The configuration of the present embodiment is desirable especially when the amount of ink in the ink tank 127 is small because bubbling of ink has a greater adverse effect in such an occasion.

The conical configuration of the sealing rubber 21 allows more reliable sealing than that achievable when the atmosphere introducing opening 2 is closed at planar features abutting on each other.

3.6 Sixth Embodiment

In FIG. 32, a pressure plate 309 and a coil spring 25 are provided outside an ink tank 327 constituted by a tank sheet 306 a part of which is joined to an inner wall of a tank containing chamber and only one side of which undergoes contraction and expansion. The coil spring 25 is urged in the direction of expanding the ink tank 327 or in the direction indicated by the arrow F in the figure. The pressure plate 309 and the coil spring 25 may be joined using spot welding similar to the method described with reference to FIG. 11A, and the pressure plate 309 and the tank sheet 306 may be joined using heat bonding similar to the method described with reference to FIG. 11B. The inner wall of the tank containing chamber 130 and the coil spring 25 may be joined using a known method such as bonding or fitting. The tank sheet 306 constituting the ink tank 327 contracts inward or in the direction indicated by the arrow E as ink is consumed, and the pressure plate 309 simultaneously moves inward in the tank to serve as a movable member also in this case. As a result, an atmosphere introducing opening 2 is separated from a sealing rubber 1 to introduce air through the atmosphere introducing opening 2 in the same manner as described in the embodiment according to FIG. 27A. The introduction of air and an action of the coil spring 25 cause the tank to expand outward or in the direction indicated by the arrow F again, which results in an increase in the internal volume of the ink tank 327 to put the atmosphere introducing opening 2 and the sealing rubber 31 in tight contact with each other again. Those operations are repeated to make it possible to keep a negative pressure in the ink tank in a predetermined range.

While any of the above embodiments has been described as having a configuration in which a spring as an elastic member is provided inside or outside an ink tank, depending on the rigidity of a film to be used as a tank sheet, it is not essential to provide an elastic member when the sheet can be contracted and expanded by the rigidity of the film without providing the spring. Further, when two pressure plates as movable members are provided in positions where they face each other, an elastic member is provided between them. However, this is not limiting the invention, and an elastic member may be provided between the mounting position of each movable member outside the sheet and an inner wall of an ink containing chamber.

A sealing member constituted by a rubber or a shaft and a spring that can be displaced in a predetermined range has been referred to as the sealing member of each of the embodiments, it is not essential that the sealing member is constituted by a displaceable elastic member as long as it is configured similarly to a one-way valve which can introduce air into an ink tank as an ink containing section at a predetermined pressure and which prevents fluid (ink and air) from being leakeded through an atmosphere introducing opening even when the air in the ink containing section is expanded. Specifically, a wall of the ink tank containing chamber 130 described in each embodiment may be used as the sealing member. When such a configuration is used in which, the sealing member is not displaced, it is more desirable to provide a plurality of movable members as seen in the first, second, and fourth embodiments because a movable member having no atmosphere introducing opening can be moved in response to an ambient change when there in air in the tank.

In the case of a liquid container according to the invention having an elastic member for urging a movable member and utilizing the elastic member as a sealing member, the sealing member desirably has an elastic force that is smaller than the elastic force of the elastic member for urging the movable member because this makes it possible to increase the amount of ink that can be initially charged when a pressure in the ink tank is kept equal to or smaller than a predetermined value and to allow the movable member to move a certain distance (buffering space) when air is introduced into the tank.

While the atmosphere introducing opening may be provided in any position of the region that constitutes the ink containing section except for the ink supply port as a liquid supply port, it is desirable to provide it on a movable member when the ink containing section is also constituted by a rigid movable member as in each of the above-described embodiments to allow more stable introduction of air.

While configurations in which an ink in one color is contained in a single ink tank have been described above, it is obvious that a color ink jet print head can be configured by arranging three or four ink tanks containing inks in different colors in an ink tank containing chamber and by connecting different groups of nozzles to the ink tanks, respectively. For example, when a plurality of ink tanks are contained as shown in FIG. 16, partitions may be provided between the ink tanks, and members to serve as one-way valves may be provided on the partitions.

4. Preferred Embodiments of Positioning of Movable Member

A description will now be made on preferable configuration for preventing ambient air from entering into an ink tank.

The description is based on findings on a mechanism of permeation of a gas through a film as described below.

4.1 Mechanism of Permeation of Gas

There are two major mechanisms of permeation of gas molecules through a certain material. One is a mechanism of a capillary, and the other is a mechanism of an activated and diffused flow. The former is a mechanism in which a flow occurs though a capillary such as a pin hole and which is different from the mechanism solved by the present invention. On the contrary, the latter is a mechanism that is a flow of gas molecules during the permeation of the same through a plastic film having substantially no hole and that is a mechanism to play an important role in the present invention. Such a mechanism for an activated and diffused flow will now be described.

In the case of an activated and diffused flow, a gas in a first region enters a second region through a film, as described below.

First, molecules of the gas in the first region are condensed on a surface of the film and are dissolved into the film. The dissolving concentration is proportionate to a partial pressure of the gas in the first region. Thereafter, the gas molecules dissolved in the film are driven by a concentration gradient in the film for diffusion toward the second region having a lower concentration and are transpired from the film after reaching a surface of the same on the side of the second region. That is, the gas molecules permeate through the film through three steps, i.e., dissolution, diffusion, and desorption.

For example, the invention has been made on an assumption of a situation in which molecules of a gas such as oxygen or nitrogen permeate through a flexible material (film) that constitutes a liquid container from a first region outside the container to a second region in the container.

First, let us assume that a gas having a negative pressure exists in the second region in the container. In this case, a driving force to cause a gas to permeate from the first region to the second region is the negative pressure in the container and an osmotic pressure of the gas. Since liquid components (e.g., moisture) in the second region are assumed to be substantially saturated, there is a difference between concentrations of the liquid components in the first and second regions even when there is substantially no difference between partial pressures of the oxygen molecules or nitrogen molecules in the first region outside the container and the second region in the container. Therefore, the osmotic pressure of the gas is generated as a driving force to cause the gas to permeate from the first region to the second region in order to reduce the concentration of the liquid components in the second region. As a result, the amount of oxygen molecules or nitrogen molecules that permeate from the first region to the second region is proportionate to a difference between pressures in the first and second regions including the two pressures (the negative pressure and the osmotic pressure), the surface area of the film, and the duration of permeation and is inversely proportionate to the thickness of the film, as will be described later.

Next, let us assume that only a liquid exists in the second region. In this case, a significant difference occurs in the desorption mechanism that is the third step of the mechanism of an activated and diffused flow. Normally, oxygen molecules or nitrogen molecules are not so dissoluble in a liquid and are in a saturated state in a liquid during normal use. That is, even when gas molecules reach the surface of the film on the side of the second region, the gas molecules can not be desorbed from the film because the second region in the liquid is saturated with gas molecules. Therefore, the permeation of oxygen molecules or nitrogen molecules is very strongly suppressed when the second region is a liquid.

Therefore, what is to be considered to effectively prevent permeation of a gas into a liquid container is a part of the container that is located between a gaseous region in the container and an atmospheric region outside the container.

In general, a mechanism of permeation of a gas through the film is expressed by the following expression.

$$Q=G\cdot\Delta p\cdot S\cdot t/T$$

where Q [g] represents the amount of the gas that moves; G [$g\cdot m/atm\cdot m^2\cdot s$] represents a gas permeation coefficient specific to a film material; Δp represents a pressure difference between regions separated by the material; S [$m^2$] represents the surface area of the film; T [m] represents the thickness of the film; and t [s] represents elapsed time.

Among those parameters, Δp represents a pressure difference between a region in a container and a region outside the container (ambience) which has a magnitude that is the sum of an osmotic pressure generated by a difference between the concentrations of liquid components and a pressure difference generated by a negative pressure in the container. A negative pressure is maintained in the container to prevent the liquid in the container from leaking out. It is difficult to reduce the pressure difference Δp in order to suppress permeation of the gas into the container. An increase in the thickness T of the film the film M can deteriorate the function of the film when it is used as a flexible member because the flexibility is reduced as a result of an increase in rigidity.

It is therefore effective to reduce the surface area S of the inner surface of the container in contact with a gas existing in the container in order to suppress permeation of the gas into the container. That is, by minimizing contact between the flexible member or a member that is highly permeable for a gas and the gas in the container, permeation of the gas into the container through such members can be effectively prevented. The preferable positioning of the movable member in the attitude or orientation in use has been achieved based such finding.

4.2 Embodiment of Configuration

FIG. 33 is an illustration of a liquid container (ink tank) configured based on the above findings.

A space (containing section) S1 for containing a liquid L is formed by a rigid container main body 411 and a flexible sheet (flexible member) 412 in a container 410. The sheet 412 is urged downward in FIG. 33 or the direction of expanding the containing space S by a spring 414 through a rigid pressure plate 413. As a result, the containing section S1 is put under a predetermined negative pressure. As shown in FIG. 33, in an unused state of the container 410 in which the contained liquid L has not been used at all, the sheet 412 is deformed downward in FIG. 33 to maximize the containing space S1. The container 410 is used with the sheet 412 located at the bottom thereof, as shown in FIG. 33. Therefore, the sheet 412 is located downward in the direction of the gravity when the container 410 is used. That is, the sheet 412 is located lower than the middle of the containing space S1 in the direction of the gravity. A liquid supplying hole 415 is provided at the bottom of the containing space S1, and an atmosphere communication port 416 is provided at the top of the main body 411. A space S2 is formed in the container 410 under the sheet 412, and the space S2 is exposed to the atmosphere at a communication port 417.

In the present embodiment, a one-way valve 430 is mounted on the atmosphere communication port 416 provided at the top of the main body 411, the one-way valve being an opening/closing mechanism having a spring 421, a pressure receiving plate 422, a flexible member 423, and a sealing member 424. The pressure receiving plate 422 and the flexible member 423 are formed with air holes 422A and 423A respectively, and the spring 421 urges the flexible member 423 against the sealing member 424 through the pressure receiving plate 422 to close the air holes 422A and 423A as shown in FIG. 33. The opening/closing mechanism is opened and closed by a pressure difference existing between the interior of the containing space S1 and outside air. Specifically, when a negative pressure in the containing space S1 has not reached a predetermined magnitude, the air holes 422A and 423A are closed as shown in FIG. 33 to prevent the introduction of outside air into the containing space S1. When the negative pressure in the containing space S1 is equal to or greater than the predetermined magnitude, the pressure receiving plate 422 and the flexible member 423 are displaced downward against the urging force of the spring 414 to open the air holes 422A and 423A. Thus, outside air is introduced into the containing space S1 through the air holes 422A and 423A and the atmosphere introducing opening 416.

As a result, the negative pressure in the containing space S1 is kept in a predetermined range. The magnitude of the negative pressure for introducing outside air into the containing space S1 can be easily and precisely set by changing the strength of the spring 421.

More specifically, the function of the one-way valve 430 is as follows. The following description is on an assumption that ink as the liquid L is contained in the containing space S1 and is supplied to an ink jet recording head through the extracting or supplying port 15. The recording head may utilize thermal energy generated by an electrothermal transducer as energy for ejecting ink. In this case, film boiling of ink may be caused by heat generated by the electrothermal transducer, and ink may be ejected from ink ejection ports by foaming energy generated at that time.

When the containing space S1 is sufficiently filled with ink as shown in FIG. 33, an expanding force (a reaction force originating from compression) in accordance with the amount of compression and displacement of the spring 414 in a compressed state acts on the sheet 412 through the pressure plate 413. The direction of the expanding force acts downward in FIG. 33 or the expanding direction of the spring 414. At this time, a pressure directed inwardly of the containing space S1 acts in the containing space S1. Specifically, a pressure P1 in the containing space S1 has a value with a negative sign (a negative pressure) on an assumption that the atmospheric pressure is "0". That is, the negative pressure P1 generated in the containing space S1 acts in a direction that is opposite to the direction of the force provided by the spring 414. Since the negative pressure P1 thus acts in the containing space S1, a negative pressure also acts on meniscuses at ink ejecting nozzles in the recording head, which prevents ink from leaking out the ink ejection ports provided on the recording head.

In such a state, the air holes 422A and 423A are closed by the sealing member 424 in the valve chamber of the one-way valve. The negative pressure P1 in the containing space S1 also acts in the valve chamber through the communication port 416. The expanding force of the spring 421 also acts in the valve chamber, and the expanding force acts upward in FIG. 33 or in the expanding direction of the spring 421. That is, the direction of a pressure exerted by the spring 421 in the valve chamber is the same as the expanding direction of the spring 421. A pressure P2 in the valve chamber required to seal the air holes 422A and 423A with the sealing member 424 is greater than the absolute value or magnitude of negative pressure P1. Specifically, the one-way valve is kept in a sealed state by keeping a force originating from the spring 421 and the flexible member 423 greater than the negative pressure P1 against which it acts.

When ink is further ejected from the recording head to reduce the amount of ink remaining in the containing space S1, the negative pressure P1 in the containing space S1 increases accordingly.

Specifically, as a result of a reduction in the amount of ink remaining in the containing space S1, the internal volume of the containing space S1 that is an enclosed space is also substantially reduced, which causes the sheet 412 to be displaced upward accordingly. The displacement of the sheet 412 is accompanied by upward displacement of the pressure plate, which causes the compression of the spring 414 to proceed. The progress of the compression of the spring 414 means an increase in the expanding force of the same, and this results in an increase in the negative pressure P1 in the containing space S1.

The increasing negative pressure P1 in the containing space S1 eventually balances the pressure P2 in the valve chamber of the one-way valve. The one-way valve is kept in the sealed state until that time. Thereafter, the negative pressure P1 further increases, and the sealing member 424 becomes unable to seal the air holes 422A and 423A depending on the pressure P2 in the valve chamber. The sealing of the holes is canceled at that instant.

As a result, the atmosphere flows in through the air holes 422A and 423A, and it is introduced into the containing space S1 through the communication port 416. The introduction of the atmosphere increases the volumetric capacity of the containing space S1 that has been reduced and conversely decreases the negative pressure P1 that has been increased, at the same time. As a result of the reduction in the negative pressure P1, the air holes 422A and 423A of the one-way valve are sealed by the sealing member 424 again.

Thereafter, the change in the negative pressure P1 becomes very small, and the consumption of ink proceeds with a substantially constant negative pressure value maintained. The negative pressure P1 then increases again, and the negative pressure P1 is reduced by canceling the sealing of the air holes 422A and 423A each time the sealing member 424 fails to seal them depending on the pressure P2 in the valve chamber. The one-way valve repeats such an operation to keep the negative pressure P1 in the containing space S1 in a predetermined range. Therefore, the recording head can use up the ink in the containing chamber S1 while maintaining a stable state of ejection.

Thus, in the present embodiment, the negative pressure in the containing space S1 balances the force of the one-way valve to close the opening as a result of consumption of ink in the containing chamber and, at the instant when the negative pressure in the containing space S1 increases as a result of further consumption of ink, the one-way valve opens the opening to introduce the atmosphere into the containing space S1. The introduction of the atmosphere increases the volumetric capacity of the containing space S1 and simultaneously reduces the negative pressure therein, which causes the one-way valve to close the opening.

FIGS. 34A, 34B, and 34C are illustrations for explaining the above-described situation of the container 410. The one-way valve 430 is schematically shown in those illustrations.

As shown in FIG. 34A, the container 410 is used in an attitude or orientation in which the sheet 412 is located downward in the direction of the gravity. When the liquid L in the container 410 is supplied to the outside through the liquid supplying port 415, the sheet 412 is first deformed upward against the urging force of the spring 414 in accordance with the amount of the supplied liquid L as shown in FIG. 34B, and the volume of the containing space S1 is decreased with the negative pressure kept unchanged. In FIG. 34B, the sheet 412 is deformed upward to the extremity, and a buffer area is provided in the form of such a reduction in the volume of the containing space S1 that is accompanied by the deformation of the sheet 412. The buffer area is an area for absorbing fluctuations of the pressure in the containing space S1 accompanied by the deformation of the sheet 412. Fluctuations of the pressure in the containing space S1 are attributable to thermal expansion of a gas (air) in the containing space S1.

When the liquid L in the container 410 is further supplied to the outside, air is introduced through the atmosphere communication port 416 to replace the supplied liquid L without any further deformation of the sheet 412 in which the buffer area has been provided, as shown in FIG. 34C. That is, air is introduced through the atmosphere communication port 416 as a result of a reduction in the pressure in the containing space S1 attributable to the supply of the liquid L to maintain the negative pressure in the containing space S1.

Thus, the container 410 supplies the liquid L to the outside from the unused state shown in FIG. 34A in which the liquid L contained in the containing space S1 is not consumed at all until the buffer area is provided as shown in FIG. 34B, the supplying operation being accompanied by the deformation of the sheet 412. Thereafter, the liquid L is supplied to the outside with air introduced through the atmosphere communication port 416 as shown in FIG. 34C. Thus, the liquid L in the containing space S1 is supplied to the outside with stability under a predetermined negative pressure.

FIG. 35 is an illustration of the container 410 in use in which introduced air has been accumulated in an upper part of the interior of the containing space S1. The concentration of the vapor of the contained liquid in the air in the containing space S is near saturation, and the vapor concentration is greatly different from the vapor concentration of outside air. Therefore, an osmotic pressure of a gas as described above is generated between the region inside the containing space S1 where air is present and outside air, and an osmotic pressure acts on the main body 411 in contact with the air in the containing space S1 to allow the outside gas to permeate into the containing space S1 as indicated by the arrows in FIG. 35. Further, since the containing space S1 has the negative pressure to prevent the liquid L from leaking out, there is a pressure difference between the space and the outside. Such a pressure difference between the inside and outside the containing space S1 generates a force that can cause an outside gas to permeate into the containing space S1. The amount of such permeation of the gas is as expressed by the expression presented earlier in the document.

In the present embodiment, since the region of the container 410 in contact with the gas (air) in the containing space S1 is the main body 411 that is rigid (inflexible), the permeation of the outside gas into the containing space S1 can be prevented by adopting a material having a low gas permeability (e.g., a metal) as the material of the main body 411.

As thus described, the flexible sheet 412 is provided downward in the direction of the gravity to prevent an osmotic pressure of a gas from acting on the same, which makes it possible to suppress the amount of a gas that permeates through the sheet 412 even when a flexible member having a high gas permeability is used as the same. Thus, the buffering mechanism accompanied by deformation of the sheet 412 can sufficiently work to absorb fluctuations of the pressure in the containing space S1 even when the liquid L is stored for a long time, and this consequently makes it possible to prevent the leakage of the liquid L and the breakage of the container 410.

4.3 Modification

It is not essential that a flexible member is provided in the liquid containing section of the liquid container, and a configuration is possible in which the liquid containing section is constituted by a plurality of materials that are different in gas permeability and in which a material having a high gas permeability is located downward in the direction of the gravity when the container is used. The liquid container according to the invention may be used in a wide range as a container for containing various liquids other than ink.

In stead of providing a flexible member made of a material having higher gas permeability than that of the rigid (inflexible) main body 411 downward in the direction of the gravity in the attitude of the same in use, for example, as shown in FIG. 36, a flexible member 412' having a multilayer (e.g., double layer) structure configuration may be adopted to allow ink to spread between the layers due to a capillary force or to insulate regions inside and outside an ink tank with an ink layer, thereby preventing a gas from entering the tank. This makes it possible to relax limitations on the attitude or orientation of an ink tank in use and to increase freedom in designing an ink tank or recording apparatus. In addition, it is possible to prevent a gas from entering an ink tank effectively even in transportation during which the ink tank can be in various attitudes.

5. Ink Tank Design Conditions 5.1 Operating Principle of One-way Valve of Another Embodiment of the Invention FIG. 37 shows a liquid container in another embodiment of the invention, the liquid container having an ink jet recording head 520 (hereinafter simply referred to as "recording head) integrally mounted thereto. The liquid container (hereinafter also referred to as "ink container") is generally constituted by two chambers, i.e., an ink containing chamber 510 in which an ink containing space 510A is defined and a valve chamber 530, and the interiors of the two chambers are in communication with each other through a communication channel 517. Ink to be ejected from the recording head 520 is charged in the ink containing chamber 510 and is supplied to the recording head 520.

The ejection of ink from the recording head 520 is not limited to any particular method and, for example, thermal energy generated by an electrothermal transducer may be used as energy for ejecting ink. In this case, film boiling is caused in ink by head generated by the electrothermal transducer, and ink may be ejected through ink ejection ports by foaming energy at that time.

A movable member 511 that is a movable section is disposed in a part of the ink containing chamber 510, and a space for containing ink is defined between this section and an outer casing 513. A space outside the ink containing space 510A as viewed from the movable member 511 or a space on the right-hand side of the movable member 511 in FIG. 37 is exposed to the atmosphere through an atmosphere communication port 512 such that it has a pressure equal to the atmospheric pressure. Further, a substantially sealed space is formed in the ink containing space 510A except for an ink supply port 518 provided at the bottom thereof and the communication channel 517 between the valve chamber 530 serving as a valve section and the space.

The outer casing 513 defines the ink containing space 510A and also serves as a shell for protecting the movable member 511 from an external force. The movable member 511 of the present embodiment is constituted by a deformable flexible film (sheet member) whose configuration in a central section thereof is regulated by a support plate 514 that is a support member in the form of a flat plate and which is deformable in a peripheral section thereof. The movable member 511 has a convex configuration in the central section and has a trapezoidal side configuration. As will be described later, the movable member 511 is deformed in accordance with changes in the amount of ink in the ink containing space 510A and fluctuations of a pressure in the same. In such cases, the peripheral section of the movable member 511 is expanded and contracted or deformed in a good balance, and the central section of the movable member 511 undergoes parallel displacement in the horizontal direction of the figure with a substantially vertical attitude orientation of the same maintained. Since the movable member 511 is thus smoothly deformed (moved), the deformation will cause no shock, and there will be no abnormal pressure fluctuation attributable to shock in the ink containing space.

In the ink containing space 510A, there is provided a spring member 515 in the form of a compression spring for exerting an urging force that urges the movable member 511 to the right in the figure through the support plate 514 to generate a negative pressure within a range in which an ink ejecting operation of the recording head can be performed in equilibrium with an ability for holding meniscus formed at an ink ejecting section of the recording head 520. FIG. 37 shows a state in which the ink containing section 510A is substantially fully charged with ink, and the spring member 515 is compressed to generate an adequate negative pressure in the ink containing space even in this state.

The recording head 520 and the ink containing chamber 510 are coupled by inserting a supply tube 521 provided on the recording head into the ink containing chamber 510. This establishes fluidic coupling between them to allow ink to be supplied to the recording head 520. A sealing member 524 is mounted around the supply tube 521 to ensure sealing between the supply tube 521 and the ink containing chamber 510. A filter 523 is provided in the supply tube 521 to prevent any foreign substance present in supplied ink from flowing into the recording head 520.

The valve chamber 530 will now be described. The interior of the valve chamber 530 is in communication with the ink containing space 510A through the communication channel 517. In the present embodiment, the communication channel 517 is formed using a pipe made of stainless steel having an inner diameter of 0.2 mm. Further, a sealing member 538 made of rubber is mounted around the stainless steel pipe to improve sealing around the communication channel.

In the valve chamber 530, there is provided a valve closing plate 534 to serve as a valve closing member having an opening section 536 that is an element of the one-way valve and a valve sealing member 537 for sealing the opening section 536. The valve closing plate 534 is bonded to a flexible sheet 531. The opening section 536 extends through the valve closing plate 534 and the flexible sheet 531. A substantially sealing space is maintained also in the valve chamber 530 except for the communication channel 517 and the opening section 536. The space above the flexible sheet 531 in the figure is exposed to the atmosphere at the atmosphere communication port 512 to have a pressure equal to the atmospheric pressure. An outer casing 533 of the valve chamber 530 also serves as a shell for protecting the flexible sheet 531 from an external force.

The flexible sheet 531 is also deformable at a peripheral region thereof excluding a central section that is bonded to the valve closing plate. It has a convex configuration in the central section and a substantially trapezoidal side configuration. Such a configuration allows the valve closing plate 534 to be smoothly moved up and down.

In the valve chamber 530, there is provided a valve regulating spring 535 as a valve regulating member for regulating an opening operation of the valve. The valve regulating spring 535 is somewhat compressed to urge the valve closing member 534 upward in the figure utilizing a reaction force against the compression. The function of a valve is achieved by expanding and compressing the valve regulating spring 535 to put the valve sealing member 537 in tight contact with the opening section 536 and to separate them from each other, and a gas is only allowed to be introduced into the valve chamber from the atmosphere communication port 532 through the opening section 536 to provide a one-way valve mechanism.

What is required for the valve sealing member 537 is to seal the opening section 536 with reliability. Specifically, it is required to have a configuration in which at least the part thereof in contact with the opening section 536 securely seals the opening, and there is no particular restriction on the quality of the material as long as tight contact can be achieved. However, since such tight contact is achieved by the expanding force of the valve regulating spring 535, the valve sealing member 537 is more preferably formed from a material that can easily follow the flexible sheet 531 and the valve closing plate 534 moved by the action of the expanding force, i.e., a shrinkable elastic material such as rubber.

An operation of the ink container in the present embodiment having the above configuration will now be described with reference to FIGS. 38A to 38E.

Figures 38A, 38B, 38C, 38D, 38E:
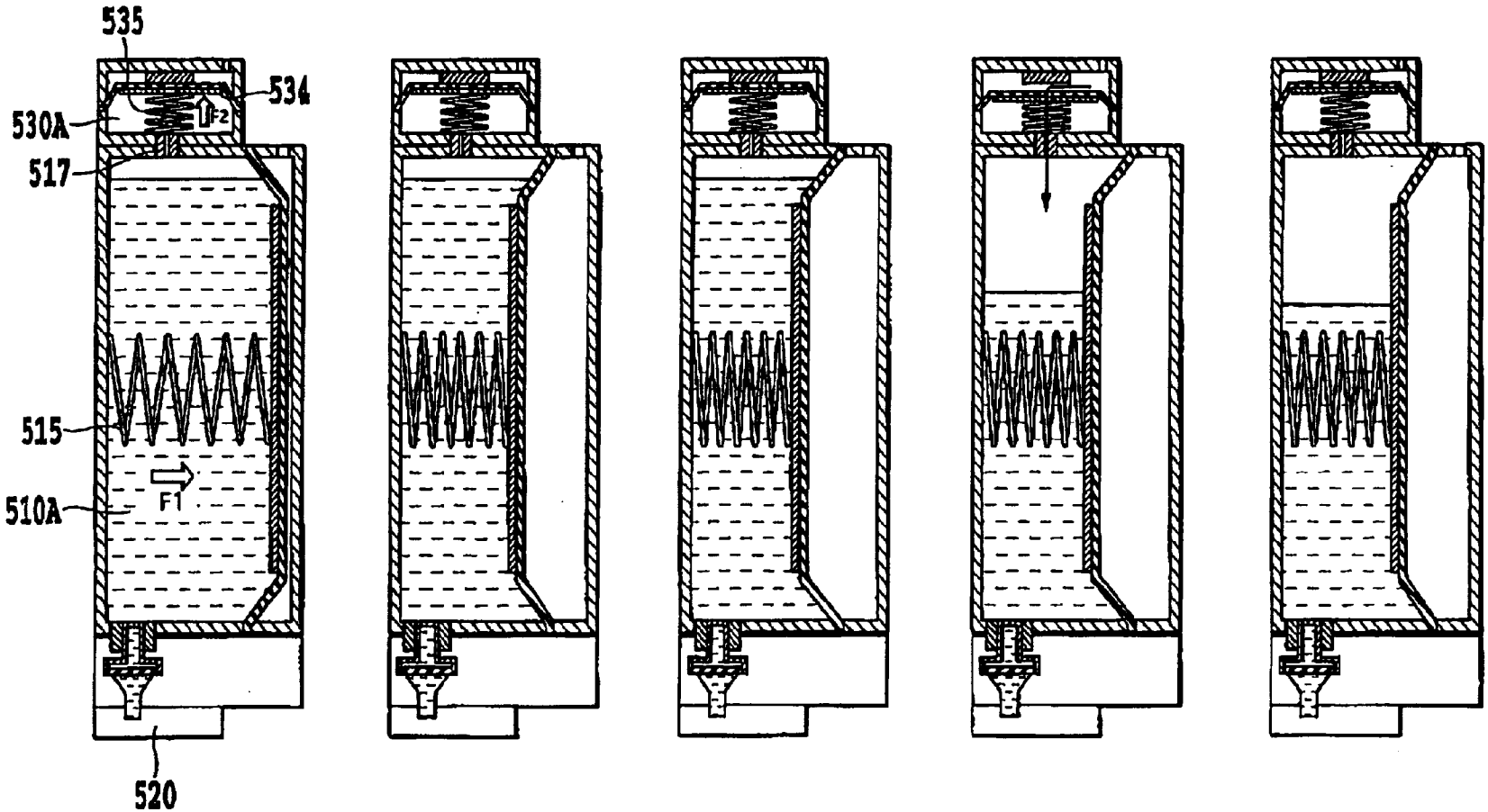

FIG. 38A shows a state of the same in which the ink containing space is sufficiently filled with ink. In this state, since the spring member 515 is compressed, an expanding force F1 (a reaction force originating from the compression) in accordance with the amount of displacement as a result of compression acts on the movable member 511 through the support plate 514. Referring to the direction of the expanding force F1 at this time, it acts rightward in FIG. 38A or the expanding direction of the spring member 515, and this direction is indicated by a positive sign in the following description. At this time, a pressure in the ink containing space 510A acts inwardly of the chamber. That is, a pressure P1 acting in the ink containing chamber 510A has a value with a negative sign (negative pressure) according to the above rule for signs on an assumption that the atmospheric pressure is "0". Therefore, when the surface area of the support plate 514 to which the spring member 515 is bonded is represented by S1, the negative pressure generated in the ink containing space at this time can be expressed as follows:

$$P1=-F1/S1 \qquad \text{Expression 1}$$

That is, the negative pressure generated in the ink containing chamber is directed opposite to the direction of the force provided by the spring member 515.

Since the negative pressure thus acts in the ink containing space, the negative pressure P1 also acts on meniscuses at the ink ejecting nozzles in the recording head 520 to prevent leakage of ink from the ink ejecting port provided on the recording head 520.

In this state, the opening section 536 is sealed by the sealing member 537 in the valve chamber 530. Referring to the pressure in the valve chamber 530, the negative pressure P1 is exerted through the communication channel 517 between the chamber and the ink containing space 510A. The expanding force of the valve regulating spring 535 acts in the valve chamber 530. Let us indicate the expanding force by "F2". Then, the expanding force F2 acts upward in FIG. 38A or the expanding direction of the valve regulating spring 535 and has the positive sign. Let us indicate the surface area of the bonding surface of the valve closing plate 534 to which the valve regulating spring 535 is bonded by "S2". Then, the direction of the pressure exerted by the valve regulating spring 535 in the valve chamber 530 as a force acting in the valve chamber coincides with the expanding direction of the valve regulating spring 535 and indicated by the positive sign. When the pressure is represented by "P2", the following relationship exists.

$$P2=F2/S2 \qquad \text{Expression 2}$$

In order for the opening section 536 to be sealed with the valve sealing member 537, the pressure P2 and the negative pressure P1 must satisfy a relationship expressed by:

$$-P1<P2 \qquad \text{Expression 3}$$

Then, Expression 2 and Expression 3 derive the following relationship:

$$-P1<F2/S2 \qquad \text{Expression 4}$$

That is, the one-way valve is kept sealed by maintaining a state in which the force provided by the valve regulating spring 535 and the valve closing plate 534 acting against the negative pressure is greater than the internal negative pressure.

The ejection of ink from the recording head 520 proceeds to reduce the amount of ink remaining in the ink containing space 510A, and the negative pressure in the ink containing space 510 increases accordingly.

FIG. 39 shows a relationship between the negative pressure in the ink containing space 510A and the amount of ink remaining therein or supplied therefrom. When ink consumption continues, a change from the state in FIG. 38A to the state in FIG. 38B occurs. The internal volume of the ink containing space 510A that is a sealed space substantially decreases with the amount of ink, which is accompanied by a leftward movement of the movable member 511 in the figure. The support plate 514 also moves leftward in accordance with the displacement of the movable member 511, and the compression of the spring member 515 also proceeds. The progress of the compression of the spring member 515 means an increase in the expanding force F1, and the negative pressure P1 also increases from the point a to the point b in FIG. 39 according to Expression 1.

When ink consumption further proceeds from the state in FIG. 38B, the movable member 511 is displaced leftward further to enter the state in FIG. 38C. This further increases the negative pressure in the ink container 510 to change to the point c in FIG. 39. In this state, the negative pressure in the ink container 510 balances the force exerted by the valve regulating member 534 in the valve chamber 530 to satisfy a relationship expressed by:

$$-P1=F2/S2 \qquad \text{Expression 5}$$

Since the force F2/S2 has a predetermined value because the state of contact of the valve sealing member 537 achieved by the pressure of the valve regulating spring 535 has not changed up to this point, when ink consumption is continued thereafter to increase the negative pressure further, the force F2/S2 becomes unable to cause the valve sealing member 537 to seal the opening section 536 in the valve chamber 530, which results in a relationship expressed by:

$$-P1>F2/S2 \qquad \text{Expression 6}$$

The relationship indicates the state shown in FIG. 38D and the change in the negative pressure at the point d in FIG. 39. At the instant when this relationship becomes true, the sealing of the opening section 536 with the sealing member 537 is canceled.

As a result, the atmosphere begins to flow in through the opening section 536 as indicated by the arrow in FIG. 38D, and it is further introduced into the ink containing space 510A through the communication port 517. The introduction of the atmosphere results in an increase in the volumetric capacity of the ink containing space 510A that has been decreasing and simultaneously results in a decrease in the negative pressure that has been increasing, conversely. The decrease in the negative pressure means a return from the state expressed by Expression 6 to the state expressed by Expression 5, and the opening section 536 and the valve sealing member 537 are put in tight contact with each other again in the valve chamber 530. This results in the state shown in FIG. 38E and a change in the negative pressure from the point d to the point e in FIG. 39.

From the above description, the following relationship is satisfied according to Expression 1 and Expression 6 in the valve chamber 530 because the relationship between the negative pressure in the ink containing space 510A and the pressure urging the valve sealing member in the valve chamber 530 can be expressed as a relationship between the magnitudes of the absolute values of the respective pressures although they act in opposite directions.

$$|F1|/S1>|F2|/S2 \quad \text{Expression 7}$$

When ink is further consumed thereafter, the state in FIG. 38D and the state in FIG. 38E alternate; there are very small changes in the negative pressure as shown at the point e and later; and ink is consumed with the negative pressure kept at a substantially constant value. That is, since the state in FIG. 38D and the state in FIG. 38E are thus repeated even when ink consumption is continued, there is no unnecessary increase in the negative pressure in the ink containing space 510A after a certain amount of ink is consumed, which makes it possible to use up the ink in the ink containing space 510A while maintaining a stable ejecting condition.

5.2 Parameter Setting

It is apparent from the above that each of the chambers can be easily designed for a desired negative pressure because the negative pressure is adjusted based on the balance between the pressures in the ink containing space 510A and the valve chamber 530, respectively. Specifically, the spring expanding forces F1 and F2 depend on the state of compression of the springs disposed in the respective chambers, and the expanding forces are determined by the spring constants and the distances of displacement caused by the compression (the amounts of displacement in the initial compressed state and the amounts of later displacement) ($F=k\times x$; k and x represent the spring constant and the amount of displacement, respectively). Therefore, any desired negative pressure can be obtained by appropriately setting those parameters. The negative pressure can be easily adjusted by setting the surfaces areas S1 and S2 of the support plate and the valve closing plate attached to the springs appropriately.

A feature of the invention achieved in the above embodiment is to provide guidelines for designing an ink container in which the four parameters F1, F2, S1, and S2 are appropriately determined based on the relational expressions for them derived as described above.

For example, a technique disclosed in U.S. Pat. No. 6,186,620 solves the problems with the technique disclosed in Japanese Patent Application Laid-open No. 7-125240 (1995) or Japanese Patent Application Laid-open No. 7-125241 (1995) described in the section of the related art, i.e., the problems with a liquid seal. There is disclosed a configuration in which a member in the form of a plug urged by a spring is provided in a boss for introducing outside air to achieve mechanical sealing. However, there is neither consideration nor suggestion to the above-described expressions. In this sense, the above-cited invention still remains in the category of substitution of a mechanical seal for a liquid seal and does not provide guidelines for optimization of a design of an ink container unlike the present invention.

An ink container can be adequately designed in accordance with guidelines based on the principle of the invention that the four parameters F1, F2, S1, and S2 are appropriately determined in relation to each other.

For example, a discussion will now be made on a relationship expressed by F1: (S1/S2)×F2 that is derived from Expression 1 and Expression 6.

Let us assume that the spring force F2 of the valve regulating spring 535 is substantially constant because substantially no displacement occurs on the same. Then, a wide range of values of the parameter F1 can satisfy Expression 1 to prevent the introduction of outside air when the active area S2 of the force to seal the atmosphere introducing opening is small relative to the active area S1 of the spring force to generate a negative pressure or when S1/S2 is relatively large, and it is therefore assumed that the spring member 515 can be designed with high freedom to obtain an initial value of the parameter F1. However, when the parameter F1 is designed with a high initial value, the parameter F1 must be changed considerably to introduce outside air by satisfying Expression 6, which results in a great increase in the negative pressure in the ink containing space 510A. However, the negative pressure in the ink containing space 510A must be an adequate value within a range in which it is in equilibrium with an ability to hold meniscuses formed at ink ejection ports to sufficiently prevent leakage of ink from the ink ejecting section and in which an ink ejecting operation of a recording head can be performed. Therefore, in order to keep the parameter F1 in the adequate range until outside air is introduced, the spring force F2 of the valve regulating spring 535 must be relatively small, which results a risk that the opening section 536 will be easily opened by a shock or ambient change.

Such a problem can be avoided when the parameters S1 and S2 are adequately determined. Specifically, there is no need for increasing the amount of a change in the parameter F1 required for a transition from a state that satisfies Expression 1 to a state that satisfies Expression 6, which increases freedom also in setting the parameter F2 and makes it possible to effectively prevent unpreferable opening of the opening section 536.

The above discussion is merely an example, and it is obvious that each portion must be appropriately designed taking various conditions into consideration. However, this can be accomplished by considering the four parameters in relation to each other and can not be accomplished by simply considering the relationship between the magnitudes of the parameters P1 and P2 that determines whether to introduce outside air based on common sense or intuition.

5.3 Operating Principle of One-way Valve in Still Another Embodiment of the Invention.

In the above embodiment of the invention, the spring member 515 for generating a negative pressure in the ink containing space 510A and the spring member 35 and the valve closing plate 534 for generating a force to seal the opening section 536 in the valve chamber 530 are provided inside the respective chambers. However, referring to modes of utilizing a force exerted by a spring, it is possible to utilize not only a reaction force generated during compression of the same but also a reaction force generated when the spring is expanded. Therefore, each of the springs may be disposed outside the respective chamber.

FIG. 40 shows an embodiment in which the disposing positions of the springs for the ink containing chamber and the valve chamber have been moved to the outside of the respective chambers. In this configuration, when ink is sufficiently charged, a spring member 545 connected to an ink containing chamber 540 is slightly expanded, and a valve regulating spring 555 provided in a valve chamber 550 is similarly slightly expanded.

In this configuration, a movable member 541 moves leftward in the figure in accordance with the consumption of ink in an ink containing space 540A, which results in further expansion of the spring member 545 to displace the same. A negative pressure is determined by the amount of displacement at this time. The negative pressure that acts in the ink containing space 540A in accordance with the displacement of the spring member 545 at this time is generated by a force in the contracting direction of the spring member 545, and a contracting force F1 in accordance with the amount of displacement as a result of expansion of the spring member 545 (a reaction force originating from the expansion which is assumed to have the negative sign) acts on a movable member 541 through a support plate 544. Therefore, the negative pressure at this time is expressed by Expression 8 shown below according to the same rules for signs as those in the above embodiment.

$$P1=F1/S1 \quad \text{Expression 8}$$

In the valve chamber 555, since the valve regulating spring 555 that is provided between an outer casing 553 and a valve closing plate 554 exerts a force in the contacting direction of the same, a contracting force F2 in accordance with the amount of displacement as a result of expansion of the valve regulating spring 555 acts upward in the figure. A pressure in a movable member 551 is expressed by Expression 9 shown below according to the same rules for signs as those in the embodiment shown in FIG. 37.

$$P2=-F2/S2 \quad \text{Expression 9}$$

Therefore, when an opening section 556 is sealed with a valve sealing member 557 in the valve chamber 550 or when a relationship expressed by $-P1<P2$ exists, the following relationship is satisfied.

$$-F1/S1<-F2/S2$$

When tight contact between the opening section 556 and the valve sealing member 557 is canceled to introduce outside air from an atmosphere communication port 52 through the opening section 556 as a result of progress of ink consumption, the following relationship is satisfied.

$$-F1/S1>-F2/S2 \quad \text{Expression 10}$$

Only the directions of the forces exerted by the spring member 545 and the valve regulating spring 555 are different from those in the embodiment in FIG. 37, and the directions of the negative pressure in the ink containing space 540A and the pressure in the valve chamber 550 are the same as those in the embodiment in FIG. 37. Therefore, Expression 10 can be changed as follows:

$$|F1|/S1>|F2|/S2 \quad \text{Expression 11}$$

Therefore, the description of the embodiment in FIG. 37 similarly holds true here for the operation of each section that occurs as ink consumption proceeds, changes in the negative pressure, and the balance between the pressures in the ink containing space 540A and the valve chamber 550.

When such a configuration is adopted, since each of the springs is not put in contact with ink, there is no need for considering deterioration of the springs attributable to contact between members forming the springs and ink and elution and mixing of foreign substances into ink. This also results in an advantage in that freedom in selecting a material for forming the springs is increased.

While an embodiment has been shown in which the springs for the ink containing chamber and the valve chamber are both disposed outside the respective chambers, it will be easily understood that the invention can be achieved according to the relationship expressed by Expression 11 even in a configuration in which the spring for either of the chambers is disposed inside the chamber.

5.4 Area for Buffering Ambient Change

In the configurations of the above embodiments in FIGS. 37 and 40, ink consumption proceeds from an initial state in which ink is sufficiently charged and, at the instant when the negative pressure in the ink containing chamber is increased as a result of further consumption of ink in a state in which the negative pressure balances the force exerted by the valve regulating member in the valve chamber, the atmosphere begins to flow in through the opening section to be introduced into the ink containing space. As a result of the introduction of the atmosphere, the volumetric capacity of the ink containing space conversely increases, and the negative pressure decreases to close the opening section.

For example, in the embodiment in FIG. 37, ink consumption proceeds from the initial state shown in FIG. 38A and, after the state in FIG. 38C is entered, the state in FIG. 38D and the state in FIG. 38E alternate in accordance with the progress of ink consumption. That is, the internal volume of the ink containing space 510A that is a sealed space substantially decreases as the amount of ink decreases from the initial charged state; the operation of introducing outside air is enabled after the movable member 511 is displaced to the position on the left-hand side of FIG. 37; and there will be substantially no change in the internal volume of the ink containing space 510A itself thereafter because the movable member 511 thereafter stays in the vicinity of the position reached by the leftward displacement.

Specifically, the liquid container in the embodiment in FIG. 37 has the ink containing chamber 510 in which the liquid (ink) containing space 510A is defined and which includes the movable section (movable member 511) that is displaced as ink is supplied from the supply tube 521 and the valve chamber 530 which is provided with the opening section 536 for allowing a gas to be introduced into the containing space and the sealing member 537 that is a sealing member for sealing the same. The liquid container has a configuration in which the volumetric capacity of the containing space 510A decreases because of displacement of the movable member as a result of ink consumption and in which the opening section 536 is opened to introduce the gas when the volumetric capacity becomes equal to or smaller than a predetermined value (the state in FIG. 38C). The opening section 536 is separated from the sealing member 537 when the following relationship is satisfied after the state in FIG. 38C is entered.

$$P-P1>F2/S2 \quad \text{Expression 12}$$

where F2 represents the urging force for sealing the opening section 536 (the spring force of the valve regulating spring 535); S2 represents the surface area of the surface on which the urging force acts (the surface area of the bonding surface of the valve closing plate 534); P1 represents the pressure in the containing space 510A; and P represents the ambient pressure (atmospheric pressure) of the container.

Therefore, even if there is a change in the ambience of the ink tank, e.g., a temperature rise or pressure reduction, the air introduced in the containing space is permitted to expand in a quantity equivalent to the volumetric capacity of the space in the range between the displaced position and the initial position of the movable member. In other words, a space equivalent to the volumetric capacity functions as a buffer area. It is therefore possible to moderate an increase in the pressure as a result of the ambient change, thereby preventing leakage of ink from the ejection ports effectively. Further, since the flexible sheet 531 is pneumatically driven to displace by the movable member 511, no leakage of ink will be caused by the expansion of the ink containing space attributable to a change in the ambience of the ink tank, e.g., a temperature rise of pressure reduction.

Since outside air is not introduced until a buffer area is provided as a result of a reduction of the volumetric capacity of the ink containing space attributable to supply of the liquid from the initial charged state, no leakage of ink occurs even if there is an abrupt change in the ambience or the container is vibrated or dropped until that time. Further, the buffer area is not provided in advance in the state in which ink has not been used yet, the ink container can be compactly configured with high volumetric efficiency. By making the surface area S2 of the surface on which the urging force F2 (the spring force of the valve regulating spring 535) for sealing the opening section 536 acts greater than the surface area of opening section 536 or the sealing surface of the sealing member 537, sufficient sealing properties can be maintained. Furthermore, the above configuration makes it possible to achieve those advantages with a small number of components, and it is also possible to achieve stable introduction of the atmosphere by providing the opening section 536 for introducing outside air in a part of the movable members (the flexible sheet 531 and the valve closing plate 534).

A description will now be made on a volumetric capacity that is preferable as the buffer area providing the above-described functions. While the description will be made based on the ink container in the embodiment in FIG. 37, it equally applies to the ink container in the embodiment in FIG. 40.

FIG. 41 is an illustration showing how the volumetric capacity of the ink containing space 510A changes in accordance with amounts of supplied liquid (ink), amounts of extracted or supplied ink being shown on the abscissa axis of the figure, volumetric capacities being shown on the ordinate axis of the figure. The thick slid line indicates changes in the volumetric capacity of the ink containing space, and the broken line indicates changes in the amount of air in the ink containing space.

In the initial state in which ink has not been extracted yet, the movable member 511 is in a displaced position on the right-hand side in FIG. 38A, and the containing space has a maximum volumetric capacity (Vmax). The movable member 511 is displaced from this state as a result of extraction of ink, and the volumetric capacity monotonously decreases. In this state (which corresponds to the state in FIG. 38B), since air has not been introduced into the container yet, no leakage of ink occurs even if there is a change in the ambience.

When the volumetric capacity decreases to reach a value Vair or when a state corresponding to the state in FIG. 38D is reached, the opening section 536 is opened to introduce air in an amount in accordance with the amount of extracted ink, and the reduction of the volumetric capacity stops.

Thereafter, substantially no change occurs in the volumetric capacity of the ink containing chamber 510A itself. That is, since a volumetric capacity equivalent to (Vmax−Vair) is provided as a buffer area, no leakage of ink occurs even if air is introduced. While the ink in the container is difficult to be used up and the volumetric efficiency is reduced if no air is introduced at this time, since the state in FIG. 38D and the state in FIG. 38E alternate in accordance with the progress of ink extraction through the above-described operations, the ink can be effectively used up.

A description will now be made on how to set the volumetric capacity Vair of the ink containing space.

The maximum amount of air introduced into the container substantially equals the value Vair as apparent from FIG. 41. The volume V of expansion of the maximum amount of air Vair as a result of depressurization is expressed as follows:

$$V=(1/P^*)\times Vair \qquad \text{Expression 13}$$

where it is assumed that the atmospheric pressure in a substantially normal state is 1 atm (absolute pressure) and that the atmospheric pressure of the ambience in which the ink container is actually located is P atm. When the value V is equal to or smaller than the value Vmax, there will be no increase of the pressure in the container, and the ink will not leak out. Therefore, leakage of ink can be prevented by designing the valve such that it opens the opening section 536 at the atmospheric pressure of the ambience when the volumetric capacity reaches a value Vair that satisfies relationships expressed by:

$$V=(1/P^*)\times Vair \leqq Vmax \qquad \text{Expression 14}$$

$$Vair \leqq P^*\times Vmax \qquad \text{Expression 15}$$

For example, atmospheric pressures considered lowest in actual ambience in which the ink container can be located are as follows where it is assumed that the atmospheric pressure in a substantially normal state is 1 atm.

| Atmospheric pressures | Ambience |
|---|---|
| 0.9 atm | Use at ordinary altitudes without transportation |
| 0.8 atm | Use in ambience with very severe temperature changes |
| 0.7 atm | Transportation by an airplane |
| 0.6 atm | Use at a high altitude of 4000 m or more (e.g., Bolivia and Tibet) |

Therefore, the atmospheric pressure P* may be put as 0.6 atm in order to satisfy all the conditions for use, for example. An optimum configuration can be provided on an assumption that P*=0.9 atm when the container is used only at ordinary altitudes and is not transported.

For example, such data indicate that the value Vair is 0.9×Vmax or less for use only at ordinary altitudes and that the volume to start introduction of air may be 90% of the maximum volumetric capacity. However, it is desirable to set the value Vair at 0.8×Vmax or less and the volume to start introduction of air at 80% of the maximum volumetric capacity if consideration is to be paid to use in ambience with very severe temperature changes. It is desirable to set the value Vair at 0.7×Vmax or less and the volume to start introduction of air at 70% of the maximum volumetric capacity if consideration is to be paid to transportation by air or use on an airplane. It is desirable to set the value Vair at 0.6×Vmax or less and the volume to start introduction of air at 60% of the maximum volumetric capacity if consideration is also to be paid to use at a high altitude of 4000 m or more.

Since the required buffering capacity depends on ambience as thus described, it becomes easy to improve the ink containing efficiency of the container and to prevent leakage of ink effectively by designing it such that an optimum buffer volume can be obtained in accordance with the ambience.

Expression 7 can be changed as follows according to the Hooke's law where k1 represent the spring constant of the spring member 515 and X1 represents a quantity of displacement from the initial state.

$$|k1\times X1|/S1>|F2|/S2 \qquad \text{Expression 16}$$

In the present embodiment, since deformation of the movable member 511 is regulated by the spring member 515 through the support plate 514, a change in the volume attributable to the deformation of the movable member 511 is determined by displacement of the spring member 515. That is, when the volume of the container changes from Vmax to Vair, if a quantity of displacement X1 satisfying Expression 16 also satisfies expression 17 below, the valve is opened to introduce outside air always after the spring member 515 is displaced by a quantity of displacement Xair or more where Xair represents a quantity of displacement of the spring member 515.

$$X1>Xair \qquad \text{Expression 17}$$

Therefore, by configuring the valve regulating spring 535 and the spring member 515 such that a relationship expressed by Equation 18 is satisfied, no leakage of the liquid occurs because the valve is opened due to an increase in the negative pressure after a volume equal to or greater than a predetermined buffer volume is made available as a result of deformation to introduce outside air.

$$|k1\times Xair|/S1>|F1|/S2 \qquad \text{Expression 18}$$

5.5 Another Embodiment of Formation of Buffer Area for Ambient Changes

The configuration of an ink container for forming a preferable buffer area is not limited to configurations having a valve chamber as in the above embodiments in FIGS. 37 and 40, and various configurations may be employed FIG. 42A is a schematic sectional view showing another embodiment of such an ink container. A movable member 561 constituted by a flexible film (sheet member) that defines an ink containing space is provided in an outer casing 563 of the container, and the movable member 561 is urged by a spring member 565 through a support plate 564 such that the containing space has a maximum volumetric capacity in a normal state. An opening section 592 of an ink containing space 560A provided on the outer casing 563 is sealed by a valve 590 that is a sealing unit urged by a valve regulating spring 595.

FIG. 44B shows a state in which ink of a volume (Vmax−Vair) has been extracted from a supply port 568 to reduce the volumetric capacity of the containing space to a volume Vair. At this time, as a result of deformation of the movable member 561, the support plate 564 is put in contact with the valve 590 to displace the valve 590 against the urging force of the valve regulating spring 595, thereby allowing the opening section 592 to be opened. Specifically, a buffer area is provided which is the range from the initial position of the movable member 561 indicated by the broken line in the figure to the position of the same indicated by the solid line at the instant when the support plate 564 comes into contact with the valve 590. In other words, the support plate 564 comes into contact with the valve 590 to allow the opening section 592 to be opened after a predetermined buffering capacity is provided.

FIG. 43A shows state in which the support plate 564 presses the valve 590 downward as a result of further extraction of ink to instantaneously open the opening section 592, thereby introducing air into the ink containing space 560A. FIG. 43B shows a state in which the support plate 564 and the valve 590 are separated from each other. Specifically, the introduction of air as shown in FIG. 43A has moderated an internal negative pressure to reduce the force that displaces the support plate 564 downward, which causes slight upward displacement of the support plate 564 to separate the support plate 564 and the valve 590 from each other and causes the valve 590 to seal the opening section 592 again due to the urging force of the valve regulating spring 595. When ink is extracted again thereafter, the support plate 564 and the valve 590 contact with each other as shown in FIG. 42B to introduce air as shown in FIG. 43A. Since air is gradually introduced as thus described, the ink in the ink containing space 560A is gradually replaced by the air with a predetermined negative pressure maintained, which makes it possible to use up the ink and to moderate an increase in the pressure as a result an ambient change, thereby preventing leakage of ink from an ejection port effectively.

Since the valve 564 is mechanically driven to displace by the support plate 564, no leakage of ink will be cause by expansion of the ink containing chamber attributable to ambient changes such as a temperature rise or pressure reduction.

An important feature of the present embodiment is that the opening section 592 is opened only after the buffering area having the volume (Vmax−Vair) is provided because the opening and closing operations of the valve 590 is regulated by the quantity of displacement of the support plate 564. As a result, air is not introduced when no sufficient buffering area is available, and no leakage of ink therefore occurs. The present embodiment is similar to the above embodiments in that all operations can be controlled by adequately designing four parameters, i.e., the spring force of the spring member 565, the spring force of the valve regulating member 595, the surface area of the support plate 564, and the surface area of a predetermined part of the valve 590. This results in a significant advantage in that there is no need for making a change in the configuration even if changes in physical properties of ink result in significant changes in the viscosity and contact angle of the same.

A description will now be made on designing of the four parameters with reference to FIG. 44. FIG. 44 shows a state in which the support plate 564 and the valve 590 contact with each other to introduce air.

The support plate 564 is subjected to a force that is the sum of an upward urging force F1 provided by the spring member 565 and a downward total pressure P1×S1 generated when a negative pressure P1 acts on a surface area S1 of the support plate 564. The valve 590 is subjected to a force that is the sum of an upward urging force F2 provided by the valve regulating spring 595 and an upward total pressure P1×S2 generated when the negative pressure P1 acts on a surface area S2 of the part of the valve 590 that covers the opening section 592.

What is required for the valve 590 to be opened is that the force of the support plate 564 urging the valve 590 is equal to or greater than the force of the valve 590 sealing the opening section. That is:

$$P1\times S1-F1\geqq F2+P\times S2 \qquad \text{Expression 19}$$

Referring to the negative pressure at that time:

$$P1\geqq(F1+F2)/(S1-S2) \qquad \text{Expression 20}$$

That is, the spring forces F1 and F2 and the surface areas S1 and S2 of the support plate 564 and the valve 590 may be chosen based on the negative pressure to be maintained when the valve is opened to exchange air and the liquid. The volume Vair and those parameters may be appropriately determined taking various conditions into consideration just as in the above embodiments.

FIG. 45 shows a state in which ink has been nearly used up as a result of extraction through the supply port 568. At this time, the amount of air that has been introduced into the ink containing space 560A substantially equals the volume Vair, the volume of the deformation of the movable member 561 indicated by hatching serves as a buffer to prevent ink from leaking out even if there is expansion of the volume attributable to an ambient change.

5.6 Generalization of Ink Tank Design Conditions

The embodiment in FIG. 37 has a configuration in which the valve chamber 530 is located above the ink containing chamber 510 in which the ink containing space 510A of the ink tank is defined in the attitude or orientation of the same in use. However, the positional relationship between an ink containing space and a valve chamber of an ink tank may be defined in various ways, and it is desirable to design the ink tank such that the one-way valve operates properly to maintain an adequate negative pressure in the ink containing chamber in any case. A description will now be made on generalization of design conditions for an ink tank.

FIG. 46A shows an ink tank constituted by an ink containing chamber 610 having a port 618 for supplying ink to a recording head provided on the bottom thereof in an attitude of the same in use and a valve chamber 630 which is in communication with the same in the vicinity of the bottom through a communication channel 617. The ink containing chamber 610 basically has substantially the same configuration as that shown in FIG. 37 in which a movable member 611 constituted by a deformable flexible film (sheet member) is disposed, the configuration of the same in a central section being regulated by a support plate 614 that is a support member in the form of a flat plate, a peripheral section of the same being deformable. In the ink containing space, there is provided a spring member 615 in the form of a compression spring that exerts an urging force for urging the movable member 511 downward in the figure through the support plate 614 to generate a negative pressure in a range in which it is in equilibrium with an ability for holding meniscuses formed at an ink ejecting section of a recording head 520 and in which an ink ejecting operation of the recording head can be performed.

The valve chamber 630 is also substantially the same as that shown in FIG. 37, and it is provided with a valve closing plate 634 to serve as a valve closing member having an opening section that is an element of a one-way valve and a valve sealing member 637 for sealing the opening section, the valve closing plate 634 being bonded to the flexible sheet 631. In the valve chamber 630, there is provided a valve regulating spring 635 as a valve regulating member for regulating an opening operation of the valve.

FIG. 46A illustrates an initial state of the ink tank in which the tank has not been used yet, and FIGS. 46B to 46F illustrate states of the ink tank as a result of the progress of ink consumption. FIG. 47 shows changes in the negative pressure as a result of ink consumption, and the points indicated by reference numerals 60*a* to 60*f* in the figure correspond to the states in FIGS. 46A to 46F, respectively.

In the configuration in FIG. 46A, ink is present in the communication channel 617, and meniscus is formed at the end of the communication channel 617 on the side of the valve chamber 630 due to a capillary force of the communication channel 617. Therefore, a pressure to hold the meniscus is also taken into consideration when designing the ink tank.

It is assumed that in the initial state in which the ink containing space is sufficiently filled with ink (FIG. 46A), the spring member 615 exerts an expanding force F1 (a reaction force originating from compression) in accordance with the amount of displacement as a result of compression to the movable member 611 through the support plate 614. Referring to the direction of the expanding force F1 at this time, it acts upward in FIG. 46A or in the expanding direction of the spring member 615, and the direction is indicated by the positive sign. A pressure in the ink containing space at this time acts inwardly of the chamber. Specifically, a pressure PT acting in the ink containing space is a value having the negative sign (a negative pressure) according to the above-mentioned rules for signs where the atmospheric pressure is assumed to be "0". A negative pressure that is generated in the position of the opening of the communication channel 617 on the side of the ink containing space at this time can be expressed as follows, S1 representing the surface area of the support plate 614 to which the spring member 615 is bonded.

$$PT=-(F1/S1)+h\times\rho\times g \qquad \text{Expression 21}$$

where h represents the height to the uppermost or level of ink in the ink containing chamber from the position of meniscus formed at the communication channel 617(*m*); ρ represents the density of ink ($kg/m^3$); and g represents acceleration of gravitation ($m/s^2$).

In this state, in the valve chamber 630, the opening section is sealed by the valve sealing member 637. Referring to a pressure in the valve chamber 630, the negative pressure PT acts through the communication channel 617 located between the valve chamber and the ink containing space, and a pressure PM originating from an ability for holding the meniscus formed at the communication channel 617 also acts. That is, the pressure (negative pressure) in the valve chamber 630 is given by:

$$PV=PT+PM=-(F1/S1)+h\times\rho\times g+PM \qquad \text{Expression 22}$$

Incidentally, PM has either of positive and negative signs according to the relationship between the negative pressures of the ink containing chamber and the valve chamber. The value thereof becomes '0' when negative pressures are equivalent.

The expanding force of the valve regulating spring 635 also acts in the valve chamber 630, and the expanding force which is represented here by "F2" acts rightward in the figure or in the expanding direction of the valve regulating spring 635 and has the positive sign. Let us indicate the surface area of the bonding surface of the valve closing plate 634 to which the valve regulating spring 635 is bonded by "S2". Then, the direction of the pressure exerted by the valve regulating spring 635 in the valve chamber 630 as a force acting in the valve chamber is the same as the expanding direction of the valve regulating spring 635 and indicated by the positive sign. Therefore, when the pressure is represented by "P2", the following relationship exists.

$$P2=F2/S2 \qquad \text{Expression 23}$$

In order for the opening section 636 to be sealed with the valve sealing member 637, the pressure P2 and the negative pressure PV in the valve chamber must satisfy a relationship expressed by:

$$-PV<P2 \qquad \text{Expression 24}$$

Then, Expressions 22 to 24 derive the following relationship:

$$PV=(F1/S1)-h\times\rho\times g-PM<F2/S2 \qquad \text{Expression 25}$$

That is, the one-way valve is kept sealed by maintaining a state in which the force provided by the valve regulating spring 635 and the valve closing plate 634 acting against the negative pressure in the valve chamber is greater than the negative pressure. In other words, the one-way valve is kept sealed by maintaining a state in which the force provided by the valve regulating spring 635 and the valve closing plate 634 acting against the negative pressure is greater than the negative pressure in the valve chamber determined by the negative pressure in the ink containing chamber, the pressure corresponding to the depth from the uppermost or level of ink in the ink containing chamber to the position of the meniscus formed at the communication channel 617, and the pressure originating from the ability for holding the meniscus formed at the communication channel 617.

The ejection of ink from the recording head proceeds to reduce the amount of ink remaining in the ink containing space, and the negative pressure in the ink containing space increases accordingly.

Figure 46B:
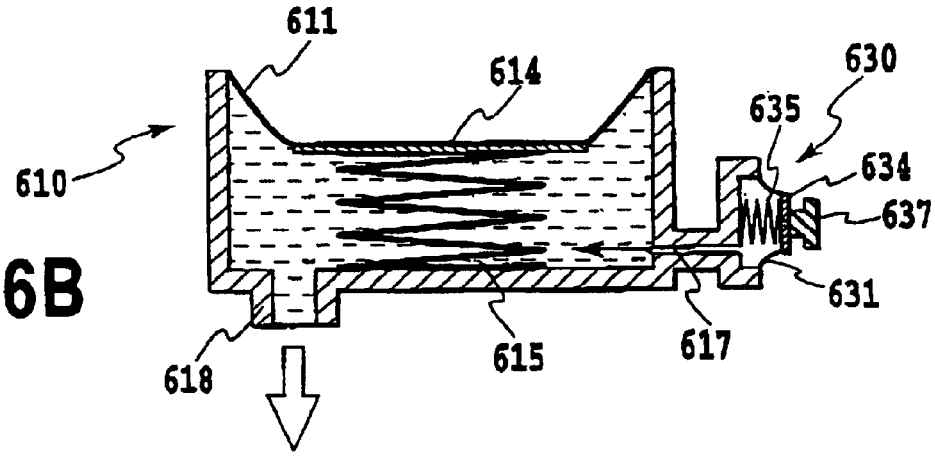

FIG. 46B and the reference numeral 61*b* in FIG. 47 indicate a state in which displacement equivalent to a buffering area has occurred and in which the negative pressure PT in the ink containing chamber increases and the depth h decreases to increase the negative pressure PV in the valve chamber.

Figure 46C:
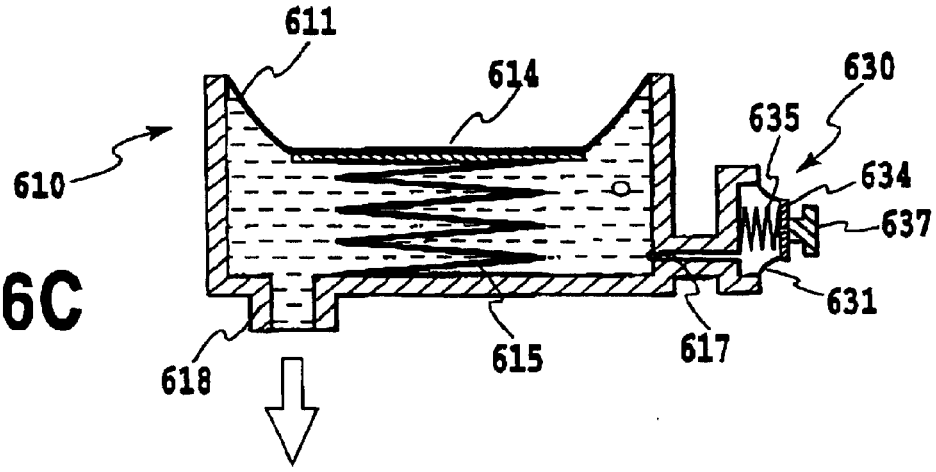
Figure 46D:
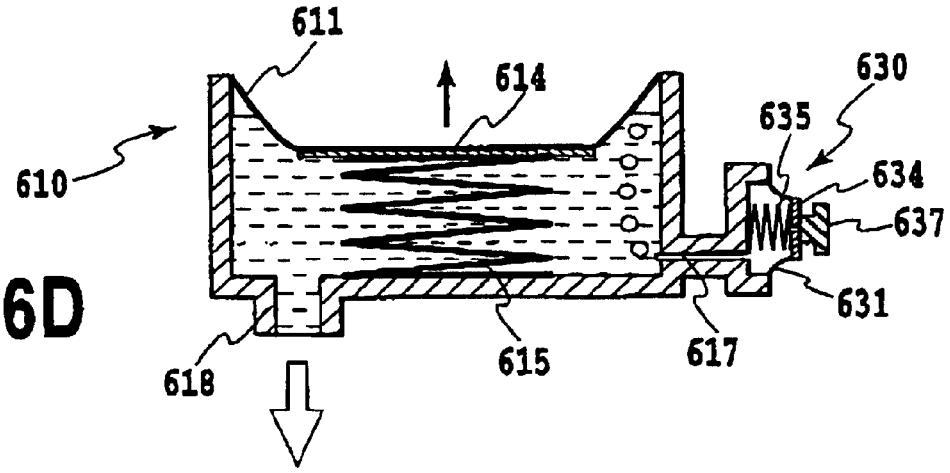
Figure 46E:
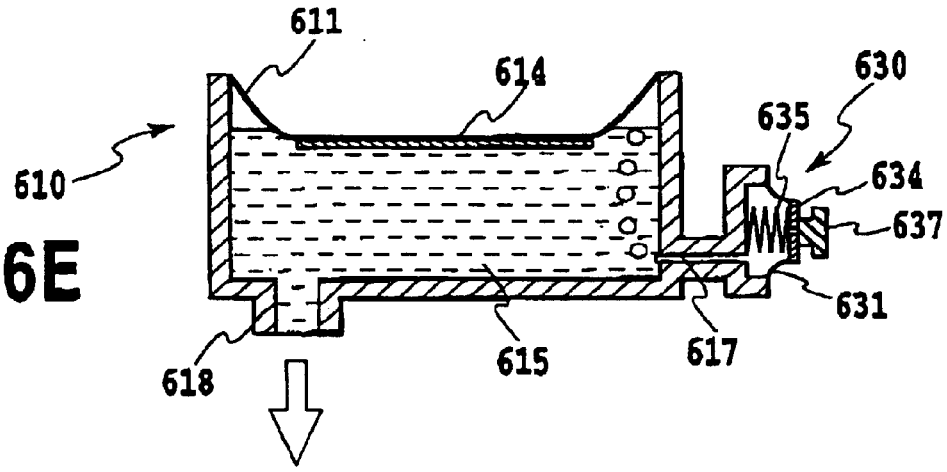

When the negative pressure in the ink containing chamber increases further, air begins to move from the valve chamber toward the ink containing chamber as shown in FIG. 46C, but the one-way valve has not been opened in this state. Immediately after air begins to move, the meniscus is instantaneously moved toward the valve chamber by the capillary force of the communication channel 617, but it is moved back to the ink containing chamber by the negative pressure in the ink containing chamber.

When the negative pressure increases further to satisfy a relationship expressed by Expression 26 below, the one-way valve is opened to allow air to be introduced into the ink containing chamber, thereby moderating the negative pressure and moderating displacement of the buffer area although only slightly. This results in the state in FIG. 46D and the change in the negative pressure at the point 61*d* in FIG. 47.

$$-PV=(F1/S1)-h\times\rho\times g-PM>F2/S2 \qquad \text{Expression 26}$$

The introduction of air decreases the negative pressure that has been increasing. The decrease in the negative pressure means a return form the state expressed by Expression 26 to the state expressed by Expression 25.

Figure 46F:
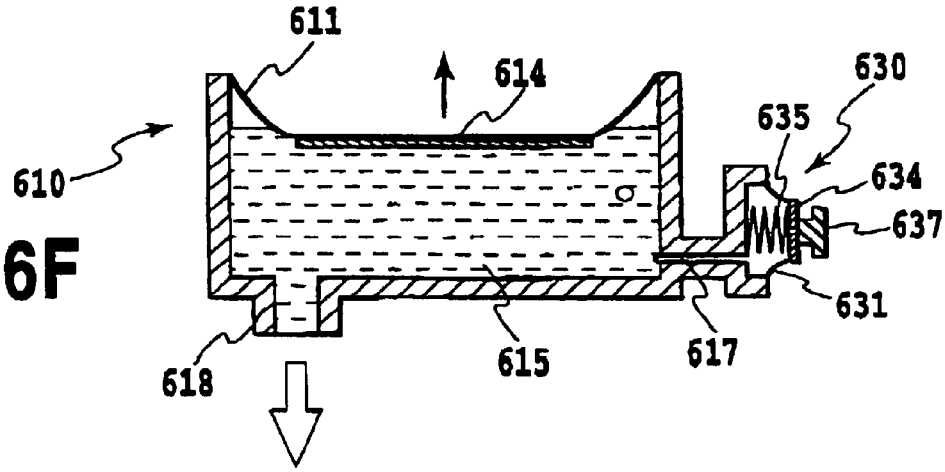

While the valve closing plate 634 moves in the closing direction again in the valve chamber 630 (FIG. 46E and the point 61*e* in FIG. 47), the negative pressure in the valve chamber is smaller than the value on the right side of Expression 22 as long as air is introduced. The opening section and the valve sealing member 637 are eventually put into tight contact with each other again (FIG. 46F and the point 61*f* in FIG. 47). Thereafter, air is moved from the valve chamber to the ink containing chamber until the negative pressure in the valve chamber becomes substantially equal to the value on the right side of Expression 22, and then the negative pressures in the chambers are substantially equivalent.

From the above description, the condition for the one-way valve in the valve chamber 630 to be opened is as expressed by Expression 27 below because the relationship among the negative pressure in the ink containing space, the pressure originating from the depth h, the meniscus holding pressure, and the pressure for urging the valve sealing member in the valve chamber 630 can be expressed as a relationship among the magnitudes of the absolute values of the respective pressures.

$$|PV|=(|F1|/S1)-h\times\rho\times g-PM>|F2|/S2 \qquad \text{Expression 27}$$

This is a general formula of a condition for designing the ink tank such that the one-way valve can properly operate to maintain an adequate negative pressure in the ink containing chamber in any case in accordance with various positional relationships between the ink containing chamber and the valve chamber in the ink tank. In the configuration shown in FIG. 46A, the communication channel 617 between the ink containing chamber and the valve chamber extends in the horizontal direction. The Expression 27 can be applied to a configuration in which a communication channel toward a valve chamber is bent upwardly to reach the valve chamber, for example, by taking account of the height depth from a position of a meniscus formed at the communication channel to the ink level in the ink containing chamber.

5.7 Application of General Formula to Various Positional Relationships between Ink Containing Chamber and Valve Chamber in Ink Tank The above general condition will now be examined by applying it to various configurations.

First, a case is considered in which the volumetric capacity of the valve chamber 630 is large in a configuration substantially similar to that shown in FIG. 46A. In this case, in order for the one-way valve to be closed, while it is strongly desired that the value "|F2/S2−|PV|" is great enough to deform the edge of the valve sealing member, it is necessary to introduce a great amount of air to decrease the negative pressure in the valve chamber.

FIG. 48 is an illustration for explaining the change in the negative pressure in this case, and the negative pressure at the time of the introduction of air (solid line) is significantly decreased compared to the change in the negative pressure in the case shown in FIG. 46A (broken line). Although the one-way valve is not left open until the pressure therein equals to the atmospheric pressure (0) because the negative pressure in the valve chamber becomes substantially equal to the negative pressure in the ink containing chamber, it is strongly desired to set the ratio between the volumetric capacities of the valve chamber and the ink containing chamber appropriately in order to prevent the pressure from decreasing below the initial value to near the atmospheric pressure.

That is, when it is assumed that the valve chamber is completely exposed to the atmosphere, the negative pressure in the ink containing chamber when the valve is closed is given as follows, where VV represents the volumetric capacity of the valve chamber including the communication channel and VT represents the volumetric capacity of the ink containing chamber.

$$PT\cong F1/S1+PM \qquad \text{Expression 28}$$

Therefore, an average negative pressure of both chambers is as follows when the one-way valve is closed.

$$(-F1/S1+PM)\times VT/(VT+VV)$$

That is, what is required is to set the ratio between the volumetric capacities of the valve chamber and the ink containing chamber such that the value becomes greater than the initial negative pressure.

A case will now be considered in which a valve chamber 730 is provided above an ink containing chamber 710 with a communication channel 717 provided therebetween as shown in FIG. 49A. In this case, the speed of air moving in the communication channel 717 is higher than the speed of air introduced through an atmosphere communication port of the valve chamber 730. In the configuration in FIG. 46A, since air that is a gas is introduced into ink that is a liquid, the speed of air moving in the communication channel 617 is lower than the speed of air introduced through the atmosphere communication port of the valve chamber 630.

When the above general formula is applied to the case shown in FIG. 49A, since the height h and the pressure PM are both '0', pressures in the ink containing chamber 710 and the valve chamber 730 are always equal to each other on an assumption that there is substantially no pressure loss of air in the communication channel 717.

Therefore, as indicated by the solid line in FIG. 49B, there is substantially no phase at which the pressures in the two chambers are uneven when compared to the change in the negative pressure in the case shown in FIG. 46A (broken line), and fluctuations of the negative pressure as a result of the opening and closing of the one-way valve are small.

This case is similar to the case described in the above item 5.1, and designing may therefore be carried out taking the relationship among the four parameters F1, F2, S1, and S2 into consideration.

A case will now be considered in which an ink containing chamber 810 and a valve chamber 830 are connected through a communication channel 817 having a large sectional area in a configuration substantially similar to that in FIG. 46A.

When an atmosphere communication port of the valve chamber 830 is located lower than the communication channel 817 in the vertical-direction, the atmosphere communication port is always in contact with ink, and a negative pressure is then to be controlled using a meniscus holding force and spring forces. In this case, there is a risk of leakage of ink as encountered in the case of the above mentioned liquid seal.

When ink consumption proceeds thereafter to reduce the ink level below the atmosphere communication port, negative pressure control is carried out using only the spring forces because the pressure PM is 0.

In the case shown in FIG. 50A, since resistance to the movement of air in the communication channel 817 is small, there is a small difference between negative pressures in the ink containing chamber and the valve chamber, and fluctuations of the negative pressure as a result of the opening and closing of the one-way valve are small compared to the change in the negative pressure (broken line) in the case shown in FIG. 46A, as indicated by the solid line in FIG. 50B. When the communication channel 817 is no longer filled with ink, communication is established between the air in both chambers, which result in a state similar to that shown in FIG. 49A.

5.8 Observation on Effects of Vibration on Ink Tank

Since a negative pressure to be controlled by a one-way valve is in a range as small as 0 to −200 mmAq (about −200 Pa), pressure fluctuations in the excess of the controllable negative pressure may be caused by even slight movement of ink or air in the valve attributable to vibration during transportation, which is considered a possible cause of undesirable introduction of air due to thus opened valve.

In this connection, the inventors examined the configuration in FIG. 46A by applying vibration thereto and found that the valve chamber was filled with ink with no air introduced therein.

The result seems to originate from the following phenomena.

i) Vibration in the ink containing chamber causes air to move from the valve chamber toward the ink containing chamber;

ii) a relative great negative pressure is instantaneously generated in the valve chamber;

iii) the negative pressure generates a force that acts to open the one-way valve;

iv) however, the pressure change attributable to vibration occurs only instantaneously, and ink enters the valve chamber from the ink containing chamber before the one-way valve is opened to introduce air to moderate the negative pressure in the valve chamber;

v) the force that acts to open the one-way valve is lost, and the valve is not opened; and vi) the above process is repeated until the valve chamber is filled with ink, and the valve chamber has no negative pressure when air in the valve chamber is eliminated.

That is, the one-way valve is not opened even though the negative pressure in the valve chamber increases because ink enters before air is introduced. Therefore, in the case of the configuration in FIG. 46A, it is desirable to set the sectional dimensions of the communication channel such that the speed of ink entering the valve chamber due to the capillary force of the communication channel exceeds the opening speed of the one-way valve.

Even when the valve chamber is filled with ink, the ink returns to the ink containing chamber with introduced air if the one-way valve is actuated by an increase in the negative pressure of the ink tank as a whole during use. In order for the actuation mechanism of the one-way valve to more effectively work, the atmosphere communication port of the valve chamber is preferably located above the end of the communication channel on the side of the valve chamber in the vertical direction in the attitude or orientation in use.

An examination on the case of an extremely large valve chamber provided results similar to those observed in the case in FIG. 46A.

Next, the configuration in FIG. 49A was examined. In this case, ink will not enter the valve chamber unlike the above-described case. Even when there is a movement of ink in the ink containing chamber, a resultant pressure change is absorbed by air present in the valve chamber and an air chamber in the ink containing chamber, the pressure change is considered to have small influence on the one-way valve. Further, it is considered that undesirable introduction of air can be more effectively prevented by absorbing fluctuations of the pressure of air with the displacement of the buffering section.

That is, the buffer spring (the spring in the ink containing chamber) can provide a higher pressure absorbing effect with the amount of displacement unchanged by making the parameter S1 greater than the parameter S2. In addition, the buffer spring can be more easily displaced in response to a slight change in the load by making a parameter K2 greater than a parameter K1.

Next, the configuration in FIG. 50A was examined. In this case, although ink easily enters the valve chamber, the ink that has entered is then easily returned to the ink containing chamber conversely, which can result in undesirable opening of the one-way valve.

It is therefore strongly desired to set the dimensions of the communication channel such that ink is held in the communication channel by a meniscus holding force even when the ink tank is inverted with the communication channel located upward in the vertical direction. Specifically, what is required is to make the meniscus holding force in the narrowest portion of the communication channel greater than the gravity of ink in a quantity equivalent to the volumetric capacity of the communication channel.

An examination was carried out also on the case of a communication channel having an extremely small sectional area. In this case, the communication channel is always filled with ink even when a pressure change occurs, and a pressure change in an ink containing chamber does not transmit into the valve chamber. However, since the actuation mechanism of the one-way valve does not work when the meniscus holding force of the communication channel exceeds the range of negative pressure control of the one-way valve, it is strongly desired to make a pressure originating from the meniscus holding force at the narrowest portion of the communication channel smaller than F2/S2.

5.9 Modification

Instead of forming a part of an inner wall of a space that constitutes an ink containing chamber of an ink container as a movable member using a deformable flexible film as in the above embodiments, the inner wall as a whole may be formed by such a member as long as an adequate buffer area is provided. Further, instead of providing such a deformable member, a member that is displaced in accordance with the volumetric capacity of a containing space S may be provided in a part of the container.

6. Others

While the above description has referred to the application of the invention to an ink tank for supplying ink to a recording head, the invention may be applied to a supply section for supplying ink to a pen as a recording section.

In addition to various recording apparatus as thus described, the invention may be used in a wide range including apparatus for supplying various liquids such as drinking water and liquid flavoring materials and apparatus for supplying pharmaceuticals in the medical field.

In addition to serial scan type apparatus as described above, the invention may be applied to recording apparatus of various types. For example, the invention may be used to configure a so-called full-line type recording apparatus utilizing a long sized recording head extending over the entire length of a recording area of a recording medium.

The invention, or various aspects or various embodiments of the same as described above makes it possible to achieve at least one of the followings.

In a configuration having a unit for generating a required negative pressure in a section containing a liquid (e.g. ink) to be supplied to the outside (e.g., a recording head) and an air introducing section for allowing air to be introduced in accordance with an increase in the negative pressure in the containing section as a result of the supply of the liquid to keep the negative pressure in an adequate range, it is possible to prevent leakage of the liquid such as ink from the air introducing section in any ambience for use or storage and to maintain stable negative pressure characteristics regardless of the phase of the consumption of the liquid. Further, since high volumetric efficiency is achieved and ink is supplied smoothly in such a state, various advantages can be achieved including stable printing quality and compact designs when used in ink jet recording systems.

In order to adjust a pressure in an ink tank or liquid container by introducing a gas, a one-way valve that allows gas to flow in one direction and disallows fluid (liquid or gas) to flow in the opposite direction may be provided separately from the ink tank. It is therefore possible to determine the disposing position of the one-way valve free from restrictions placed by the position in which the ink tank is disposed.

As a result, it is possible to provide a negative pressure adjusting mechanism for an ink tank with which freedom in designing an ink jet recording apparatus can be improved.

Ink contained in an ink tank can be supplied to an ink jet head with a stable negative pressure maintained until the ink is used up. Since a sealing member expands/contacts or moves according to a movable member, no leakage of ink occurs even when the ink tank expands as a result of changes in the ambient of the ink tank such as a temperature rise or pressure reduction.

According to the invention, the above advantages can be achieved with a small number of components, and the atmosphere can be stably introduced by providing the atmosphere introducing opening in a part of the movable member.

This makes it possible to always achieve stable characteristics of ejection of ink from an ink jet head and also contributes to a reduction of the running cost because ink can be efficiently used.

For example, by locating the flexible member or a member having high gas permeability in a low position of the container in use in the direction of the gravity, it is possible to contain a liquid in a proper state because opportunities of application of an osmotic pressure to those members are reduced to suppress permeation of the gas into the container and to supply the contained liquid with stability.

When a buffer area is provided as a result of deformation of the flexible member, it is possible to reliably absorb fluctuations of a pressure in the container as a result of a temperature rise with the buffer area which allows a significant reduction of the amount of a gas that permeates into the container, which consequently makes it possible to prevent leakage of the liquid or breakage of the container. In addition, the reduction in the amount of permeation of a gas eliminates the need for providing a great buffer area taking the expansion of the permeating gas into consideration, which makes it possible to improve the volumetric efficiency of the container accordingly.

By providing an opening/closing mechanism for introducing outside air into a container when a negative pressure in the container exceeds a predetermined value, a predetermined negative pressure can be maintained in the container to allow a liquid to be supplied stably. The opening/closing mechanism may have a configuration utilizing a valve that is opened and closed by a pressure difference.

By maintaining a stable negative pressure in the container until ink in the container is substantially used up, it is possible to supply the ink to the recording apparatus with improved stability and to suppress the running cost by eliminating waste of ink.

It is possible to supply a liquid (e.g., ink) in a liquid container to the outside until it is used up with a negative pressure in the container kept at a stable value without any unnecessary increase. Since the introduction of air to moderate the negative pressure in the liquid container can be carried out at appropriate timing, any negative pressure can be easily set as desired taking various conditions into consideration, which allows setting of a stable negative pressure with high reliability. Further, since the movable member for acting a force to generate a negative pressure and the member for opening and closing the opening for introducing air are controlled by a member having an expanding/contracting force, it is possible to absorb expansion of a gas introduced in the liquid container attributable to changes in the ambience of the liquid container such as a temperature rise or pressure reduction, which eliminates undesirable leakage of the liquid. Outside air is introduced only when there is a change in a predetermined amount from an initial position in which the liquid has not been extracted yet, and a space having a volume equivalent to the change serves as a buffer area. It is therefore possible to moderate any pressure increase as a result of an ambient change and to reliably prevent leakage of the liquid from an extracting section of the destination of the liquid (e.g., an ink ejecting port of an ink jet recording head). This also eliminates wasteful consumption of the liquid and contributes to a reduction in the running cost.

Furthermore, the above advantages can be achieved with a small number of components according to the invention.

In addition, when the invention is applied to an ink jet recording head, stable ink ejecting characteristics can be always achieved to stabilize and improve recording quality.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A liquid container comprising:

a containing portion defining a containing space for liquid;

a liquid supply portion provided with said containing portion and forming a liquid supply port for supplying liquid contained in said containing portion to the outside;

a one-way valve arranged on said containing portion for allowing an introduction of ambient air into said containing space from outside, and preventing a leakage of liquid and gas to the outside; and a mechanism having a function for keeping or expanding a capacity of said containing space, wherein said one-way valve and said mechanism act independently of each other to control a negative pressure state of said containing space.

2. A liquid container as claimed in claim 1, wherein said mechanism includes a movable member equipped with at least a part of said containing portion displaceably or deformably, and an urging means for urging said movable member in a direction to increase a capacity of said containing space.

3. A liquid container as claimed in claim 2, wherein said movable member has a film-like flexible member of which a center section forms a projection extending outward of said containing space.

4. A liquid container as claimed in claim 1, wherein said one-way valve has a blocking member capable of blocking a communication path leading to said containing space and an urging member producing an urging force for the blocking member, said communication path being open against the urging face from said urging member if pressure within said containing space becomes less than a predetermined value.

5. A liquid supplying method for supplying liquid to the outside from a containing portion defining a containing space for liquid through a supply port formed on said containing portion, comprising the steps of:

providing a one-way valve for allowing an introduction of ambient air into said containing space from outside, and preventing a leakage of liquid and gas to the outside;

providing a mechanism having a function for keeping or expanding a capacity of said containing space, and;

controlling a negative pressure state of said containing space by independent action of said one-way valve and said mechanism.

6. A liquid supplying method as claimed in claim 5, wherein said mechanism includes a movable member equipped with at least a part of said containing portion displaceably or deformably, and an urging means for urging said movable member in a direction to increase a capacity of said containing space, and wherein said containing space is maintained under a state of negative pressure by said independent action of said movable member and said urging means even if the content of ambient air introduced into said containing space increases.

7. A liquid supplying method as claimed in claim 6, wherein an amount of capacity increased due to deformation of said moving member is set to be more than the increased amount of content of ambient air.

8. A liquid supply apparatus, comprising:

a containing portion which defines a containing space for liquid and includes a liquid supply portion for forming a liquid supply port for supplying contained liquid to the outside and a gas introduction portion for introducing ambient air from outside into said containing space;

a mechanism having a function for keeping or expanding a capacity of said containing space; and a one-way valve having a gas introducing member mountable on said gas introduction portion in which, in the state where said gas introduction member is mounted onto said gas introduction portion, an introduction of the ambient air is allowed through said gas introduction portion and a leakage of liquid and gas from said containing space to the outside is prevented, and said one-way valve and said mechanism act independently of each other to control a negative pressure state of said containing space.

9. A liquid supply apparatus as claimed in claim 8, wherein said mechanism includes a movable member equipped with at least a part of said containing portion displaceably or deformably, and an urging means for urging said movable member in a direction to increase a capacity of said containing space.

10. A liquid supply apparatus as claimed in claim 8, wherein said containing portion is equipped with a movable member on at least a part thereof, said movable member being displaceable or deformable in accordance with a supply of liquid to the outside; said gas introduction portion comprises an opening arranged on said movable member; and said one-way valve has a sealing means for pressure-sealing said opening and for releasing the pressure-seal by a displacement or deformation of said movable member caused by supply of liquid from said containing portion to the outside.

11. A one-way valve mountable on a containing portion which defines a containing space for liquid, said one-way valve for allowing an introduction of ambient air from outside to said containing space and preventing a leakage of liquid and gas from said containing space to the outside, said one-way valve comprising:

a hollow gas introduction member for insertion into said containing space;

a valve chamber communicated with said gas introduction member and having an opening portion which allows an introduction of ambient air from outside; and an opening/closing member which is provided with said valve chamber and urged in the direction of closing said opening portion, whereby being activated to open said opening portion if pressure within said containing space becomes less than a predetermined value.

12. A liquid container, comprising:

a liquid containing chamber having a movable member defining a containing space of liquid at least in part thereof and being deformable according to a supply of the liquid to the outside, and having a liquid supply port for supplying liquid contained therein; and a valve chamber communicating with said containing space and having a one-way valve which allows an introduction of ambient air into said containing space from outside and which prevents a leakage of liquid and gas to the outside from said containing space;

wherein said liquid containing chamber includes an elastic member for generating an urging force F1 in the direction increasing a content of said containing space, and an urging means for receiving the urging force F1 to urge said movable member with an area S1 against said direction;

wherein said valve chamber includes a valve controlling member for generating an urging force F2 in order to control an opening operation of said one-way valve, and a closing means for receiving the urging force F2 to close said one-way valve by an act of the urging force F2 with an area S2; and wherein said one-way valve is configured to be open in order to introduce ambient air from outside, assuming that the pressure resulted from the meniscus of the liquid formed in a communicating portion which makes a communication between said containing space and said valve chamber when the liquid is present in said communicating portion is PM, the height between the meniscus and the uppermost of ink in said containing space is h, the density of the liquid is r, and the acceleration of gravitation is g, respectively; an absolute value of the negative pressure PV=−(F1/S1)+h'r'g+PM acting on said valve chamber satisfies $$|PV|>|F2|/S2.$$

13. A liquid container as claimed in any one of claim 12, wherein said one-way valve includes a flexible sheet having an opening for introduction of ambient air partially thereon and a sealing member arranged on a position opposite to the opening, said closing means has a plate-like valve closing member with an opening corresponding to said opening of said flexible sheet being joined with said flexible sheet and for urging said flexible sheet in a direction to close the opening by said sealing member due to the urging force F2.

14. A liquid container, comprising:

a movable member which defines a containing space for liquid and is displaceable according to supply of the liquid;

a liquid supply port for supplying the contained liquid to the outside; and a one-way valve having a port capable of introducing ambient air into said containing space and a sealing member for sealing said port; wherein said one-way valve is opened to introduce ambient air when a capacity of said containing space starts to decrease due to a displacement of said movable member according to supply of the liquid and becomes lower than a predetermined value.

15. A liquid container as claimed in claim 14, wherein, where an area of an acting face of the urging force for sealing said port is S2, the urging force is F2, the pressure within said containing space is P1 and the ambient pressure is P, said one-way valve is opened when the capacity becomes less than the predetermined value and the following formula $$P-P1>F2/S2$$

is satisfied.

16. A liquid container as claimed in claim 15 wherein the area S2 of the acting face of the urging force is larger than an area of said port.

17. A liquid container having a liquid supply port for supplying liquid from a containing space to the outside and a valve chamber equipped with a one-way valve for allowing an introduction of ambient air into said containing space from outside and preventing a leakage of liquid and gas from said containing space to the outside, said liquid container being generally sealed except for said liquid supply port and said one-way valve, comprising:

a negative pressure generating means for applying negative pressure to the liquid supply from said liquid supply port; and a negative pressure controlling means for controlling the negative pressure by introducing ambient air, wherein said negative pressure controlling means acts independently from said negative pressure generating means to prevent a discharge caused by an operation tending to discharge liquid and gas from said containing space to the outside.

18. A liquid container, comprising:

a movable member which defines a containing space for liquid and is displaceable in accordance with a supply of the liquid;

a liquid supply port for supplying the contained liquid to the outside;

an opening capable of introduction of ambient air into said containing space; and a valve body for sealing said opening;

wherein, said containing space is configured to maintain the capacity thereof about a predetermined value regardless of a supply of the liquid and an introduction of ambient air, after the capacity of said containing space starts to decrease according to the supply of the liquid from the state where said containing space is generally filled with the liquid to be lower than the predetermined value which causes an introduction of ambient air.

* * * * *

UNITED STATES PATENT AND TRADEMARK OFFICE

CERTIFICATE OF CORRECTION

PATENT NO. : 6,773,099 B2
DATED : August 10, 2004
INVENTOR(S) : Ryoji Inoue et al.

It is certified that error appears in the above-identified patent and that said Letters Patent is hereby corrected as shown below:

Column 1,
Line 64, "to the in" should be deleted.

Column 5,
Line 24, "into to" should read -- ink to --; and
Line 50, "though" should read -- through --.

Column 7,
Line 55, "an" should read -- a --.

Column 8,
Line 32, "form" should read -- from --.

Column 9,
Line 35, "In a" should read -- In an --.

Column 10,
Line 34, "BREIF" should read -- BRIEF --.

Column 11,
Line 27, "is" should read -- are --.

Column 13,
Lines 4 and 8, "illustrates" should read -- illustrate --; and
Line 39, "eletcrothermal" should read -- electrothermal --.

Column 15,
Line 10, "results" should read -- result --; and
Line 46, "an" should read -- a --.

Column 18,
Line 46, "reduces" should read -- reduced --.

Column 19,
Line 19, "deformations" should read -- deformation. --; and
Line 59, "flame 115" should read -- frame 115 --.

Column 20,
Line 31, "an" should read -- on --.

UNITED STATES PATENT AND TRADEMARK OFFICE

CERTIFICATE OF CORRECTION

PATENT NO. : 6,773,099 B2
DATED : August 10, 2004
INVENTOR(S) : Ryoji Inoue et al.

It is certified that error appears in the above-identified patent and that said Letters Patent is hereby corrected as shown below:

Column 22,
Line 15, "are" should read -- is --; and
Line 18, "performs" should read -- perform --.

Column 23,
Line 19, "an" should read -- the --.

Column 24,
Line 66, "connected" should read -- connected to --.

Column 25,
Line 23, "impracticable" should read -- impractical --; and
Line 42, "descried" should read -- described --.

Column 26,
Line 1, "an" should read -- a --.

Column 27,
Line 26, "recording heed 20" should read -- recording head 20 --.

Column 31,
Line 59, "shows" should read -- show --.

Column 34,
Line 55, "leakeded" should read -- leaked --; and
Line 65, "there in" should read -- there is --.

Column 36,
Line 58, "the film the film" should read -- the film --.

Column 37,
Line 4, "based" should read -- based on --.

Column 42,
Line 28, "substantially" should read -- substantial --.

Column 45,
Line 32, "surfaces" should read -- surface --.

UNITED STATES PATENT AND TRADEMARK OFFICE

CERTIFICATE OF CORRECTION

PATENT NO. : 6,773,099 B2
DATED : August 10, 2004
INVENTOR(S) : Ryoji Inoue et al.

It is certified that error appears in the above-identified patent and that said Letters Patent is hereby corrected as shown below:

Column 49,
Line 29, "slid" should read -- solid --.

Column 52,
Line 7, "result an" should read -- result in --; and
Line 11, "cause" should read -- caused --.

Column 55,
Line 42, "form" should read -- from --.

Column 56,
Line 24, "| F2/S2- | PV |" should read -- | F2 | /S2- | PV | --.

Column 60,
Line 1, "expands/contacts" should read -- expands/contracts --.

Column 62,
Line 25, "the ambient" should read -- ambient --.

Column 63,
Line 36, "any one of" should be deleted.

Signed and Sealed this

Twenty-second Day of February, 2005

JON W. DUDAS
*Director of the United States Patent and Trademark Office*